US008523963B2

(12) United States Patent
Bullinger et al.

(10) Patent No.: US 8,523,963 B2
(45) Date of Patent: Sep. 3, 2013

(54) APPARATUS FOR HEAT TREATMENT OF PARTICULATE MATERIALS

(75) Inventors: Charles W. Bullinger, Bismarck, ND (US); Mark A. Ness, Underwood, ND (US); Nenad Sarunac, Easton, PA (US); Edward K. Levy, Bethlehem, PA (US); Anthony F. Armor, Aptos, CA (US); John M. Wheeldon, Birmingham, AL (US); Matthew P. Coughlin, Hibbing, MN (US)

(73) Assignee: Great River Energy, Maple Grove, MN (US)

( * ) Notice: Subject to any disclaimer, the term of this patent is extended or adjusted under 35 U.S.C. 154(b) by 1188 days.

(21) Appl. No.: 11/199,838

(22) Filed: Aug. 8, 2005

(65) Prior Publication Data

US 2006/0107587 A1 May 25, 2006

Related U.S. Application Data

(63) Continuation-in-part of application No. 11/107,152, filed on Apr. 15, 2005, and a continuation-in-part of application No. 11/199,743, filed on Aug. 8, 2005, now Pat. No. 7,540,384, which is a continuation-in-part of application No. 11/107,153, filed on Apr. 15, 2005, now Pat. No. 7,275,644.

(60) Provisional application No. 60/618,379, filed on Oct. 12, 2004.

(51) Int. Cl.
*C10L 5/00* (2006.01)

(52) U.S. Cl.
USPC ..... 44/629; 44/626

(58) Field of Classification Search
USPC ..... 422/198, 204; 44/626, 629
See application file for complete search history.

(56) References Cited

U.S. PATENT DOCUMENTS

| | | | |
|---|---|---|---|
| 2,101,295 | A | 12/1937 | Rusk |
| 2,303,367 | A | 12/1942 | Kendall et al. |
| 2,512,422 | A | 6/1950 | Fletcher et al. |

(Continued)

FOREIGN PATENT DOCUMENTS

| | | |
|---|---|---|
| CN | 2165939 | 5/1994 |
| DE | 67 770 | 7/1969 |

(Continued)

OTHER PUBLICATIONS

Weiss H J et al, "Trocknung Von Braunkohle in Der Dampf-Wirbelschicht", VGB Kraftwekstechnik, vol. 71, No. 7, Jul. 1, 1991, pp. 664-668.

(Continued)

*Primary Examiner* — James Goloboy
*Assistant Examiner* — Latosha Hines
(74) *Attorney, Agent, or Firm* — Moss & Barnett

(57) ABSTRACT

The present invention constitutes a heat treatment apparatus like a fluidized-bed dryer for heat treating a particulate material in a low temperature, open-air process. Preferably, available waste heat sources within the surrounding industrial plan operation are used to provide heat to the dryer. Moreover, conveyor means contained within the dryer can remove larger, denser particles that could otherwise impede the continuous flow of the particulate material through the dryer or plug the fluidizing dryer. This invention is especially useful for drying coal for an electricity generation plant.

19 Claims, 32 Drawing Sheets

(56) References Cited

U.S. PATENT DOCUMENTS 2,586,818 A 2/1952 Harms
2,600,425 A * 6/1952 Parry ..... 422/204
2,671,968 A 3/1954 Criner
2,932,395 A 4/1960 Marot
3,007,577 A 11/1961 Putman
3,090,131 A 5/1963 Waterman, Jr
3,140,862 A 7/1964 Schoppe
3,238,634 A 3/1966 Groins
3,246,750 A 4/1966 Chase et al.
3,262,214 A 7/1966 Webb
3,331,754 A 7/1967 Mansfield
3,409,131 A 11/1968 Alfred at al.
3,434,932 A 3/1969 Mansfield
3,471,016 A 10/1969 Everson et al.
3,539,001 A 11/1970 Binnex et al.
3,654,705 A 4/1972 Smith et al.
3,687,431 A 8/1972 Parks
3,687,743 A 8/1972 Parks
3,721,014 A 3/1973 Voelskow
3,728,230 A 4/1973 Kemmetmueller
3,734,289 A 5/1973 Pearman
3,744,145 A 7/1973 Maxwell et al.
3,774,759 A 11/1973 Weintraub et al.
3,800,427 A 4/1974 Kemmetmueller
3,803,846 A * 4/1974 Letvin ..... 60/685
3,842,461 A 10/1974 Wurster
3,852,168 A 12/1974 Oetiker
3,856,441 A 12/1974 Suzukawa et al.
3,959,084 A 5/1976 Price
3,960,513 A 6/1976 Agarwal et al.
3,968,052 A 7/1976 Seglin et al.
3,985,516 A 10/1976 Johnson
4,028,228 A 6/1977 Ferris et al.
4,030,895 A 6/1977 Caughey
4,052,168 A 10/1977 Koppelman
4,053,364 A 10/1977 Poersch et al.
4,073,481 A 2/1978 Lawson et al.
4,100,033 A 7/1978 Holter
4,126,519 A 11/1978 Murray
4,145,489 A 3/1979 Wozny
4,152,843 A 5/1979 Kemmetmueller
4,155,313 A 5/1979 Moss
4,174,946 A 11/1979 Rohde
4,176,011 A 11/1979 Knappstein
4,192,650 A 3/1980 Seitzer
4,196,676 A 4/1980 Brown et al.
4,201,541 A 5/1980 Schoppe
4,230,559 A 10/1980 Smith
4,236,318 A 12/1980 Heard et al.
4,240,877 A 12/1980 Stahlherm et al.
4,245,395 A 1/1981 Potter
4,253,821 A 3/1981 Bradshaw
4,253,825 A 3/1981 Fasano
4,265,737 A 5/1981 Smith et al.
4,266,539 A 5/1981 Parker et al.
4,276,120 A 6/1981 Lutz
4,280,418 A 7/1981 Erhard
4,282,088 A 8/1981 Ennis
4,284,416 A 8/1981 Nahas
4,284,476 A 8/1981 Wagener et al.
4,292,742 A 10/1981 Ekberg
4,294,807 A 10/1981 Randolph
4,295,281 A * 10/1981 Potter ..... 34/371
4,299,694 A 11/1981 Goodell
4,300,291 A 11/1981 Heard et al.
4,308,102 A 12/1981 Wagener et al.
4,310,501 A 1/1982 Reh et al.
4,324,544 A 4/1982 Blake
4,330,946 A 5/1982 Courneya
4,331,445 A 5/1982 Burns
4,338,160 A 7/1982 Dellessard et al.
4,349,367 A 9/1982 Krumwiede
4,354,903 A 10/1982 Weber et al.
4,383,379 A 5/1983 Avril
4,389,794 A 6/1983 Bitterly
4,409,101 A 10/1983 Salikhov et al.
4,426,810 A * 1/1984 Rudolph et al. ..... 48/197 R
4,430,161 A 2/1984 Petrovic et al.
4,431,485 A 2/1984 Petrovic et al.
4,436,589 A 3/1984 Petrovic et al.
4,440,625 A 4/1984 Go et al.
4,444,129 A 4/1984 Ladt
4,449,483 A 5/1984 Strohmeyer
4,455,135 A 6/1984 Bitterly
4,468,288 A 8/1984 Galow et al.
4,470,878 A 9/1984 Petrovic et al.
4,481,724 A 11/1984 Petrovic et al.
4,492,040 A 1/1985 Jensen et al.
4,493,157 A 1/1985 Wicker
4,495,710 A 1/1985 Ottoson
4,506,608 A 3/1985 Strohmeyer, Jr.
4,523,388 A 6/1985 Cuel
4,530,700 A 7/1985 Sawyer et al.
4,533,438 A 8/1985 Michael et al.
4,567,674 A 2/1986 Strohmeyer, Jr.
4,571,174 A 2/1986 Shelton
4,574,744 A 3/1986 Lorenz et al.
4,575,418 A 3/1986 Robbins
4,583,301 A 4/1986 Crowley et al.
4,583,468 A 4/1986 Reed et al.
4,589,981 A 5/1986 Barari et al.
4,606,793 A 8/1986 Petrovic et al.
4,617,744 A 10/1986 Siddoway et al.
4,619,732 A 10/1986 Clay et al.
4,627,173 A 12/1986 O'Hagan et al.
4,635,379 A 1/1987 Kroneld
4,635,380 A 1/1987 Anderson
4,640,873 A 2/1987 Tajima
4,644,664 A 2/1987 Bradshaw
4,655,436 A 4/1987 Williams
4,668,255 A 5/1987 Govind
4,705,533 A 11/1987 Simmons
4,725,337 A 2/1988 Greene
4,736,711 A 4/1988 Marlair et al.
4,754,869 A 7/1988 Hutchison et al.
4,760,650 A 8/1988 Theliander et al.
4,790,748 A 12/1988 Litt et al.
4,795,037 A 1/1989 Rich, Jr.
4,800,015 A 1/1989 Simmons
4,809,537 A 3/1989 Glover et al.
4,810,258 A 3/1989 Greene
4,822,383 A 4/1989 Brose et al.
4,842,695 A 6/1989 Schmid et al.
4,848,249 A 7/1989 LePori et al.
4,852,384 A 8/1989 Woolbert et al.
4,882,274 A 11/1989 Pyne, Jr. et al.
4,888,885 A 12/1989 Caughey
4,908,124 A 3/1990 Goldbach et al.
4,945,656 A 8/1990 Judd
4,950,388 A 8/1990 Stafford
4,957,049 A 9/1990 Strohmeyer, Jr.
4,975,257 A 12/1990 Lin
5,024,681 A 6/1991 Chang
5,024,770 A 6/1991 Boyd et al.
5,033,208 A 7/1991 Ohno et al.
5,035,721 A 7/1991 Atherton
5,046,265 A 9/1991 Kalb
5,087,269 A 2/1992 Cha et al.
5,087,351 A 2/1992 Vallentine, Sr.
5,103,743 A 4/1992 Berg
5,120,431 A 6/1992 Cordonnier
5,132,007 A 7/1992 Meyer et al.
5,137,539 A 8/1992 Bowling
5,137,545 A 8/1992 Walker
5,145,489 A 9/1992 Dunlop
5,146,857 A 9/1992 Spliethoff et al.
5,158,580 A 10/1992 Chang
5,171,406 A 12/1992 Shang et al.
5,192,398 A 3/1993 Kress et al.
5,197,398 A 3/1993 Levy et al.
5,223,088 A 6/1993 Hansen
5,244,099 A 9/1993 Zaltzman et al.
5,248,387 A 9/1993 Hansen
5,283,959 A 2/1994 Nagayoshi et al.

| | | | |
|---|---|---|---|
| 5,285,581 | A | 2/1994 | Walker |
| 5,289,920 | A | 3/1994 | Godderidge et al. |
| 5,291,668 | A | 3/1994 | Becker et al. |
| 5,299,694 | A | 4/1994 | Rambaud |
| 5,322,530 | A | 6/1994 | Merriam et al. |
| 5,327,717 | A | 7/1994 | Hauk |
| 5,361,513 | A | 11/1994 | Woessner |
| 5,372,791 | A | 12/1994 | Abdulally |
| 5,373,648 | A | 12/1994 | Wolf |
| 5,399,194 | A | 3/1995 | Cochran et al. |
| 5,403,365 | A | 4/1995 | Merriam et al. |
| 5,426,932 | A | 6/1995 | Morihara et al. |
| 5,430,270 | A | 7/1995 | Findlan et al. |
| 5,471,955 | A | 12/1995 | Dietz |
| 5,491,969 | A | 2/1996 | Cohn et al. |
| 5,501,162 | A | 3/1996 | Kravets |
| 5,503,646 | A | 4/1996 | McKenny et al. |
| 5,527,365 | A | 6/1996 | Coleman et al. |
| 5,534,137 | A | 7/1996 | Griggs et al. |
| 5,537,941 | A | 7/1996 | Goidich |
| 5,546,875 | A | 8/1996 | Selle et al. |
| 5,547,549 | A | 8/1996 | Fracas |
| 5,601,703 | A | 2/1997 | Szymocha et al. |
| 5,637,336 | A | 6/1997 | Kannenberg et al. |
| 5,683,494 | A | 11/1997 | Altman et al. |
| 5,735,061 | A | 4/1998 | Lawrence |
| 5,795,484 | A | 8/1998 | Greenwald, Sr. |
| 5,827,352 | A | 10/1998 | Altman et al. |
| 5,830,246 | A | 11/1998 | Dunlop |
| 5,830,247 | A | 11/1998 | Dunlop |
| 5,832,848 | A | 11/1998 | Reynoldson et al. |
| 5,853,548 | A | 12/1998 | Piskorz et al. |
| 5,858,035 | A | 1/1999 | Dunlop |
| 5,867,921 | A | 2/1999 | Maruyama et al. |
| 5,869,810 | A | 2/1999 | Reynolds et al. |
| 5,904,741 | A | 5/1999 | Dunlop et al. |
| 5,948,143 | A | 9/1999 | Sjostrom et al. |
| 5,961,693 | A | 10/1999 | Altman et al. |
| 5,996,808 | A | 12/1999 | Levy et al. |
| 6,065,224 | A | 5/2000 | Eigner |
| 6,085,912 | A | 7/2000 | Hacking, Jr. et al. |
| 6,096,118 | A | 8/2000 | Altman et al. |
| 6,148,599 | A | 11/2000 | McIntosh et al. |
| 6,151,799 | A | 11/2000 | Jones |
| 6,162,265 | A | 12/2000 | Dunlop et al. |
| 6,249,988 | B1 | 6/2001 | Duske et al. |
| 6,298,579 | B1 | 10/2001 | Ichitani et al. |
| 6,302,945 | B1 | 10/2001 | Altman et al. |
| 6,355,094 | B1 | 3/2002 | Schomaker et al. |
| 6,422,392 | B1 | 7/2002 | Levy |
| 6,447,559 | B1 | 9/2002 | Hunt |
| 6,488,740 | B1 * | 12/2002 | Patel et al. ..... 95/71 |
| 6,500,241 | B2 | 12/2002 | Reddy |
| 6,536,133 | B1 | 3/2003 | Snaper |
| 6,547,854 | B1 | 4/2003 | Gray et al. |
| 6,584,699 | B2 | 7/2003 | Ronning et al. |
| 6,610,263 | B2 | 8/2003 | Pahlman et al. |
| 6,712,878 | B2 | 3/2004 | Chang et al. |
| 6,755,892 | B2 | 6/2004 | Nalette et al. |
| 6,783,739 | B2 | 8/2004 | Altman |
| 6,789,488 | B2 | 9/2004 | Levy et al. |
| 6,799,097 | B2 | 9/2004 | Villarreal Antelo et al. |
| 6,880,263 | B2 | 4/2005 | Gasparini et al. |
| 6,889,842 | B2 | 5/2005 | Sandlin et al. |
| 6,907,996 | B1 | 6/2005 | Fraas |
| 6,912,889 | B2 | 7/2005 | Stephanos et al. |
| 7,237,679 | B1 | 7/2007 | Hendrickson et al. |
| 2002/0184787 | A1 | 12/2002 | Ronning et al. |
| 2003/0000228 | A1 | 1/2003 | Leuenberger et al. |
| 2003/0046826 | A1 | 3/2003 | Snaper |
| 2004/0194337 | A1 | 10/2004 | Gasparini et al. |
| 2006/0075682 | A1 | 4/2006 | Bullinger et al. |
| 2006/0112588 | A1 | 6/2006 | Ness et al. |
| 2007/0251120 | A1 | 11/2007 | Connell |
| 2007/0256316 | A1 | 11/2007 | Jordison et al. |
| 2008/0028631 | A1 | 2/2008 | Leahy |
| 2008/0028634 | A1 | 2/2008 | Leahy |
| 2008/0201980 | A1 | 8/2008 | Bullinger et al. |
| 2009/0249641 | A1 | 10/2009 | Graham et al. |

FOREIGN PATENT DOCUMENTS

| | | |
|---|---|---|
| DE | 22 50 000 | 4/1974 |
| DE | 31 25 629 | 2/1983 |
| DE | 40 03 499 | 8/1990 |
| DE | 41 05 128 | 8/1992 |
| DE | 43 23 469 | 1/1995 |
| DE | 19518644 | 5/1995 |
| DE | 195 10 006 | 9/1996 |
| DE | 199 31 346 | 12/2000 |
| GB | 2 327 442 | 1/1999 |
| JP | 56014578 | 2/1981 |
| JP | 62-215691 | 9/1987 |
| JP | 08 270355 | 10/1996 |
| JP | 11-267591 A | 10/1999 |
| JP | 2001-055582 | 2/2001 |
| SU | 562707 | 6/1977 |
| SU | 909499 | 2/1982 |
| WO | WO 90/00219 | 1/1990 |
| WO | WO 94/02712 | 2/1994 |
| WO | WO 97/14926 | 4/1997 |

OTHER PUBLICATIONS

Klutz Von H-J et al, "Das WTA-Verfahren als Vortrocknungsstufe fur moderne Kraftwerkskonzepte auf Basis Braunkohle", VGB Kraftwerkstechnik, vol. 76, No. 3, Mar. 1, 1996, pp. 224-229.

Doell, Glenn "Dais-Analytic Corporation: An Energy Technology Company," (Mar. 22, 2001).

Bullinger, et al. "Coal Drying Improves Performance and Reduces Emissions," *27th International Technical Conference on Coal Utilization and Fuel Systems* (Clearwater, FL) (Mar. 4-7, 2002).

Sarunac, et al. "Coal Drying Improves Performance and Reduces Emissions," *EPRI Heat Rate Improvement Conference* (Birmingham, AL) (Jan. 2003).

Bullinger, Charles "Fuel Enhancement by Incremental Moisture Reduction," *18th International Low Rank Coal* (Jun. 25, 2003).

Ness, et al. "Pilot Coal Dryer Testing Summary," *TMRA Clean Coal Technology Workshop* (Feb. 5, 2004).

Ness, et al. "Pilot Fluidized Bed Coal Dryer: Operating Experience and Preliminary Results," *29th International Technical Conference on Coal Utilization & Fuel Systems* (Apr. 18-22, 2004).

Levy, et al. *Upgrading Low-Rank Coals Symposium* (May 2, 2004).

Ness, et al. "Pilot Fluidized Bed Coal Dryer: Operating Experience and Preliminary Results," *19th Western Fuels Symposium* (Billings, MT) (Oct. 12-14, 2004).

Sarunac, et al. "Impact of Coal Drying on Power Plant Efficiency, Operation and Emissions," *30th International Technical Conference on Coal Utilization and Fuel Systems* (Clearwater, FL) (Apr. 2005).

Sarunac, et al. "Comparison of Various Coal Drying Process Layouts and Their Impact on Plant Efficiency, Operation and Emissions," *30th International Technical Conference on Coal Utilization and Fuel Systems* (Clearwater, FL) (Apr. 2005).

Levy, et al. "The Impact of Coal Drying on Low Rank Coal Fired Power Plants," Lexington, KY Conference (May 2005).

Lehigh University "Performance and Emissions: Key Factors in Today's Competitive Energy Market" Bethlehem, PA Conference (May 25-26, 2005).

Merriam, Norman W. "Removal of Mercury from Powder River Basin Coal by Low-Temperature Thermal Treatment," *Report Under DOE CRADA Filed by Western Research Institute* (Jul. 1993).

James, Dennis R. "Lignite Fuel Enhancement: Incremental Reduction Project (Phase I) Revision I," *1st NDIC Grant Application* (Feb. 14, 2000).

Dr. Moen, et al. "Lignite Coal Dryer Project (for Great River Energy, Coal Creek Station)," *Report* (May 12, 2000).

James, Dennis R. "Lignite Fuel Enhancement: Incremental Reduction Project (Phase I)," *Status Report No. 2* (Aug. 10, 2000).

Bullinger, Charlie "Lignite Fuel Enhancement (Maximizing the Value (i.e., Lowest Cost of Electricity Produced and Reduced Emissions) of Lignite Fuel Through Incremental Moisture Reduction," *DOE Project Proposal* (Apr. 19, 2001).

Bullinger, Charlie "Lignite Fuel Enhancement: (Significantly Enhancing the Value of U.S. Lignite Fuel Its Abundant, Low-Cost and Environmentally Responsible)," *DOE Project Proposal* (Apr. 19, 2001).

Scheffknecht, Gunter "Technologies for Efficient Utilization of Low-Rank Fuels," (May 17-18, 2001).
James, Dennis R. "Lignite Fuel Enhancement: Incremental Moisture Reduction," *Final Report for Phase 1* (Dec. 14, 2001).
Kakaras, et al. "Computer Simulation Studies for the Integration of an External Dryer into a Greek Lignite-Fired Power Plant," 81 *Fuel* 583-93 (2002).
Kravetse, A. "Enhanced Rankine Cycle-Significant Reduction in NOx Emissions and Heat Rate in Both Existing and New Coal Fired Power Plants" (Unknown).
Bullinger, Charlie "Lignite Fuel Enhancement" *Project Proposal* (Jul. 31, 2002).
"Research Demonstrates Benefits of Drying Western Coal," *Lehigh Energy Update,* vol. 20(2) (Aug. 2002).
"Increasing Power Plant Efficiency-Lignite Fuel Enhancement," *DOE Project Facts Website* (May 20, 2003).
Levy, Edward K. "Use of Coal Drying to Reduce Water Consumed in Pulverized Coal Power Plants," *First Quarterly Report to DOE* (Mar. 2003).
Ness, Mark "Lignite Fuel Enhancement: Incremental Moisture Reduction Program Phase II Oct. 2003 Status Report," (Oct. 24, 2003).
Feeley et al. "Innovative Approaches and Technologies for Improved Power Plant Water Management," *U.S. DOE Program Facts* (Jan. 1, 2004).
Levy, et al. "Use of Coal Drying to Reduce Water Consumed in Pulverized Coal Power Plants," *Fourth Quarterly Report to DOE* (Jan. 1, 2004).
Levy, Edward "Performance Evaluation of Coal Creek Pilot Dryer," *Prepared for Mark Ness of GRE for Coal Creek Station* (Feb. 6, 2004).
Thwing, Theo "Lehigh Research Aids Power Plants," *The Brown and White* (*Lehigh Student Newspaper*) (Feb. 8, 2004).
Ness, Mark "Lignite Fuel Enhancement: Incremental Moisture Reduction Program Phase II Feb. 2004 Status Report," (Feb. 29, 2004).
Levy, et al. "Use of Coal Drying to Reduce Water Consumed in Pulverized Coal Power Plants," *Fifth Quarterly Report to DOE* (Apr. 1, 2004).
Levy, et al. "Separation of Ash From Lignite in a Bubbling Fluidized Bed," *Presented for Mark Ness of GRE for Coal Creek Station* (Apr. 23, 2004).
Levy, et al. "Use of Coal Drying to Reduce Water Consumed in Pulverized Coal Power Plants," *Sixth Quarterly Report to DOE* (Jul. 1, 2004).
Guffey, et al. "Thermal Pretreatment of Low-Ranked Coal for Control of Mercury Emissions," *85 Fuel Processing Technology* 521-31 (2004).
Weinstein, et al. "Lignite Fuel Enhancement: Incremental Moisture Reduction," *Memorandum,* Apr. 2001.
Levy, et al. "Use of Coal Drying to Reduce Water Consumed in Pulverized Coal Power Plants," *Seventh Quarterly Report to DOE* (Oct. 2004).
Ness, Mark "Pilot Fluidized Bed Coal Dryer: Test 48, 49, 50, 52, 57, 58, and 59 Results," (Dec. 26, 2004).
Dubrovich, Matthew "Ash Separation From Lignite Using a Bubbling Fluidized Bed," *Thesis Paper Presented to the Graduate and Research Committee of Lehigh University* (Jan. 21, 2005).
Ness, Mark "Lignite Fuel Enhancement: Incremental Moisture Reduction Program Phase II Mar. 2005 Final Report," *Report to NDIC* (Mar. 31, 2005).
Armor, Tony "Interest Group on Drying of Wet Fuels Using Waste Heat," (Uknown).
Niro, Inc., "Fluid Bed Processing Systems," http:// www.niroinc.com/html/drying/fluidbed.html (Unknown).
Niro, Inc., "Particulate Processing: Fluid Bed Processors," http://niroinc.com/html/drying/fluidbed.html (2001).

* cited by examiner

Schematic of the Pilot Plant

APPARATUS FOR HEAT TREATMENT OF PARTICULATE MATERIALS

CROSS-REFERENCE TO RELATED APPLICATION

This application is a continuation-in-part of U.S. Ser. No. 11/107,152 filed on Apr. 15, 2005, which claims the benefit of U.S. provisional application Ser. No. 60/618,379 filed on Oct. 12, 2004; and is a continuation-in-part of U.S. Ser. No. 11/199,743 for "Apparatus and Method of Separating and Concentrating Organic and/or Non-Organic Material" filed on Aug. 8, 2005 now U.S. Pat. No. 7,540,384, which is a continuation-in-part of U.S. Ser. No. 11/107,153 filed on Apr. 15, 2005 now U.S. Pat. No. 7,275,644, which claims the benefit of U.S. provisional application Ser. No. 60/618,379 filed on Oct. 12, 2004; all of which are hereby incorporated by reference in their entirety.

FIELD OF THE INVENTION

This invention relates to an apparatus for heat treating particulate materials in a commercially viable manner. More specifically, the invention utilizes a continuous throughput dryer, such as a fluidized bed dryer, in a low-temperature, open-air process to dry such materials to improve their thermal content or processability and reduce plant emissions before the particulate material is processed or combusted at an industrial process plant. While this apparatus may be utilized in many varied industries in an efficient and economical manner, it is particularly well suited for use in electric power generation plants for reducing moisture content in coal before it is fired.

BACKGROUND OF THE INVENTION

Electric power is a necessity for human life as we know it. It does everything from operating machinery in factories to pumping water on farms to running computers in offices to providing energy for lights, heating, and cooling in most homes.

Large electric power plants that provide this electric power harness the energy of steam or flowing water to turn the shaft of a turbine to drive, in turn, an electric generator. While some electric power plants are operated by hydroelectric or nuclear energy sources, about 63% of the world's electric power and 70% of the electric power produced in the United States is generated from the burning of fossil fuels like coal, oil, or natural gas. Such fuel is burned in a combustion chamber at the power plant to produce heat used to convert water in a boiler to steam. This steam is then superheated and introduced to huge steam turbines whereupon it pushes against the fanlike blades of the turbine to rotate a shaft. This spinning shaft, in turn, rotates the rotor of an electric generator to produce electricity.

Once the steam has passed through the turbine, it enters a condenser where it passes around pipes carrying cooling water, which absorbs heat from the steam. As the steam cools, it condenses into water which can then be pumped back to the boiler to repeat the process of heating it into steam once again. In many power plants, this water in the condenser pipes that has absorbed this heat from the steam is pumped to a spray pond or cooling tower to be cooled. The cooled water can then be recycled through the condenser or discharged into lakes, rivers, or other water bodies.

Eighty-nine percent of the coal mined in the United States is used as the heat source for electric power plants. Unlike petroleum and natural gas, the available supplies of coal that can be economically extracted from the earth are plentiful.

There are four primary types of coal: anthracite, bituminous, subbituminous, and lignite. While all four types of these coals principally contain carbon, hydrogen, nitrogen, oxygen, and sulfur, as well as moisture, the specific amounts of these solid elements and moisture contained in coal varies widely. For example, the highest ranking anthracite coals contain about 98% wt carbon, while the lowest ranking lignite coals (also called "brown coal") may only contain about 30% wt carbon. At the same time, the amount of moisture may be less than 1% in anthracite and bituminous coals, but 25-30% wt for subbituminous coals like Powder River Basin ("PRB"), and 35-40% wt for North American lignites. For Australia and Russia, these lignite moisture levels may be as high as 50% and 60%, respectively. These high-moisture subbituminous and lignite coals have lower heating values compared with bituminous and anthracite coals because they produce a smaller amount of heat when they are burned. Moreover, high fuel moisture affects all aspects of electric power unit operation including performance and emissions. High fuel moisture results in significantly lower boiler efficiencies and higher unit heat rates than is the case for higher-rank coals. The high moisture content can also lead to problems in areas such as fuel handling, fuel grinding, fan capacity, and high flue gas flow rates.

Bituminous coals therefore have been the most widely used rank of coal for electric power production because of their abundance and relatively high heating values. However, they also contain medium to high levels of sulfur. As a result of increasingly stringent environmental regulations like the Clean Air Act in the U.S., electric power plants have had to install costly scrubber devices upstream of the chimneys of these plants to prevent the sulfur dioxide ("$SO_2$"), nitrous oxides ("$NO_x$"), mercury compounds, and fly ash that result from burning these coals from polluting the air.

Lower-rank coals like subbituminous and lignite coals have gained increasing attention as heat sources for power plants because of their low sulfur content. Burning them as a fuel source can make it easier for power plants to comply with federal and state pollution standards. Also of great relevance is the fact that these subbituminous and lignite coals make up much of the available coal reserves in the western portion of the U.S. However, the higher moisture content of these lower-rank coal types reduces their heat values as a source of heat combustion. Moreover, such higher moisture levels can make such coals more expensive to transport relative to their heat values. They can also cause problems for industry because they break up and become dusty when they lose their moisture, thereby making it difficult to handle and transport them.

While natural gas and fuel oil have almost entirely replaced coal as a domestic heating fuel due to pollution concerns, the rising cost of oil and natural gas has led some factories and commercial buildings to return to coal as a heating source. Because of their higher heating values, bituminous and anthracite coals are generally preferred for these heating applications.

Coal is also the principal ingredient for the production of coke which is used in the manufacture of iron and steel. Bituminous coal is heated to about 2000° F. (1100° C.) in an air-tight oven wherein the lack of oxygen prevents the coal from burning. This high level of heat converts some of the solids into gases, while the remaining hard, foam-like mass of nearly pure carbon is coke. Most coke plants are part of steel mills where the coke is burned with iron ore and limestone to turn the iron ore into pig iron subsequently processed into steel.

Some of the gases produced during carbonization within the coke-making process turn into liquid ammonia and coal tar as they cool. Through further processing, these residual gases can be changed into light oil. Such ammonia, coal tar, and light oil can be used by manufacturers to produce drugs, dyes, and fertilizers. The coal tar, itself, can be used for roofing and road surfacing applications.

Some of the gas produced during carbonization in the coke-making process does not become liquid. This "coal gas" burns like natural gas, and can provide heat for the coke making and steel-making processes. The alternative fuels industry has also developed processes for the gasification of coal directly without carbonization. High-energy gas and high-energy liquid fuel substitutes for gasoline and fuel oil result from such gasification processes. Thus, there are many valuable uses for coal besides its intrinsic heat value.

It has previously been recognized within the industry that heating coal reduces its moisture, and therefore enhances the rank and BTU production of the coal by drying the coal. Prior to its combustion in hot water boilers, drying of the coal can enhance the resulting efficiency of the boiler.

A wide variety of dryer devices have been used within the prior art to dry coal. U.S. Pat. No. 5,103,743 issued to Berg, for example, discloses a rotary kiln in which the wet coal is dried in a drying space defined by the shell surface of the rotary kiln and a jacket surrounding the shells surface. Flue gases produced within the rotary kiln are passed with the wet coal through the drying space, so that the radiation heat of the shell surface and the heat of the hot flue gases simultaneously dry the coal. U.S. Pat. No. 4,470,878 issued to Petrovic et al., on the other hand, teaches a cascaded whirling bed dryer for preheating coal charged to a coking process wherein the coal is exposed to an indirect heat transfer while whirling in a coal-steam mixture. Cooling gases used to cool hot coke from the coke oven are recirculated to the successive cascades of the whirling bed dryer to preheat the coal.

An elongated slot dryer is disclosed in U.S. Pat. No. 4,617,744 issued to Siddoway et al. for drying wet solid particulate material like coal. The coal is introduced through the top of a trench portion of the slot dryer and exits through a bottom aperture while counter-currently contacting a drying fluid that is passed in a downwardly direction within the trench and then turned gently upward to counter-current contact the wet descending particles. A conveyor system located along the bottom of the slot dryer transports the dried coal particles.

A hopper dryer is taught by U.S. Pat. No. 5,033,208 issued to Ohno et al. This device consists of a double cylinder configuration with an annular region in between. The coal particles are introduced into this annular region, and hot gas passes through apertures in the inner cylinder to come into contact with the coal particles and is discharged through apertures in the outer cylinder.

U.S. Pat. No. 4,606,793 issued to Petrovic et al. discloses a traveling bed dryer for preheating coal fed to a coking furnace. Heat in a hot gas or waste heat vapor discharged from the dry cooling of the coke is recirculated to a heat exchange tube located within the traveling bed drier.

U.S. Pat. No. 4,444,129 issued to Ladt teaches a vibrating fluidized bed dryer used to dry coal particles smaller than 28-mesh in size. A coal-fired burner supplies hot drying gases to the dryer. A regenerative separator positioned between the burner and the vibrating fluidized bed dryer removes ash from the coal particles. The hot gas exhaust is also cleansed of particulate coal particles which are then reused for the coal-fired burner.

While all of these different dryer devices may be used to remove moisture from particulate materials like coal, they are relatively complicated in structure, suffer from relative inefficiencies in heat transport, and in some cases are better suited for batch operations rather than continuous operations. Therefore, fluidized-bed dryers or reactors have become well-known within the industry for drying coal. In such dryers, a fluidizing medium is introduced through holes in the bottom of the fluidized bed to separate and levitate the coal particles for improved drying performance. The fluidizing medium may double as a direct heating medium, or else a separate indirect heat source may be located within the fluidized bed reactor. The coal particles are introduced at one end of the reactor, and provide the propulsive means for transporting the particles along the length of the bed in their fluidized state. Thus, fluidized bed reactors are good for a continuous drying process, and provide a greater surface contact between each fluidized particle and the drying medium. See, e.g., U.S. Pat. No. 5,537,941 issued to Goldich; U.S. Pat. No. 5,546,875 issued to Selle et al.; U.S. Pat. No. 5,832,848 issued to Reynoldson et al.; U.S. Pat. Nos. 5,830,246, 5,830,247, and 5,858,035 issued to Dunlop; U.S. Pat. No. 5,637,336 issued to Kannenberg et al.; U.S. Pat. No. 5,471,955 issued to Dietz; U.S. Pat. No. 4,300,291 issued to Heard et al.; and U.S. Pat. No. 3,687,431 issued to Parks.

Many of these conventional drying processes, however, have employed very high temperatures and pressures. For example, the Bureau of Mines process is performed at 1500 psig, while the drying process disclosed in U.S. Pat. No. 4,052,168 issued to Koppelman requires pressures of 1000-3000 psi. Similarly, U.S. Pat. No. 2,671,968 issued to Criner teaches the use of updrafted air at 1000° F. Likewise, U.S. Pat. No. 5,145,489 issued to Dunlop discloses a process for simultaneously improving the fuel properties of coal and oil, wherein a reactor maintained at 850-1050° F. is employed. See also U.S. Pat. No. 3,434,932 issued to Mansfield (1400-1600° F.); and U.S. Pat. No. 4,571,174 issued to Shelton (≦1000° F.).

The use of such very high temperatures for drying or otherwise treating the coal requires enormous energy consumption and other capital and operating costs that can very quickly render the use of lower-ranked coals economically unfeasible. Moreover, higher temperatures for the drying process create another emission stream that needs to be managed. Further complicating this economic equation is the fact that prior art coal drying processes have often relied upon the combustion of fossil fuels like coal, oil, or natural gas to provide the very heat source for improving the heat value of the coal to be dried. See, e.g., U.S. Pat. No. 4,533,438 issued to Michael et al.; U.S. Pat. No. 4,145,489 issued to Dunlop; U.S. Pat. No. 4,324,544 issued to Blake; U.S. Pat. No. 4,192,650 issued to Seitzer; U.S. Pat. No. 4,444,129 issued to Ladt; and U.S. Pat. No. 5,103,743 issued to Berg. In some instances, this combusted fuel source may constitute coal fines separated and recycled within the coal drying process. See, e.g., U.S. Pat. No. 5,322,530 issued to Merriam et al; U.S. Pat. No. 4,280,418 issued to Erhard; and U.S. Pat. No. 4,240,877 issued to Stahlherm et al. Efforts have therefore been made to develop processes for drying coal using lower temperature requirements. For example, U.S. Pat. No. 3,985,516 issued to Johnson teaches a drying process for low-rank coal using warm inert gas in a fluidized bed within the 400-500° F. range as a drying medium. U.S. Pat. No. 4,810,258 issued to Greene discloses the use of a superheated gaseous drying medium to heat the coal to 300-450° F., although its preferred temperature and pressure is 850° F. and 0.541 psi. See also U.S. Pat. Nos. 4,436,589 and 4,431,585 issued to Petrovic et al. (392° F.); U.S. Pat. No. 4,338,160 issued to Dellessard et al. (482-1202° F.); U.S. Pat. No. 4,495,710 issued to Ottoson (400-900° F.); U.S. Pat. No. 5,527,365 issued to Coleman et al. (302-572° F.); U.S. Pat. No. 5,547,549 issued to Fracas (500-600° F.); U.S. Pat. No. 5,858,035 issued to Dunlop; and U.S. Pat. No. 5,904,741 and U.S. Pat. No. 6,162,265 issued to Dunlop et al. (480-600° F.).

Several prior art coal drying processes have used still lower temperatures—albeit, only to dry the coal to a limited extent. For example, U.S. Pat. No. 5,830,247 issued to Dunlop discloses a process for preparing irreversibly dried coal using a first fluidized bed reactor with a fluidized bed density of 20-40 lbs/ft$^3$, wherein coal with a moisture content of 15-30% wt, an oxygen content of 10-20%, and a 0-2-inch particle size is subjected to 150-200° F. for 1-5 minutes to simultaneously comminute and dewater the coal. The coal is then fed to a second fluidized bed reactor in which it is coated with mineral oil and then subjected to a 480-600° F. temperature for 1-5 minutes to further comminute and dehydrate the product. Thus, it is apparent that not only is this process applied to coals having relatively lower moisture contents (i.e., 15-30%), but also the coal particles are only partially dewatered in the first fluidized bed reactor operated at 150-200° F., and the real drying takes place in the second fluidized bed reactor that is operated at the higher 480-600° F. bed temperature.

Likewise, U.S. Pat. No. 6,447,559 issued to Hunt teaches a process for treating coal in an inert atmosphere to increase its rank by heating it initially at 200-250° F. to remove its surface moisture, followed by sequentially progressive heating steps conducted at 400-750° F., 900-1100° F., 1300-1550° F., and 2000-2400° F. to eliminate the water within the pores of the coal particles to produce coal with a moisture content and volatiles content of less than 2% and 15%, respectively, by weight. Again, it is clear that the initial 200-250° F. heating step provides only a limited degree of drying to the coal particles.

One of the problems that can be encountered with the use of fluidized-bed reactors to dry coal is the production of large quantities of fines entrapped in the fluidizing medium. Especially at higher bed operating conditions, these fines can spontaneously combust to cause explosions. Therefore, many prior art coal drying processes have resorted to the use of inert fluidizing gases within an air-free fluidized bed environment to prevent combustion. Examples of such inert gas include nitrogen, carbon dioxide, and steam. See, e.g., U.S. Pat. No. 3,090,131 issued to Waterman, Jr.; U.S. Pat. No. 4,431,485 issued to Petrovic et al.; U.S. Pat. Nos. 4,300,291 and 4,236,318 issued to Heard et al.; U.S. Pat. No. 4,292,742 issued to Ekberg; U.S. Pat. No. 4,176,011 issued to Knappstein; U.S. Pat. No. 5,087,269 issued to Cha et al.; U.S. Pat. No. 4,468,288 issued to Galow et al.; U.S. Pat. No. 5,327,717 issued to Hauk; U.S. Pat. No. 6,447,559 issued to Hunt; and U.S. Pat. No. 5,904,741 issued to Dunlop et al. U.S. Pat. No. 5,527,365 issued to Coleman et al. provides a process for drying low-quality carbonaceous fuels like coal in a "mildly reducing environment" achieved through the use of lower alkane inert gases like propane or methane. Still other prior art processes employ a number of heated fluidizing streams maintained at progressively decreasing temperatures as the coal travels through the length of the fluidized bed reactor to ensure adequate cooling of the coal in order to avoid explosions. See, e.g., U.S. Pat. No. 4,571,174 issued to Shelton; and U.S. Pat. No. 4,493,157 issued to Wicker.

Still another problem previously encountered by the industry when drying coal is its natural tendency to reabsorb water moisture in ambient air conditions over time after the drying process is completed. Therefore, efforts have been made to coat the surface of the dried coal particles with mineral oil or some other hydrocarbon product to form a barrier against adsorption of moisture within the pores of the coal particles. See, e.g., U.S. Pat. Nos. 5,830,246 and 5,858,035 issued to Dunlop; U.S. Pat. No. 3,985,516 issued to Johnson; and U.S. Pat. Nos. 4,705,533 and 4,800,015 issued to Simmons.

In order to enhance the process economics of drying low-rank coals, it is known to use waste heat streams as supplemental heat sources to the primary combustion fuel heat source. See U.S. Pat. No. 5,322,530 issued to Merriam et al. This is particularly true within coking coal production wherein the cooling gas heated by the hot coke may be recycled for purposes of heating the drying gas in a heat exchanger. See, e.g., U.S. Pat. No. 4,053,364 issued to Poersch; U.S. Pat. No. 4,308,102 issued to Wagener et al.; U.S. Pat. No. 4,338,160 issued to Dellessard et al.; U.S. Pat. No. 4,354,903 issued to Weber et al.; U.S. Pat. No. 3,800,427 issued to Kemmetmueller; U.S. Pat. No. 4,533,438 issued to Michael et al.; and U.S. Pat. Nos. 4,606,793 and 4,431,485 issued to Petrovic et al. Likewise, flue gases from fluidized bed combustion furnaces have been used as a supplemental heat source for a heat exchanger contained inside the fluidized bed reactor for drying the coal. See, e.g., U.S. Pat. No. 5,537,941 issued to Goldich; and U.S. Pat. No. 5,327,717 issued to Hauk. U.S. Pat. No. 5,103,743 issued to Berg discloses a method for drying solids like wet coal in a rotary kiln wherein the dried material is gasified to produce hot gases that are then used as the combustion heat source for radiant heaters used to dry the material within the kiln. In U.S. Pat. No. 4,284,476 issued to Wagener et al., stack gas from an associated metallurgical installation is passed through hot coke in a coke production process to cool it, thereby heating the stack gas which is then used to preheat the moist coal feed prior to its conversion into coke.

None of these prior art processes, however, appear to employ a waste heat stream in a coal drying operation as the sole source of heat used to dry the coal. Instead, they merely supplement the primary heat source which remains combustion of a fossil fuel like coal, oil, or natural gas. In part, this may be due to the relatively high drying temperatures used within these prior art dryers and associated processes. Thus, the process economics for drying the coal products, including low-rank coals, continues to be limited by the need to burn fossil fuels in order to dry a fossil fuel (i.e., coal) to improve its heat value for firing a boiler in a process plant (e.g., an electric power plant).

Moreover, many prior art fluidized bed dryers can suffer from plugging as the larger and denser coal particles settle to the bottom of the dryer, and make it more difficult to fluidize the rest of the particles. Condensation within the upper region of the dryer can also cause the fluidized particles to agglomerate and fall to the bottom of the dryer bed, thereby contributing to this plugging problem. For this reason, many of the prior art fluidized dryer designs seem to be vertical in orientation or feature multiple, cascading dryers with fluidizing medium inlet jets directed to creating improved fluidizing patterns for the coal particles contained within the dryer.

The operation of a dryer unit such as a fluidized bed dryer at lower temperatures below 300° F. would be desirable, and could obviate the need to suppress spontaneous combustions of the coal particles within the dryer. Moreover, incorporation of mechanical means within the fluidized bed dryer for physically separating and removing larger, denser coal particles from the dryer bed region and eliminating condensation around the fluidized particles would eliminate potential plugging problems that can otherwise crease dryer inefficiencies. Drying the coal prior to its introduction to the boiler furnace should improve the process economics of using low-rank coals like subbituminous and lignite coal. Such low-rank coal sources could suddenly become viable fuel sources for power plants compared with the more traditionally used bituminous and anthracite coals. The economical use of lower-sulfur subbitumionous and lignite coals, in addition to removal of undesirable elements found within the coal that causes pollution, would also be greatly beneficial to the environment.

SUMMARY OF THE INVENTION

An apparatus for heat treating or otherwise enhancing the quality characteristics of particulate materials used as an essential component in an industrial plant operation while preventing plugging is provided according to the invention. Such particulate materials can include fuel sources combusted within the industrial plant operation, or raw materials used to make the finished products resulting from the plant operation. Although not essential, such heat treatment apparatus is preferably heated by one or more waste heat sources available within the industrial plant operation. Such waste heat sources include, but are not limited to, hot flue or stack gases from furnaces, hot condenser cooling water, process steam from turbines, and other process streams with elevated heat values. Thus, such invention enables the heat treatment of the particulate material on a more economical basis, thereby permitting the use of lower-ranked (e.g., higher moisture) material that might not otherwise be viable within the industrial plant operation.

Although the invention has application to many varied industries, for illustrative purposes, the invention is described herein with respect to a typical coal-burning electric power generating plant, where removal of some of the moisture from the coal in a dryer is desirable for improving the heat value of the coal and the resulting boiler efficiency of the plant. Drying coal in this manner can enhance or even enable the use of low-rank coals like subbituminous and lignite coals. By reducing the moisture content of the coal, regardless of whether it constitutes low-rank or high-rank coal, other enhanced operating efficiencies may be realized, as well.

Such coal fuel stock need not be dried to absolute zero moisture levels in order to fire the power plant boilers on an economically viable basis. Instead, by using such available waste heat sources to dry the coal to a sufficient level, the boiler efficiency can be markedly increased, while maintaining the processing costs at an economically viable level. This provides true economic advantage to the plant operator. Reduction of the moisture content of lignite coals from a typical 39-60% level to 10% or lower is possible, although 27-32% is preferable. This preferred level is dictated by the boiler's ability to transfer heat.

While the heat treatment apparatus of this invention focuses upon the use of available waste heat sources like spent steam from a steam turbine, thermal energy contained within flue gas leaving the plant, or hot condenser cooling water leaving the condenser to enable the moisture reduction or other processing step, it should be appreciated that a primary heat source like combustion heat may be added to the system for utilizing waste heat sources to achieve the desired result on an economic basis. Typically, this will be a small amount of primary heat relative to the waste heat sources used.

The present invention utilizes fixed bed driers and fluidized bed driers, both single and multiple-stage, to pre-dry and further clean the material before it is consumed within the industrial plant operation, although other commercially known types of dryers may be employed. Moreover, this drying process takes place in a low-temperature, open-air system, thereby further reducing the operating costs for the industrial plant. The drying temperature will preferably be kept below 300° F., more preferably between 200-300° F. With the present invention, a portion of the hot condenser cooling water leaving the condenser could be diverted and used for preheating the inlet air directed to the APH to create a "thermal amplifier" effect.

The heat treatment apparatus of the present invention also provides a conveyor means such as a screw auger located within the dryer unit for moving to the side or removing outside of the unit larger, denser particles of the particulate ("undercut") material that would otherwise impede the continuous flow of particulate material through the dryer or plug up the dryer. The removal of such undercut particles can increase the dryer efficiency and be easily achieved in the first stage of a multiple-stage dryer.

The present invention also provides a system for removing fly ash, sulfur, mercury-bearing material, and other harmful pollutants from the coal using the material segregation and sorting capabilities of fluidized beds, in contrast to current prior art systems that attempt to remove the pollutants and other contaminates after the coal has been burned. Removal of such pollutants and other contaminants before the coal is burned eliminates potential harm that may be caused to the environment by the contaminants in the plant processes, with the expected benefits of lower emissions, coal input levels, auxiliary power needs to operate the plant, plant water usage, equipment maintenance costs caused by metal erosion and other factors, and capital costs arising from equipment needed to extract these contaminants from the flue gas.

DETAILED DESCRIPTION OF THE PREFERRED EMBODIMENT

Figure 1:
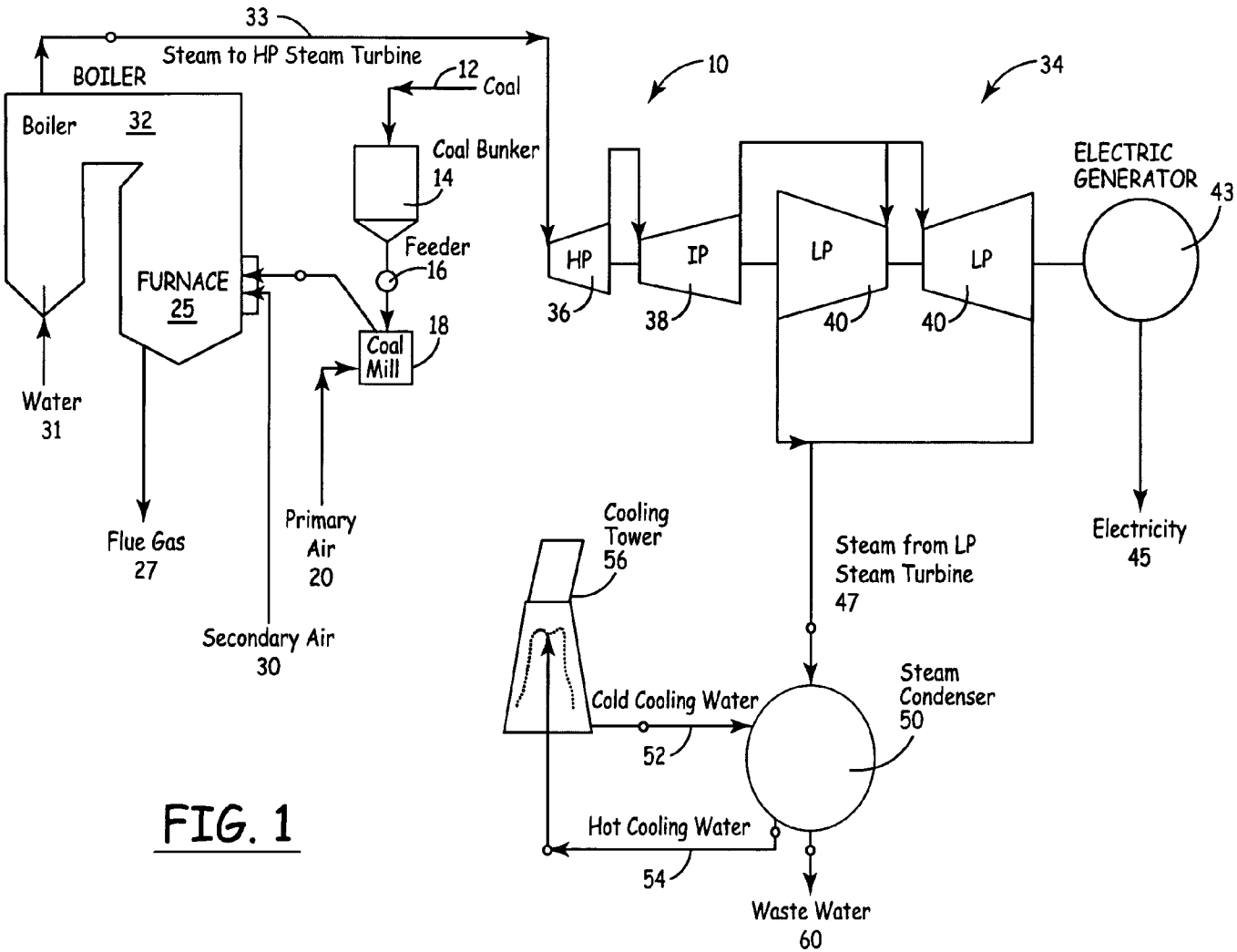
FIG. 1 is a schematic diagram illustrating a simplified coal-fired power plant operation for producing electricity.

An apparatus for heat treating particulate materials at relatively low temperatures while preventing plugging is provided by the invention. Such invention allows for the drying of the material on a more economical basis, thereby enabling the use of lower-ranked (e.g., higher moisture) material that might not otherwise be viable within an industrial plant operation. Use of the heat treatment apparatus may also enable reduction in pollutants and other undesirable elements contained within the material before it is processed within the industrial plant operation.

Although the invention has application to many varied industries, for illustrative purposes, the invention is described herein with respect to a typical coal-burning electric power generating plant, where removal of some of the moisture from the coal in a dryer is desirable for improving the heat value of the coal and the resulting boiler efficiency of the plant. Drying coal in this manner can enhance or even enable the use of low-rank coals like subbituminous and lignite coals. By reducing the moisture content of the coal, regardless of whether it constitutes low-rank or high-rank coal, other enhanced operating efficiencies may be realized, as well. For example, drier coal will reduce the burden on the coal handling system, conveyers and coal crushers in the electric generating plant. Since drier coal is easier to convey, this reduces maintenance costs and increases availability of the coal handling system. Drier coal is also easier to pulverize, so less "mill" power is needed to achieve the same grind size (coal fineness). With less fuel moisture, moisture content leaving the mill is reduced. This will improve the results of grinding of the coal. Additionally, less primary air used to convey, fluidize, and heat the coal is needed. Such lower levels of primary air reduces air velocities and with lower primary air velocities, there is a significant reduction of erosion in coal mills, coal transfer pipes, coal burners, and associated equipment. This has the effect of reducing coal transfer pipe and mill maintenance costs, which are, for lignite-fired plants, very high. Reductions in stack emissions should also be realized, thereby improving collection efficiency of downstream environmental protection equipment.

Such coal fuel stock need not be dried to absolute zero moisture levels in order to fire the power plant boilers on an economically viable basis. Instead, by using such available waste heat sources to dry the coal to a sufficient level, the boiler efficiency can be markedly increased, while maintaining the processing costs at an economically viable level. This provides true economic advantage to the plant operator. Reduction of the moisture content of lignite coals from a typical 39-60% level to 10% or lower is possible, although 27-32% is preferable. This preferred level is dictated by the boiler's ability to transfer heat.

The present invention preferably utilizes multiple plant waste heat sources in various combinations to dry the material without adverse consequences to plant operations. In a typical power plant, waste process heat remains available from many sources for further use. One possible source is a steam turbine. Steam may be extracted from the steam turbine cycle to dry coal. For many existing turbines, this could reduce power output and have an adverse impact on performance of turbine stages downstream from the extraction point, making this source for heat extraction of limited desirability. For newly built power plants, however, steam turbines are designed for steam extraction without having a negative effect on stage efficiency, thereby enabling such steam extraction to be a part of the waste heat source used for coal drying for new plants.

Another possible source of waste heat for drying coal is the thermal energy contained within flue gas leaving the plant. Using the waste heat contained in flue gas to remove coal moisture may decrease stack temperature, which in turn reduces buoyancy in the stack and could result in condensation of water vapor and sulfuric acid on stack walls. This limits the amount of heat that could be harvested from flue gas for coal drying, especially for units equipped with wet scrubbers, which may thereby dictate that hot flue gas is not the sole waste heat source used in many end-use applications under this invention.

In a Rankine power cycle, heat is rejected from the cycle in the steam condenser and/or cooling tower. Heat rejected in a steam condenser typically used in utility plants represents a large source of waste heat, the use of which for a secondary purpose minimally impacts plant operation. A portion of this hot condenser cooling water leaving the condenser could therefore be diverted and used instead for coal drying. Engineering analyses show that, at full unit load, only 2 percent of the heat rejected in the condenser is needed to decrease coal moisture content by 4 percent points. Utilization of this heat source, solely or in combination with other available plant waste heat sources, provides optimal use of plant waste heat sources without adverse impact on plant operations.

While this invention focuses upon the use of available waste heat sources to enable the moisture reduction or other processing step, it should be appreciated that a primary heat source like combustion heat may be added to the system for utilizing waste heat sources to achieve the desired result on an economic basis. Typically, this will be a small amount of primary heat relative to the waste heat sources used.

The present invention utilizes fixed bed driers and fluidized bed driers, both single and multiple-stage, to pre-dry and further clean the material before it is consumed within the industrial plant operation, although other commercially known types of dryers may be employed. Moreover, this drying process takes place in a low-temperature, open-air system, thereby further reducing the operating costs for the industrial plant. The drying temperature will preferably be kept below 300° F., more preferably between 200-300° F.

The heat treatment apparatus of the present invention also provides a system for removing fly ash, sulfur, mercury-bearing material, and other harmful pollutants from the coal using the material segregation and sorting capabilities of fluidized beds, in contrast to current prior art systems that attempt to remove the pollutants and other contaminates after the coal has been burned. Removal of such pollutants and other contaminants before the coal is burned eliminates potential harm that may be caused to the environment by the contaminants in the plant processes, with the expected benefits of lower emissions, coal input levels, auxiliary power needs to operate the plant, plant water usage, equipment maintenance costs caused by metal erosion and other factors, and capital costs arising from equipment needed to extract these contaminants from the flue gas.

For purposes of the present invention, "particulate material" means any granular or particle compound, substance, element, or ingredient that constitutes an integral input to an industrial plant operation, including but not limited to combustion fuels like coal, biomass, bark, peat, and forestry waste matter; bauxite and other ores; and substrates to be modified or transformed within the industrial plant operation like grains, cereals, malt, cocoa.

In the context of the present invention, "industrial plant operation" means any combustion, consumption, transformation, modification, or improvement of a substance to provide a beneficial result or end product. Such operation can include but is not limited to electric power plants, coking operations, iron, steel, or aluminum manufacturing facilities, cement manufacturing operations, glass manufacturing plants, ethanol production plants, drying operations for grains and other agricultural materials, food processing facilities, and heating operations for factories and buildings. Industrial plant operations encompass other manufacturing operations incorporating heat treatment of a product or system, including but not limited to green houses, district heating, and regeneration processes for amines or other extractants used in carbon dioxide or organic acid sequestration.

As used in this application, "coal" means anthracite, bituminous, subbituminous, and lignite or "brown" coals, and peat. Powder River Basin coal is specifically included.

For purposes of the present invention, "quality characteristic" means a distinguishing attribute of the particulate material that impacts its combustion, consumption, transformation, modification, or improvement within the industrial plant operation, including but not limited to moisture content, carbon content, sulfur content, mercury content, fly ash content, and production of $SO_2$ and Ash, carbon dioxide, mercury oxide when burned.

As used in this application, "heat treatment apparatus" means any apparatus that is useful for the application of heat to a product, including but not limited to furnaces, dryers, cookers, ovens, incubators, growth chambers, and heaters.

In the context of the present invention, "dryer" means any apparatus that is useful for the reduction of the moisture content of a particulate material through the application of direct or indirect heat, including but not limited to a fluidized bed dryer, vibratory fluidized bed dryer, fixed bed dryer, traveling bed dryer, cascaded whirling bed dryer, elongated slot dryer, hopper dryer, or kiln. Such dryers may also consist of single or multiple vessels, single or multiple stages, be stacked or unstacked, and contain internal or external heat exchangers.

For purposes of this application "principal heat source" means a quantity of heat produced directly for the principal purpose of performing work in a piece of equipment, such as a boiler, turbine, oven, furnace, dryer, heat exchanger, reactor, or distillation column. Examples of such a principal heat source include but are not limited to combustion heat and process steam directly exiting a boiler.

As used in this application, "waste heat source" means any residual gaseous or liquid by-product stream having an elevated heat content resulting from work already performed by a principal heat source within a piece of equipment within an industrial plant operation that is used for the secondary purpose of performing work in a piece of equipment instead of being discarded. Examples of such waste heat sources include but are not limited to cooling water streams, hot condenser cooling water, hot flue or stack gas, spent process steam from, e.g., a turbine, or discarded heat from operating equipment like a compressor, reactor, or distillation column.

Coal fired in the boiler furnace of an electric power plant shall be used as exemplary particulate material and industrial plant operation for purposes of this application, but it is important to appreciate that any other material that constitutes a useful, necessary, or beneficial input to an industrial plant operation is covered by this application, as well.

FIG. 1 shows a simplified coal-fired electric power plant 10 for the generation of electricity. Raw coal 12 is collected in a coal bunker 14 until needed. It is then fed by means of feeder 16 to coal mill 18 in which it is pulverized to an appropriate particle size as is known in the art with the assistance of primary air stream 20.

The pulverized coal particles are then fed to furnace 25 in which they are combusted in conjunction with secondary air stream 30 to produce heat. Flue gas 27 is also produced by the combustion reaction, and is vented to the atmosphere.

This heat source, in turn, converts water 31 in boiler 32 into steam 33, which is delivered to steam turbine 34. Steam turbine 34 may consist more fully of high pressure steam turbine 36, intermediate pressure steam turbine 38, and low pressure steam turbines 40 operatively connected in series. Steam 33 performs work by pushing against the fan-like blades connected to a series of wheels contained within each turbine unit which are mounted on a shaft. As the steam pushes against the blades, it causes both the wheels and turbine shaft to spin. This spinning shaft turns the rotor of electric generator 43, thereby producing electricity 45.

Steam 47 leaving the low-pressure steam turbines 40 is delivered to condenser 50 in which it is cooled by means of cooling water 52 to convert the steam into water. Most steam condensers are water-cooled, where either an open or closed-cooling circuit is used. In the closed-loop arrangement show in FIG. 1, the latent heat contained within the steam 47 will increase the temperature of cold cooling water 52, so that it is discharged from steam condenser 50 as hot cooling water 54, which is subsequently cooled in cooling tower 56 for recycle as cold cooling water 52 in a closed-loop arrangement. In an open-cooling circuit, on the other hand, the heat carried by cooling water is rejected into a cooling body of water (e.g., a river or a lake). In a closed-cooling circuit, by contrast, the heat carried by cooling water is rejected into a cooling tower.

Figure 2:
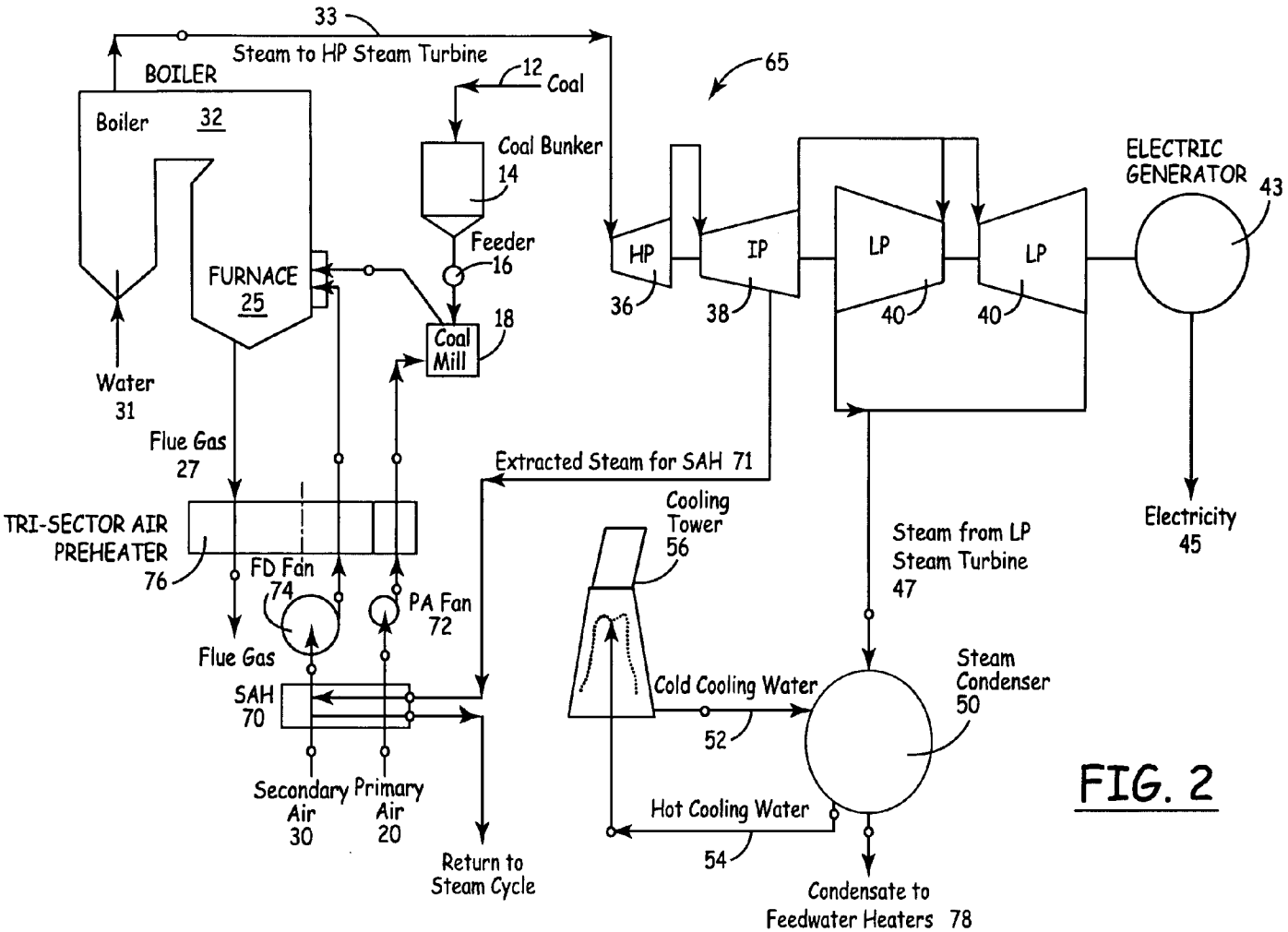
FIG. 2 is a schematic diagram showing an improved coal-fired power plant, which utilizes the flue gas and steam turbine waste heat streams to enhance the boiler efficiency.

The operational efficiency of the electric power plant 10 of FIG. 1 may be enhanced by extracting and utilizing some of the waste heat and byproduct streams of the electricity power plant, as illustrated in FIG. 2. Fossil-fired plant boilers are typically equipped with air pre-heaters ("APH") utilized to heat primary and secondary air streams used in the coal milling and burning process. Burned coal is used in a boiler system (furnace, burner and boiler arrangement) to convert water to steam, which is then used to operate steam turbines that are operatively connected to electrical generators. Heat exchangers, often termed steam-to-air pre-heaters ("SAH"), use steam extracted from the steam turbine to preheat these primary and secondary air streams upstream of the air pre-heater. Steam extraction from the turbine results in a reduced turbine (and plant) output and decreases the cycle and unit heat rate.

A typical APH could be of a regenerative (Ljungstrom or Rothemule) or a tubular design. The SAHs are used to maintain elevated temperature of air at an APH inlet and protect a cold end of the APH from corrosion caused by the deposition of sulfuric acid on APH heat transfer surfaces, and from plugging which results in an increase in flow resistance and fan power requirements. A higher APH inlet air temperature results in a higher APH gas outlet temperature and higher temperature of APH heat transfer surfaces (heat transfer passages in the regenerative APH, or tubes in a tubular APH) in the cold end of the APH. Higher temperatures reduce the acid deposition zone within the APH and also reduce the acid deposition rate.

Thus, within the modified system 65, SAH 70 uses a portion 71 of the spent process steam extracted from intermediate-pressure steam turbine 38 to preheat primary air stream 20 and secondary air stream 30 before they are delivered to coal mill 18 and furnace 25, respectively. The maximum temperature of primary air stream 20 and secondary air stream 28 which can be achieved in SAH 70 is limited by the temperature of extracted steam 71 exiting steam turbine 38 and the thermal resistance of SAH 70. Moreover, primary air stream 20 and secondary air stream 30 are fed by means of PA fan 72 and FD fan 74, respectively, to tri-sector APH 76, wherein these air streams are further heated by means of flue gas stream 27 before it is discharged to the atmosphere. In this manner, primary air stream 20 and secondary air stream 30 with their elevated temperatures enhance the efficiency of the operation of coal mill 18 and production of process heat in furnace 25. Furthermore, the water stream 78 discharged by condenser 50 may be recycled to boiler 32 to be converted into process steam once again. Flue gas 27 and process steam 71 exiting steam turbine 38 and the water 78 exiting the condenser which might otherwise go to waste have been successfully used to enhance the overall efficiency of the electric power generating plant 65.

As discussed above, it would further benefit the operational efficiency of the electric generating plant if the moisture level of coal 12 could be reduced prior to its delivery to furnace 25. Such a preliminary drying process could also enable the use of lower-rank coals like subbituminous and lignite coals on an economic basis.

Figure 3:
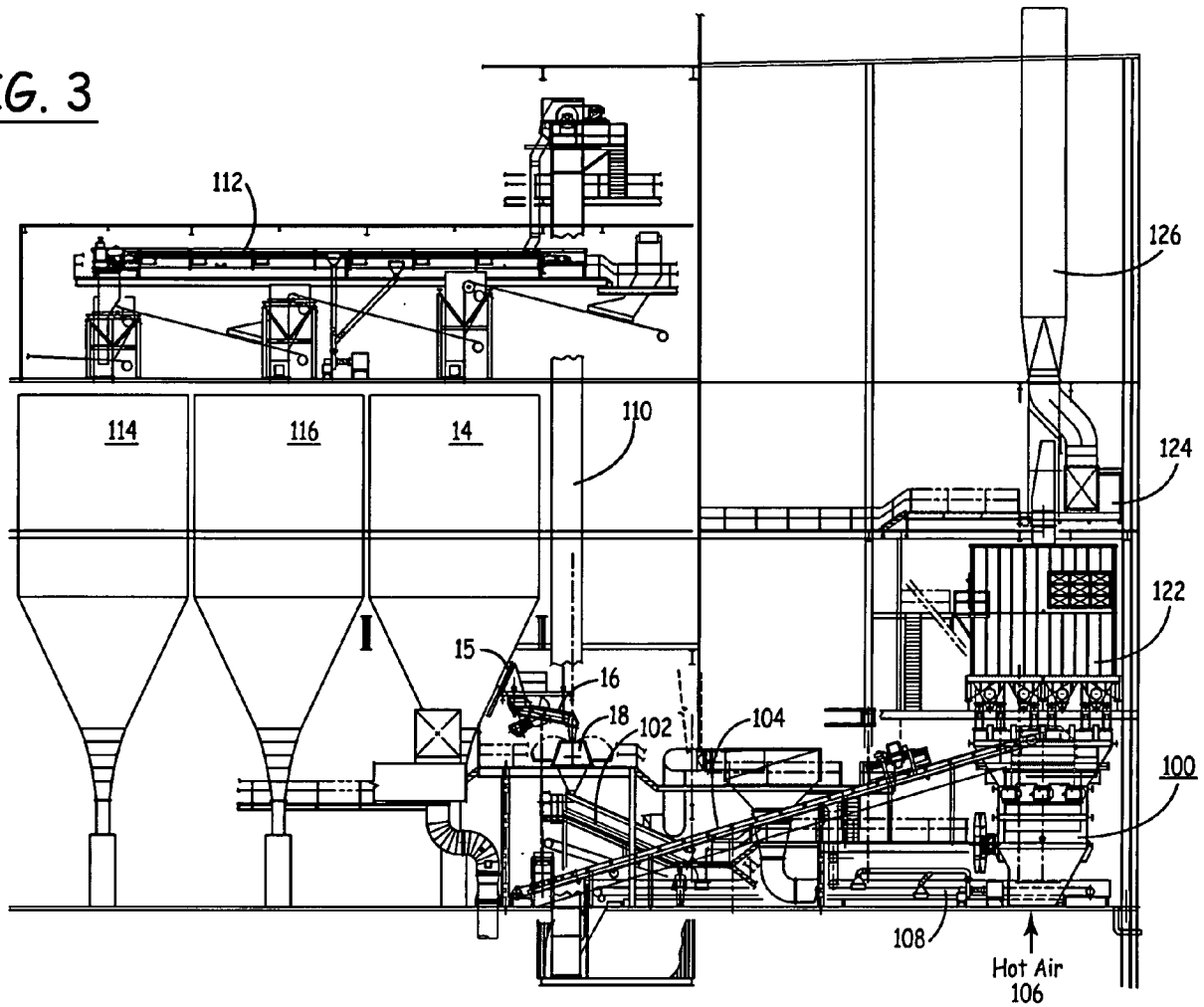
FIG. 3 is a view of a fluidized-bed dryer of the present invention and its associated equipment for conveying coal and hot fluidizing air.

FIG. 3 shows a fluidized bed dryer 100 used for purposes of reducing the moisture content of coal 12, although it should be understood that any other type of dryer may be used within the context of this invention. Moreover, the entire coal drying system may consist of multiple coal dryers connected in series or parallel to remove moisture from the coal. A multi-dryer approach, involving a number of identical coal drying units, provides operating and maintenance flexibility and, because of its generally smaller size requirements, allows coal dryers to be installed and integrated within existing power plant equipment, as well as in stages, one at a time. This will minimize interference with normal plant operations.

The fluidized bed(s) will operate in open air at relatively low-temperature ranges. An in-bed heat exchanger will be used in conjunction with a stationary fluidized-bed or fixed-bed design to provide additional heat for coal drying and, thus, reduce the necessary equipment size. With a sufficient in-bed heat transfer surface in a fluidized bed dryer, the fluidizing/drying air stream can be reduced to values corresponding to the minimum fluidization velocity. This will reduce erosion damage to and elutriation rate for the dryer.

Heat for the in-bed heat exchanger can be supplied either directly or indirectly. A direct heat supply involves diverting a portion of hot fluidizing air stream, hot condenser cooling water, process steam, hot flue gas, or other waste heat sources and passing it through the in-bed heat exchanger. An indirect heat supply involves use of water or other heat transfer liquid, which is heated by hot primary air stream, hot condenser cooling water, steam extracted from steam turbine cycle, hot flue gas, or other waste heat sources in an external heat exchanger before it is passed through the in-bed heat exchanger.

Figure 15:
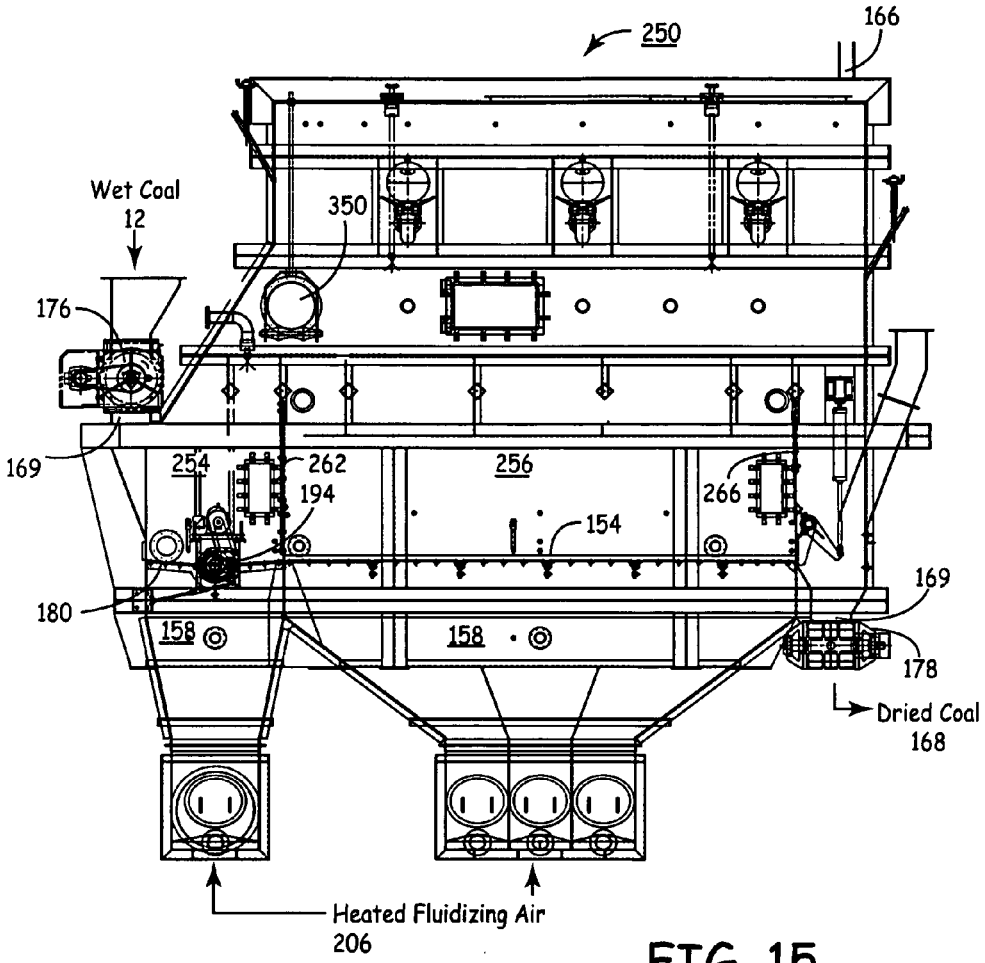
FIG. 15 is a view of a two-stage fluidized-bed dryer of the present invention.
Figure 16:
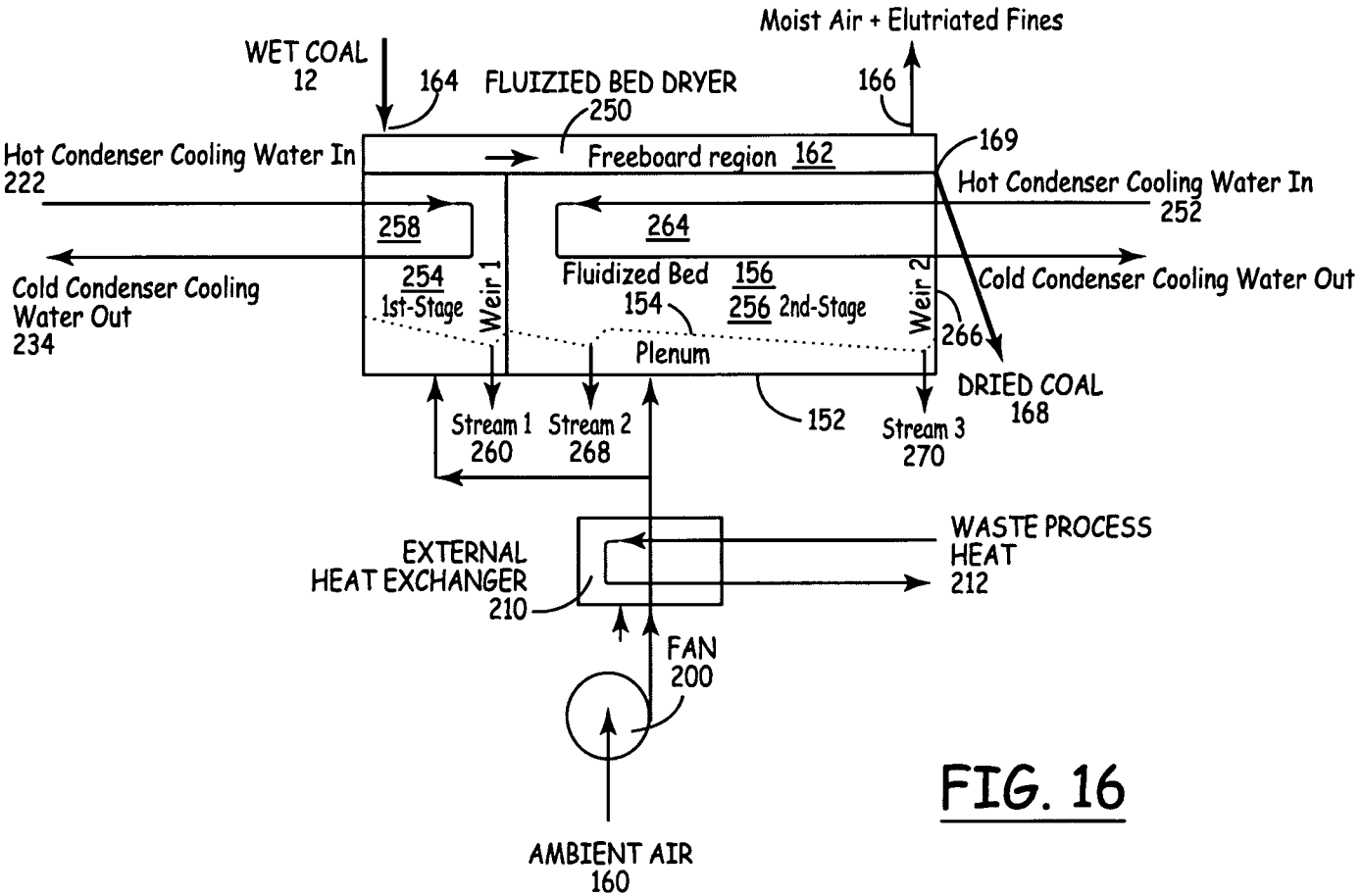
FIG. 16 is a schematic diagram of a two-stage fluidized bed dryer of the present invention that utilizes waste process heat from the plant operations to heat the fluidizing air used to fluidize the coal in both chambers of the fluidized bed dryer (indirect), and hot condenser cooling water circulated through in-bed heat exchangers contained inside both chambers of the fluidized bed dryer to dry the coal (direct heat).

The bed volume can be unitary (see FIG. 3) or divided into several sections, referred to herein as "stages" (see FIGS. 15-16). A fluidized-bed dryer is a good choice for drying wet sized coal to be burned at the same site where the coal is to be combusted. The multiple stages could be contained in a single vessel or multiple vessels. A multi-stage design allows maximum utilization of fluidized-bed mixing, segregation, and drying characteristics. The coal dryer may include a direct or indirect heat source for drying the coal.

FIG. 3 discloses a coal dryer in the form of a fluidized-bed dryer 100 and associated equipment at an industrial plant site. Wet coal 12 is stored in bunker 14 whereupon it is released by means of feed gate 15 to vibrating feeder 16 which transports it to coal mill 18 to pulverize the coal particles. The pulverized coal particles are then passed through screen 102 to properly size the particles to less than ¼ inch in diameter. The sized pulverized coal particles are then transported by means of conveyor 104 to the upper region of the fluidized-bed dryer 100 in which the coals particles are fluidized and dried by means of hot air 160. The dried coal particles are then conveyed by lower dry coal conveyor 108, bucket elevator 110, and upper dry coal conveyor 112 to the top of dried coal bunkers 114 and 116 in which the dried coal particles are stored until needed by the boiler furnace 25.

Moist air and elutriated fines 120 within the fluidized-bed dryer 100 are transported to the dust collector 122 (also known as a "baghouse") in which elutriated fires are separated from the moist air. Dust collector 122 provides the force for pulling the moist air and elutriated fires into the dust collector. Finally, the air cleaned of the elutriated fires is passed through stack 126 for subsequent treatment within a scrubber unit (not shown) of other contaminants like sulfur, Ash, and mercury contained within the air stream.

Figure 4:
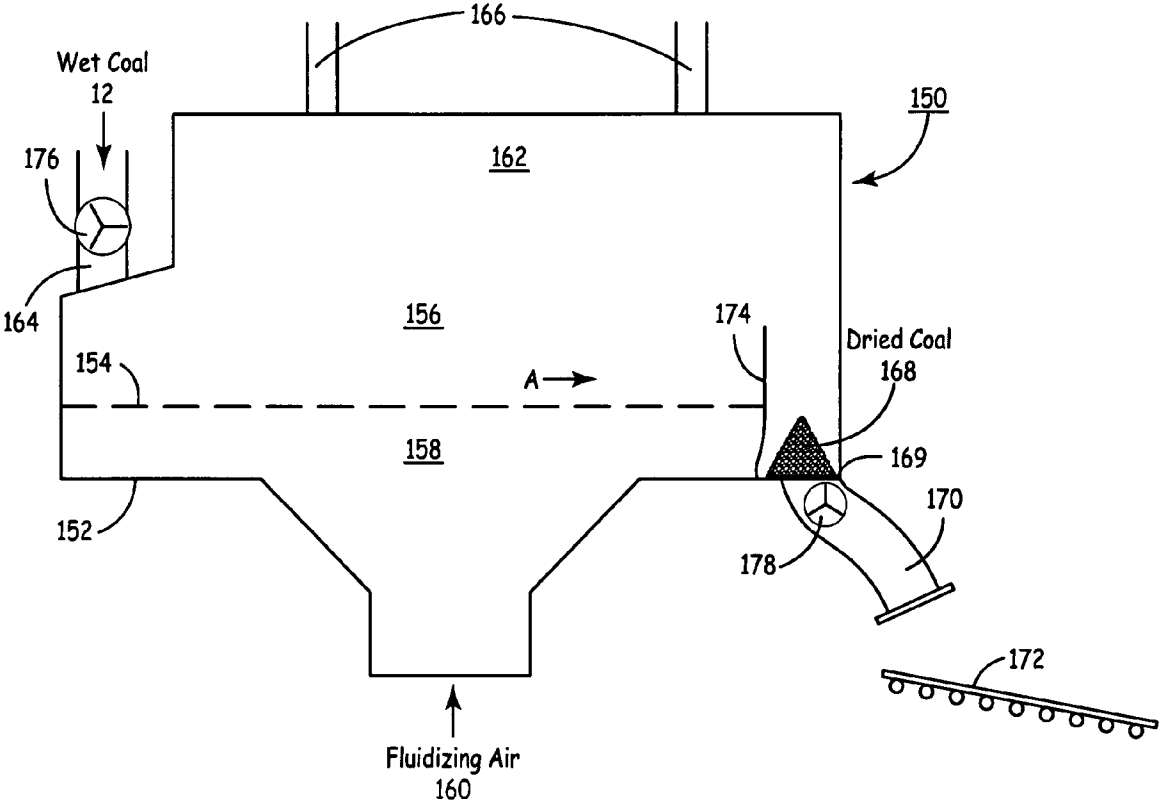
FIG. 4 is a schematic-diagram of a single-stage fluidized-bed dryer of the present invention.
Figure 5:
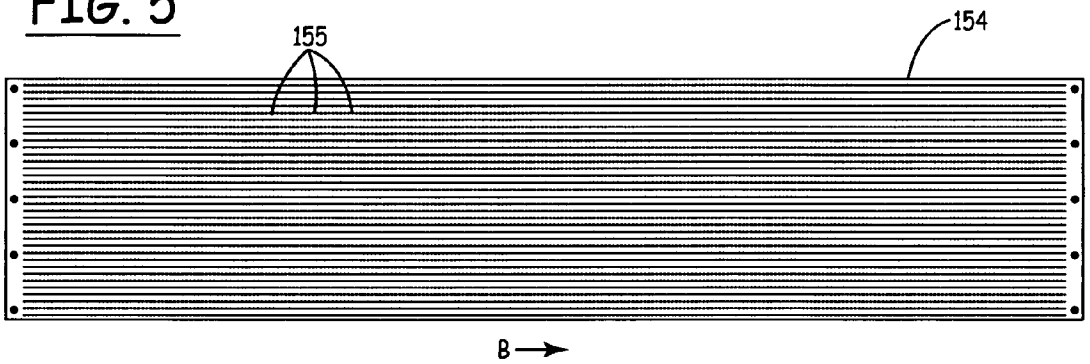
FIG. 5 is a plan view of a distributor plate for the fluidized-bed dryer of the present invention.

FIG. 4 discloses an embodiment of a coal drying bed under the present invention that is a single-stage, single-vessel, fluidized-bed dryer 150 with a direct heat supply. While there are many different possible arrangements for the fluidized-bed dryer 150, common functional elements include a vessel 152 for supporting coal for fluidization and transport. The vessel 152 may be a trough, closed container, or other suitable arrangement. The vessel 152 includes a distributor plate 154 that forms a floor towards the bottom of vessel 152, and divides the vessel 154 into a fluidized bed region 156 and a plenum region 158. As shown in FIG. 5, the distributor plate 154 may be perforated or constructed with suitable value means to permit fluidizing air 160 to enter the plenum region 158 of vessel 152. The fluidizing air 160 is distributed throughout the plenum region 158 and forced upwards through the openings 155 or valves in the distributor plate 154 at high pressure to fluidize the coal 12 lying within the fluidized bed region 156.

An upper portion of vessel 152 defines a freeboard region 162. Wet sized coal 12 enters the fluidized bed region 156 of fluidized bed dryer 150 through entry point 164 as shown in FIG. 4. When the wet sized coal 12 is fluidized by fluidizing air 160, the coal moisture and elutriated coal fines are propelled through the freeboard region 162 of vessel 152 and exit the vessel typically at the top of the fluidized-bed dryer 150 at vent outlet points 166, as shown. Meanwhile, dried coal 168 will exit the vessel 152 via discharge chute 170 to a conveyor 172 for transport to a storage bin or furnace boiler. As the fluidized coal particles move across the fluidized bed region 156 above the distributor plate 154 in the direction A shown in FIG. 4, they will build up against weir 174 which constitutes a wall traversing the width of the fluidized-bed dryer. The height of the weir 174 will define the maximum thickness of the fluidized-bed of coal particles within the dryer, for as the accumulated coal particles rise above the height of the weir, they will necessarily pass over the top of the weir and fall into a region of the fluidized-bed dryer 150 adjacent to the discharge chute 170. The structure and location of the coal inlet 164 and outlet points 169, the elutriated fines outlet 166, the distributor plate 154, and configuration of the vessel 152 may be modified as desired for best results.

Fluidized-bed dryer 150 preferably includes a wet bed rotary airlock 176 operationally connected to wet coal inlet 164 for maintaining a pressure seal between the coal feed and the dryer, while permitting introduction of the wet coal 12 to the fluidized bed 156. Rotary airlock 176 should have a housing of cast iron construction with a nickel-carbide coated bore. The end plates of the airlock should be of cast iron construction with a nickel-carbide coated face. Airlock rotors should be of cast iron construction with closed end, leveled tips, and satellite welded. In an embodiment of the invention, airlock 176 should be sized to handle approximately 115 tons/hour of wet coal feed, and should rotate at approximately 13 RPM at 60% fill to meet this sizing criterion. The airlock is supplied with a 3 hp inverter duty gear motor and an air purge kit. While airlock 176 is direct connected to the motor, any additional airlocks provided at additional wet coal inlets to the fluidized-bed dryer can be chain driven. Note that an appropriate coating material like nickel carbide is used on cast iron surfaces of the airlock that are likely to suffer over time from passage of the abrasive coal particles. This coating material also provides a "non-stick surface."

A product rotary airlock 178 is preferably supplied air in operative connection to the fluidized-bed dryer outlet point 169 to handle the dried coal 168 as it exits the dryer. In an embodiment of the invention, airlock 178 should have a housing of cast iron construction with a nickel-carbide coated bore. Airlock end plates should likewise be of cast iron construction with a nickel-carbide coated face. The airlock rotor should be of cast iron construction with a closed end, leveled tips, and satellite welded. The airlock should preferably rotate at approximately 19 RPM at 60% fill to meet the sizing criterion. The airlock should be supplied with a 2 hp inverter duty generator, chain drive, and air purge kit.

Distributor plate 154 separates the hot air inlet plenum 158 from the fluidized-bed drying chambers 156 and 162. The distributor plate should preferably be fabricated from ⅜-inch thick water jet drilled 50,000 psi-yield carbon steel as shown in FIG. 5. The distributor plate 154 may be flat and be positioned in a horizontal plane with respect to the fluidized-bed dryer 150. The openings 155 should be approximately ⅛-inch in diameter and be drilled on approximately 1-inch centers from feed end to discharge end of the distributor plate, ½-inch center across, and in a perpendicular orientation with respect to the distributor plate. More preferably, the openings 155 may be drilled in approximately a 65°-directional orientation with respect to the distributor plate so that the fluidizing air 160 forced through the opening 155 in the distributor plate blows the fluidized coal particles within the fluidized-bed region 156 towards the center of the dryer unit and away from the side walls. The fluidized the coal particles travel in direction B shown in FIG. 5.

Figure 6:
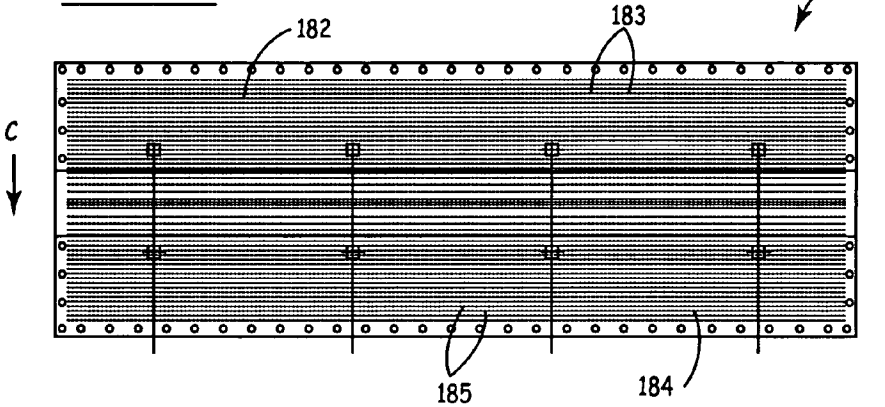
FIG. 6 is a plan view of another embodiment of the distributor plate for the fluidized-bed dryer.
Figure 7:
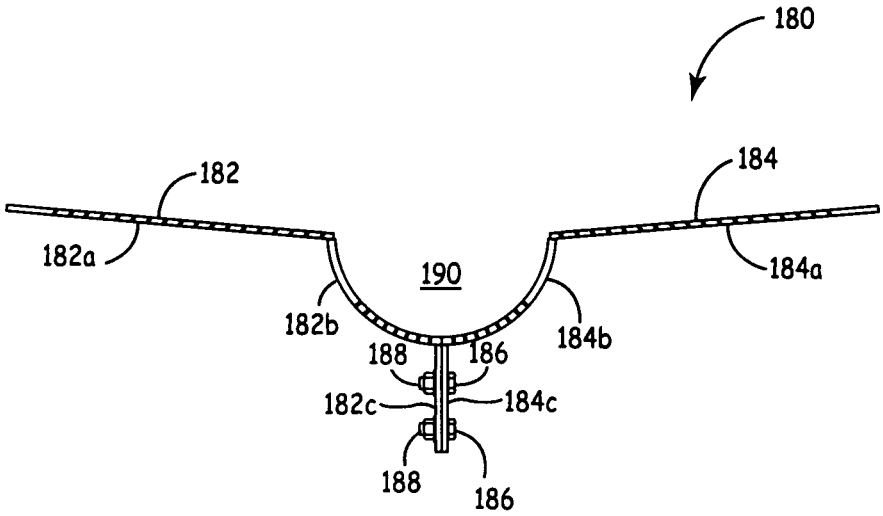
FIG. 7 is a view of the distributor plate taken along line 7-7 of FIG. 6.

Another embodiment of the distributor plate 180 is shown in FIGS. 6-7. Instead of a flat planar plate, this distributor plate 180 consists of two drilled plates 182 and 184 that have flat portions 182*a* and 184*b*, rounded portions 182*b* and 184*b*, and vertical portions 182*c* and 184*c*, respectively. The two vertical portions 182*c* and 184*c* are bolted together by means of bolts 186 and nuts 188 in order to form the distributor plate unit 180. "Flat" portions 182*a* and 184*a* of the distributor plate 180 are actually installed on a 5° slope towards the middle of the dryer unit in order to encourage the coal particles to flow towards the center of the distributor plate. Meanwhile, rounded portions 182*b* and 184*b* of the distributor plate units cooperate to define a half-circle region 190 approximately one foot in diameter for accommodating a screw auger 192, as shown more clearly in FIG. 8. The drilled openings 183 and 185 in the distributor plate units 182 and 184, respectively, will once again be on an approximately 1-inch centers from the feed end to the discharge end and ½-inch center across, having a 65°-directional slope with respect to the horizontal plane of the dryer unit. While the flat portions 182*a* and 184*a* and vertical portions 182*a* and 184*c* of the distributor plate units 182 and 184 should be made from ⅜-inch thick water jet drilled 50,000 psi-yield carbon steel, the rounded portions 182*b* and 184*b* will preferably be formed from ½-inch thick carbon steel for increased strength around the screw trough 190. Fluidized coal particles travel in direction C shown in FIG. 6.

As the coal particles are fluidized within the fluidized-bed region 156 of the dryer unit and travel in direction D along the fluidized bed, the larger and more dense particles will naturally gravitate towards the bottom of the fluidized bed, because of their increased specific gravity. At the same time, the lighter coal particles and elutriated fines will gravitate towards the top of the fluidized bed, because their specific gravity is less. Ordinarily, these denser "oversized" coal particles would cover the distributor plate 180 surface and plug the drilled openings 183 and 185 in the distributor plate, thereby impeding the inflow of pressurized hot air 160 into the dryer for fluidizing the coal particles. Moreover, fluidized coal particles could build up unevenly across the length of the dryer unit, thereby impeding the necessary flow of the fluidized particles from the feed end to the discharge end of the dryer. It would therefore become necessary to shut down the fluidized bed dryer 150 periodically to clean these oversized coal particles out of the fluidized bed region 156 in order to enable the hot air 160 once again to fluidize the coal particles and enable them to flow evenly along the length of the dryer. Such maintenance of the dryer can significantly interfere with the continuous operation of the dryer.

Figure 8:
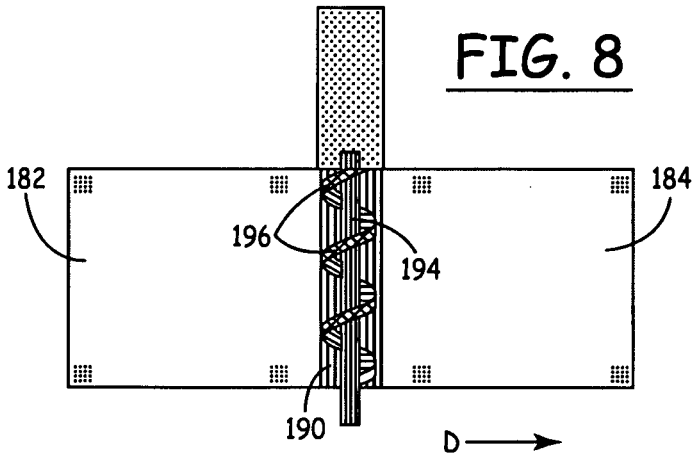
FIG. 8 is a plan view of the distributor plate of FIG. 6 containing a screw auger.

Therefore, a screw auger 194 is positioned within the trough region 190 of the distributor plate, as shown on FIG. 8. This screw auger should have a 12-inch diameter, be sized for 11.5 tons/hour removal of the oversized coal particles in the dryer bed, and have sufficient torque to start under a 4-foot thick deep bed of coal particles. The drive will be a 3-hp inverter duty motor with a 10:1 turndown. The screw auger 194 should be of carbon steel construction for durability.

The trough 190 of the distributor plate 180 and screw auger 194 should be perpendicular to the longitudinal direction of the dryer. This enables the fins 196 of the screw auger during operation to engage the oversized coal particles along the bottom of the fluidized coal bed and pull them to one side of the dryer unit, thereby preventing these oversized coal particles from plugging the distribution plate holes and impeding the flow of the fluidized coal particles along the length of the dryer bed.

Figure 9:
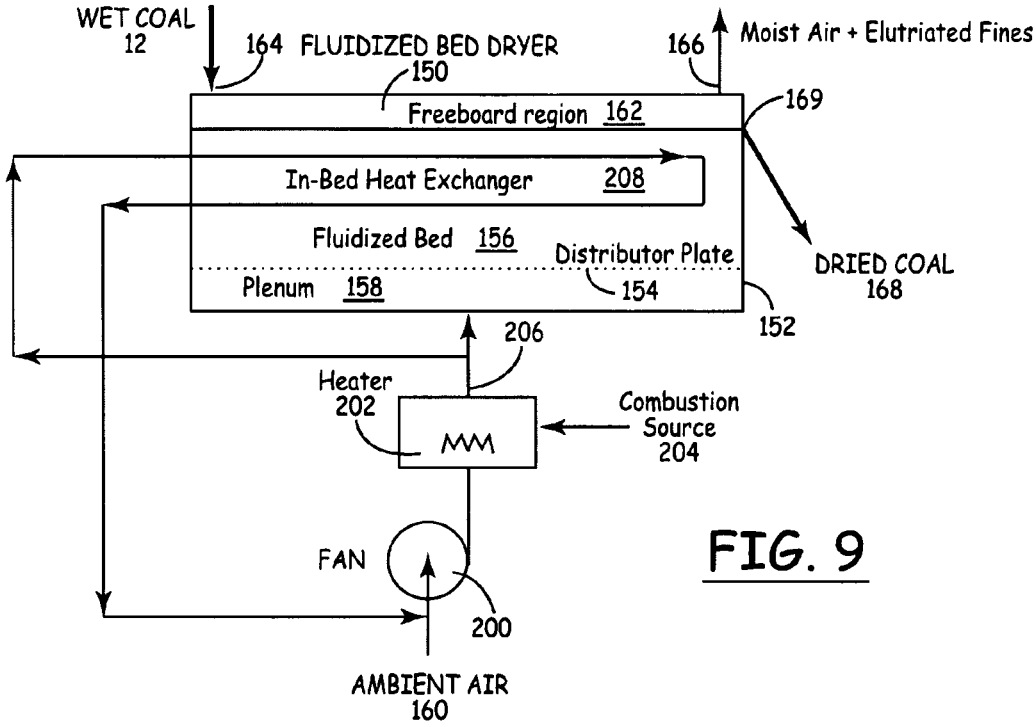
FIG. 9 is a schematic diagram of a single-stage fluidized-bed dryer of the present invention that utilizes a primary heat source to heat indirectly the fluidizing air used both the dry and fluidize the coal.

FIG. 9 discloses the fluidized bed dryer 150 of FIG. 4 in schematic form wherein the same numbers have been used for the corresponding dryer parts for ease of understanding. Ambient air 160 is drawn by means of a fan 200 through a heater 202 heated by a combustion source 204. A portion of the fluidizing air 206, heated by circulation through heater 202, is directed to the fluidized bed region 156 for fluidizing the wet sized coal 12. Any suitable combustion source like coal, oil, or natural gas may be used for heater 202.

While such heated fluidizing air 206 can be used to heat the coal particles 12 that are fluidized within the bed region 156 and evaporate water on the surface of the particles by connective heat transfer with the heated fluidizing air, an inbed heat exchanger 208 is preferably included within the dryer bed to provide heat conduction to the coal particles to further enhance this heating and drying process. A direct heat supply is created by diverting the remainder of the fluidizing hot air 206 (heated by heater 202) through in-bed heat exchanger 208, which extends throughout the fluidized bed 156, to heat the fluidized coal to drive out moisture. The fluidizing air 206 exiting the in-bed heat exchanger 208 is recycled back to fan 200 to once again be circulated through and heated by the heater 202. Some loss of fluidizing air 206 results when fluidizing air directly enters the fluidized bed region 156 through plenum 158. This lost air is replaced by drawing further ambient air 160 into the circulation cycle.

Figure 10:
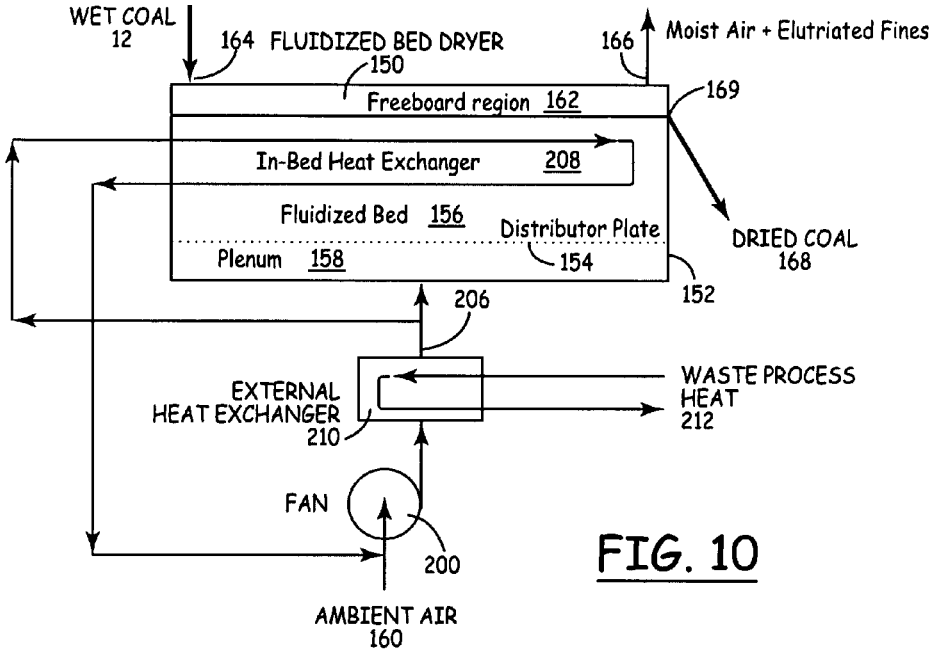
FIG. 10 is a schematic diagram of a single-stage fluidized bed dryer of the present invention that utilizes waste process heat to indirectly heat the fluidizing air used both to dry and fluidize the coal.

FIG. 10 illustrates another embodiment of the single-stage, single-vessel, fluidized bed dryer 150 of FIG. 4 except that an external heat exchanger 210 is substituted for heater 202, and waste process heat 212 from the surrounding industrial process plant is used to heat this external heat exchanger. Because industrial process plants like electricity generation plants typically have available waste process heat sources that would otherwise be discarded, this configuration of the present invention enables the productive use of this waste process heat to heat and dry the wet coal 12 in the fluidized bed dryer 150 in order to enhance the boiler efficiencies from the combustion of such dried coal on a more commercially viable basis. The use of a primary heat source like coal, oil, or natural gas, as shown in FIG. 9, is a more expensive option for drying the coal particles.

Figure 11:
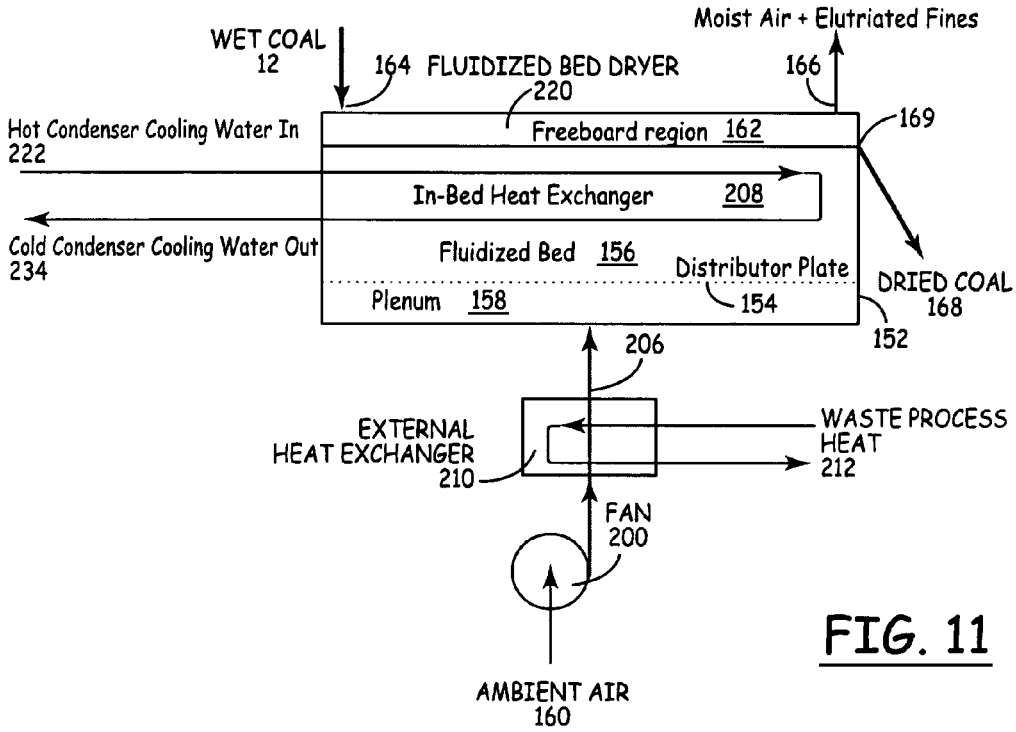
FIG. 11 is a schematic diagram of a single-stage fluidized bed dryer of the present invention that utilizes a combination of waste process heat to heat the fluidizing air used to fluidize the coal (indirect heat), and hot condenser cooling water circulated through an in-bed heat exchanger contained inside the fluidized bed dryer to dry the coal (direct heat).

FIG. 11 illustrates yet another embodiment of a single-stage, single-vessel, fluidized bed dryer 220 that is similar to the one shown in FIG. 10, except that the waste process heat 212 is not used to heat both the external heat exchanger 210 and the in-bed heat exchanger 208. Instead, a portion of the hot condenser cooling water 222 from elsewhere in the electricity generation plant operation is diverted to in-bed heat exchanger 208 to provide the necessary heat source. Thus, in the fluidized dryer embodiment 220 of FIG. 11, two separate waste heat sources (i.e., waste process heat and hot condenser cooling water) are employed to enhance the operational efficiency of the coal drying process.

Figure 12:
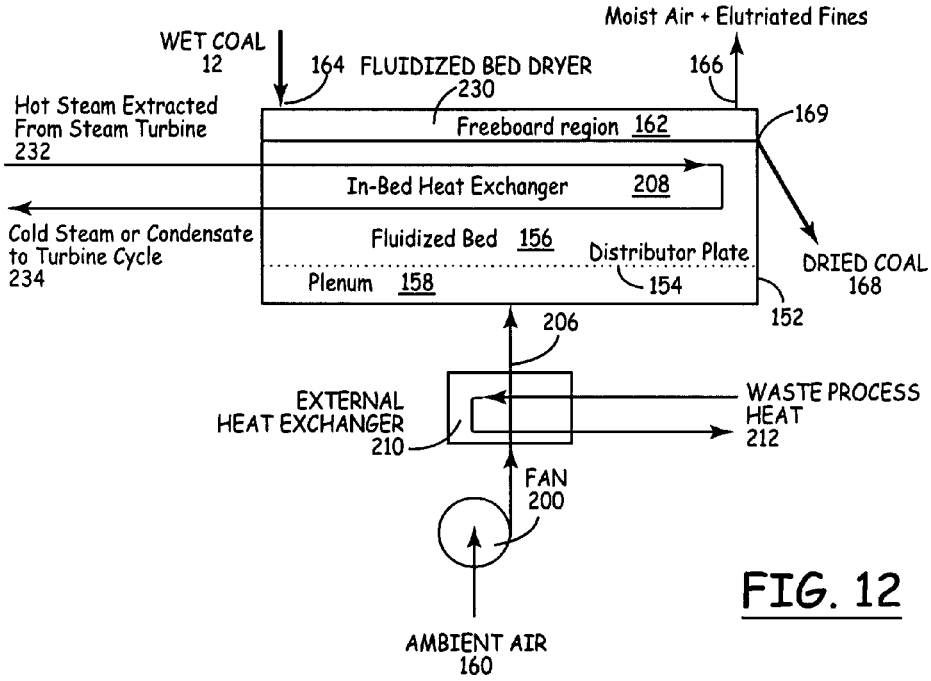
FIG. 12 is a schematic diagram of a single-stage fluidized bed dryer of the present invention that utilizes a combination of waste process heat to heat the fluidizing air used to fluidize the coal (indirect heat), and hot steam extracted from a steam turbine cycle and circulated through an in-bed heat exchanger contained inside the fluidized bed dryer to dry the coal (direct heat).

FIG. 12 shows still another embodiment of a single-stage, single-vessel, fluidized bed dryer 230 similar to the one depicted in FIG. 11, except that hot process steam 232 extracted from the steam turbines of the electricity power plant is used instead of hot condenser cooling water as a heat source for in-bed heat exchanger 208. Again, fluidized bed dryer 230 uses two different waste heat sources (i.e., waste process heat 212 and hot process steam 232) in order to enhance the operating efficiency of the coal drying process.

Figure 13:
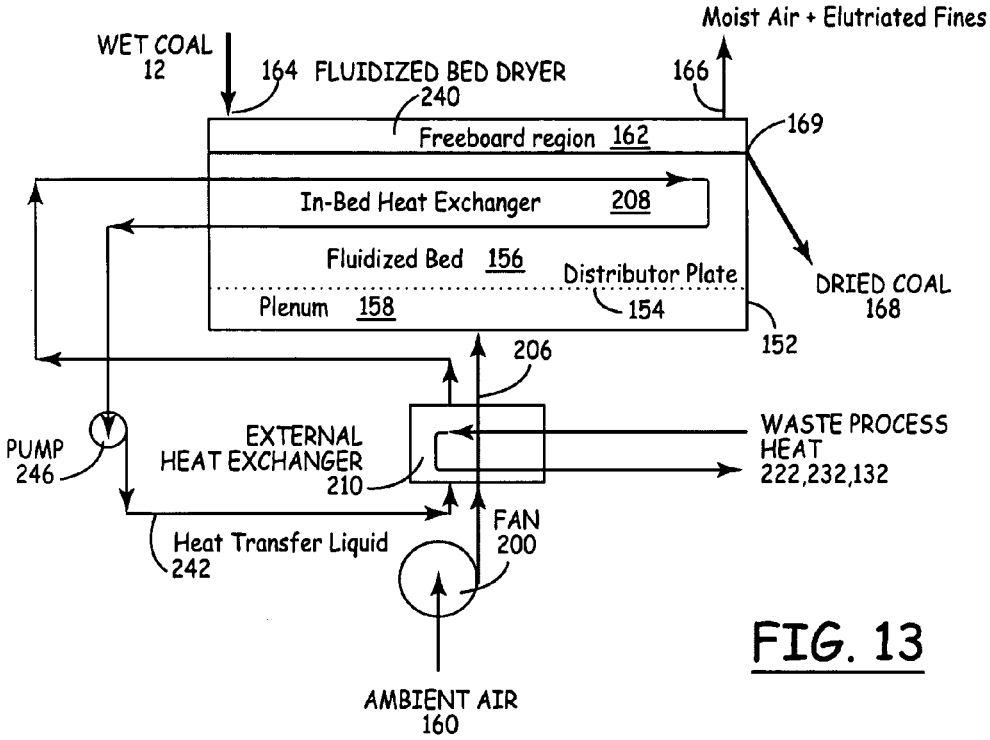
FIG. 13 is a schematic diagram of a single-stage fluidized bed dryer of the present invention that utilizes waste process heat to both heat the fluidizing air used to fluidize the coal (indirect heat), and to heat the transfer liquid circulated through an in-bed heat exchanger contained inside the fluidized bed dryer to dry the coal (indirect heat).
Figure 14:
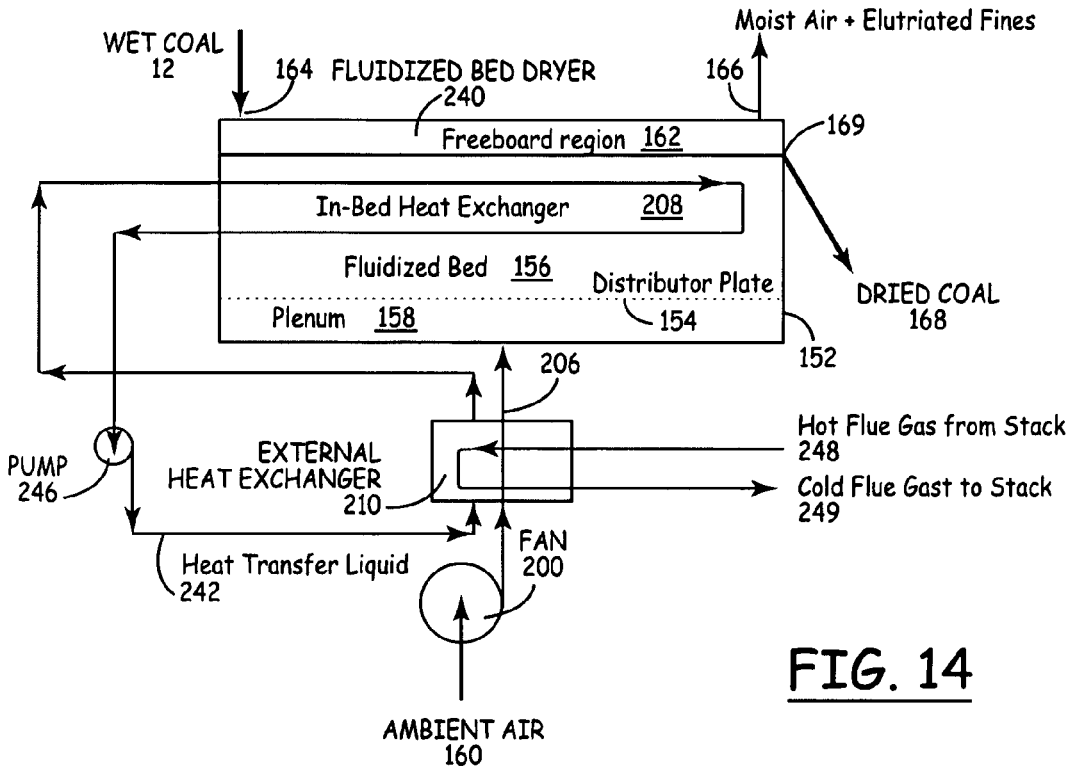
FIG. 14 is a schematic diagram of a single-stage fluidized bed dryer of the present invention that utilizes hot flue gas from a plant furnace stack to both heat the fluidizing air used to fluidize the coal (indirect heat), and to heat the transfer liquid circulated through an in-bed heat exchanger contained inside the fluidized bed dryer to dry the coal (indirect heat).

Another embodiment of a fluidized bed dryer is shown in FIGS. 13-14, entailing a single-stage, single-vessel, fluidized bed dryer 240 with an indirect heat supply. An indirect heat supply to the in-bed heat exchanger 208 is provided by the use of water or other heat transfer liquid 242, which is heated by the fluidizing air 206, hot condenser cooling water 222, process steam 232 extracted from the steam turbine cycle, or hot flue gas 248 from the furnace stack in an external heat exchanger 210, and then circulated through the in-bed heat exchanger 208 by means of pump 246, as illustrated in FIG. 13. Any combination of these sources of heat (and other sources) may also be utilized.

Still another embodiment of an open-air, low-temperature fluidized bed dryer design of the present invention is illustrated in FIGS. 15-16, which is a multiple-stage, single-vessel, fluidized bed dryer 250 with a direct heat supply (hot condenser cooling water 252 from the cooling tower of electric power plant) to an in-bed heat exchanger 208. Vessel 152 is divided in two stages: a first stage 254 and second stage 256. Although illustrated in FIGS. 15-16 as a two-stage dryer, additional stages may be added and further processing can be achieved. Typically, wet sized coal 12 enters the first stage 254 of the fluidized bed drier 250 through the freeboard region 162 at entry point 164. The wet sized coal 12 is preheated and partially dried (i.e., a portion of surface moisture is removed) by hot condenser cooling water 252 entering, circulating and exiting through the heating coils of in-bed heat exchanger 258 contained inside the first stage 254 (direct heat). The wet sized coal 12 is also heated and fluidized by hot fluidizing air 206. Fluidizing air 206 is forced by fan 200 through the distributor plate 154 of the first stage 254 of the fluidized bed dryer 250 after being heated by waste process heat 212 in external heat exchanger 210.

In the first stage 254, the hot fluidization air stream 206 is forced through the wet sized coal 12 supported by and above distributor plate 154 to dry the coal and separate the fluidizable particles and non-fluidizable particles contained within the coal. Heavier or denser, non-fluidizable particles segregate out within the bed and collect at its bottom on the distributor plate 154. These non-fluidizable particles ("undercut") are then discharged from the first stage 254 as Stream 1 (260), as explained more fully in a U.S. application filed on the same day as this application with a common co-inventor and owner to the present application, which is a continuation-in-part of U.S. Ser. No. 11/107,153 filed on Apr. 15, 2005, and which are incorporated hereby by reference. Fluidized bed dryers are generally designed to handle non-fluidized material up to four inches thick collecting at the bottom of the fluidized bed. The non-fluidized material may account for up to 25% of the coal input stream. This undercut stream 260 can be directed through another beneficiation process or simply be rejected. Movement of the segregated material along the distributor plate 154 to the discharge point for stream 260 is accomplished by an inclined horizontal-directional distributor plate 154, as shown in FIG. 16. The first stage 254 therefore separates the fluidizable and non-fluidizable material, pre-dries and preheats the wet sized coal 12, and provides uniform flow of the wet sized coal 12 to the second stage 256 contained within the fluidized bed dryer 250. From the first stage 254, the fluidized coal 12 flows airborne over a first weir 262 to the second stage 256 of the bed dryer 250. In this second stage of the bed dryer 250, the fluidized coal 12 is further heated and dried to a desired outlet moisture level by direct heat, hot condenser cooling water 252 entering, circulating, and exiting the heating coils of the in-bed heat exchanger 264 contained within the second stage 256 to radiate sensible heat therein. The coal 12 is also heated, dried, and fluidized by hot fluidizing air 206 forced by fan 200 through the distributor plate 154 into the second stage 256 of the fluidized bed dryer 250 after being heated by waste process heat 212 in external heat exchanger 210.

The dried coal stream is discharged airborne over a second weir 266 at the discharge end 169 of the fluidized bed dryer 250, and elutriated fines 166 and moist air are discharged through the top of the dryer unit. This second stage 256 can also be used to further separate fly ash and other impurities from the coal 12. Segregated material will be removed from the second stage 256 via multiple extraction points 268 and 270 located at the bottom of the bed 250 (or wherever else that is appropriate), as shown in FIG. 16 as Streams 2 (268) and 3 (270). The required number of extraction points may be modified depending upon the size and other properties of the wet sized coal 12, including without limitation, nature of the undesirable impurities, fluidization parameters, and bed design. The movement of the segregated material to the discharge point(s) 260, 268, and 270 can be accomplished by an inclined distributor plate 154 shown in FIG. 16, or by existing commercially available horizontal-directional distributor plates. Streams 1, 2 and 3 may be either removed from the process and land-filled or further processed to remove undesirable impurities.

The fluidization air stream 206 is cooled and humidified as it flows through the coal bed 250 and wet sized coal 12 contained in both the first stage 254 and second stage 256 of the fluidized bed 156. The quantity of moisture which can be removed from the coal 12 inside the dryer bed is limited by the drying capacity of the fluidization air stream 206. Therefore, the heat inputted to the fluidized bed 156 by means of the heating coils of the in-bed heat exchangers 258 and 264 increases the drying capacity of fluidizing air stream 206, and reduces the quantity of drying air required to accomplish a desired degree of coal drying. With a sufficient in-bed heat transfer surface, drying air stream 206 could be reduced to values corresponding to the minimum fluidization velocity needed to keep particulate suspended. This is typically in the 0.8 meters/second range, but the rate could be increased to run at a higher value, such as 1.4 meters/second, to assure that the process never drops below the minimum required velocity.

To achieve maximum drying efficiency, drying air stream 206 leaves fluidized bed 156 at saturation condition (i.e., with 100% relative humidity). To prevent condensation of moisture in the freeboard region 162 of the fluidized bed dryer 250 and further downstream, coal dryer 250 is designed for outlet relative humidity less than 100%. Also, a portion of the hot fluidizing air 206 may be bypassed around the fluidized bed 156, and mixed with the saturated air in the freeboard region 162 to lower its relative humidity (e.g., sparging), as explained more fully herein. Alternatively, reheat surfaces may be added inside the freeboard region 162 of the fluidized bed dryer 250 or heating of vessel skin, or other techniques may be utilized to increase the temperature and lower the relative humidity of fluidization air 206 leaving the bed dryer 250, and prevent downstream condensation. The moisture removed in the dryer is directly proportional to the heat input contained in the fluidizing air and heat radiated by the in-bed heat exchangers. Higher heat inputs result in higher bed and exit temperatures, which increase the water transport capabilities of the air, thereby lowering the required air-to-coal ratio required to achieve the desired degree of drying. The power requirements for drying are dependent upon the air flow and the fan differential pressure. The ability to add heat in the dryer bed is dependant upon the temperature differential between the bed and heating water, the heat transfer coefficient, and the surface area of the heat exchanger. In order to use lower temperature waste heat, more heat transfer area is therefore needed to introduce the heat into the process. This typically means a deeper bed to provide the necessary volume for the heat coils of the in-bed heat exchangers. Thus, intended goals may dictate the precise dimensions and design configuration of the fluidized bed dryer of the present invention.

Coal streams going into and out of the dryer include the wet sized coal 12, processed coal stream, elutriated fines stream 166, and the undercut streams 260, 268, and 270. To deal with the non-fluidizable coal, the dryer 250 is equipped with a screw auger 194 contained within the trough region 190 of first-stage distributor plate 180 in association with a collection hopper and scrubber unit for collecting the undercut coal particles, as disclosed more fully herein. This screw auger and scrubber unit are disclosed more fully in a U.S. application filed on the same day as this application with a common co-inventor and owner, which is a continuation-in-part of U.S. Ser. No. 11/107,153 filed on Apr. 15, 2005, which are incorporated hereby by reference.

Typical associated components of a dryer include, amongst others, coal delivery equipment, coal storage bunker, fluidized bed dryer, air delivery and heating system, in-bed heat exchanger(s), environmental controls (dust collector), instrumentation, and a control and data acquisition system. In one embodiment, screw augers are used for feeding moist coal into and extracting the dried coal product out of the dryer.

Vane feeders can be used to control the feed rates and provide an air lock on the coal streams into and out of the dryer. Load cells on the coal bunker provide the flow rate and total coal input into the dryer. Instrumentation could include, without limitation, thermocouples, pressure gauges, air humidity meters, flow meters and strain gauges.

With respect to fluidized-bed dryers, the first stage accomplishes pre-heating and separation of non-fluidizable material. This can be designed as a high-velocity, small chamber to separate the coal. In the second stage, coal dries by evaporation of coal moisture due to the difference in the partial pressures between the water vapor and coal. In a preferred embodiment, most of the moisture is removed in the second stage.

Figure 17:
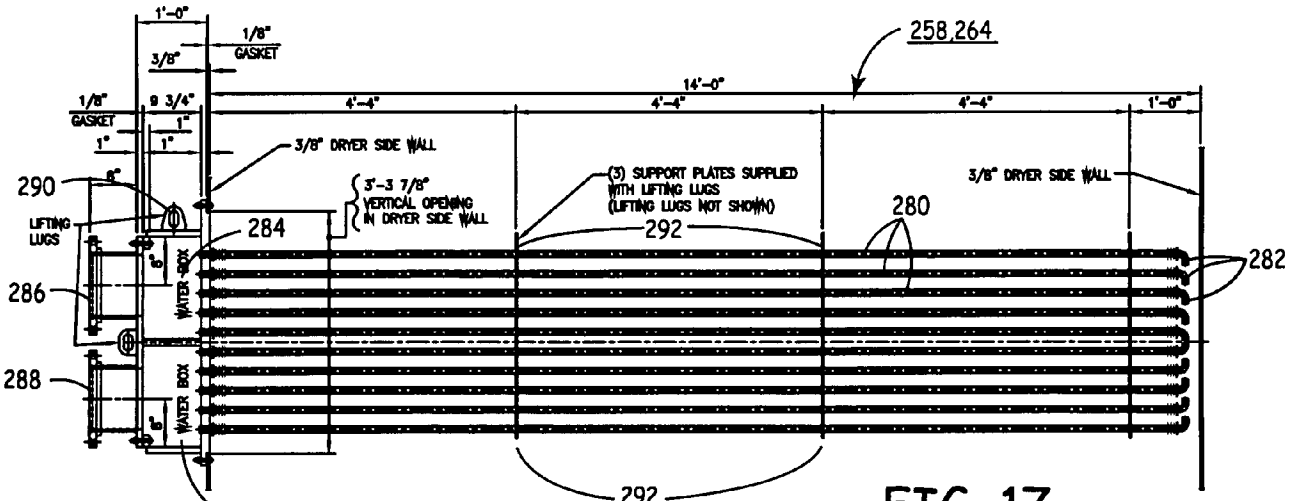
FIG. 17. is a side view of the heating coils employed within the dryer bed.
Figure 18:
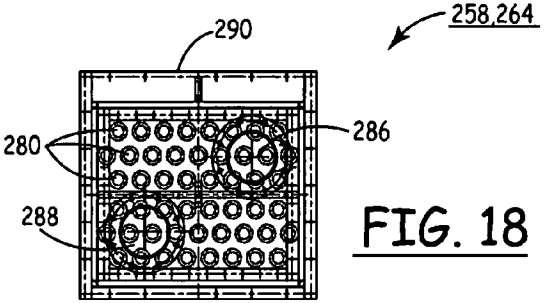
FIG. 18 is a view of the heating coils taken along line 18-18 of FIG. 17.

The heating coils 280 contained within the in-bed heat exchanges 258 and 264 of fluidized-bed dryer 250 are shown more clearly in FIGS. 17-18. Each heating coil is of carbon steel construction consisting of a two-pass, U-tube coil connection 282 with an integral water box 284 connected thereto with a cover, inlet flange 286, outlet flange 288, and lifting lugs 290. These heating coil bundles are designed for 150 psig at 300° F. with 150# ANSI flanges for the water inlet 286 and outlet 288. The heating coil tubes 280 are oriented across the width of the first-stage 254 and second-stage 256 of the dryer unit, and support plates 292 with lifting lugs are interspaced along the length of the heating coil bundles to provide lateral support.

An embodiment of the first-stage heat exchanger 258 contains 50 heating coil pipes (280) having a 1½-inch diameter with Sch 40 SA-214 carbon steel finned pipe, ½-inch-high fins, and ½-inch fin pitch×16-garage solid helical-welded carbon steel fins with a 1-inch horizontal clearances and a 1½-inch diagonal clearance. The second-stage heat exchanger 264, meanwhile, can consist of one long set of tube bundles, or multiple sets of tube bundles in series, depending upon the length of the second stage of the dryer. The tube of the second-stage heat exchanger 264 will generally consist of 1-1½-inch OD tubing×10 BWG wall SA-214 carbon steel finned pipe, ¼-½-inch-high fins, and ½-¾-inch fin pitch× 16-gauge solid helical-welded carbon steel fins with 1-inch horinzontal clearance and 1½ diagonal clearance. In an embodiment of this invention, the second-stage heating coil pipes contained 110-140 tubes. The combined surface areas of the tube bundles for both the first-state and second-stage heat exchangers 258 and 264 is approximately 8,483 $ft^2$.

Figure 19:
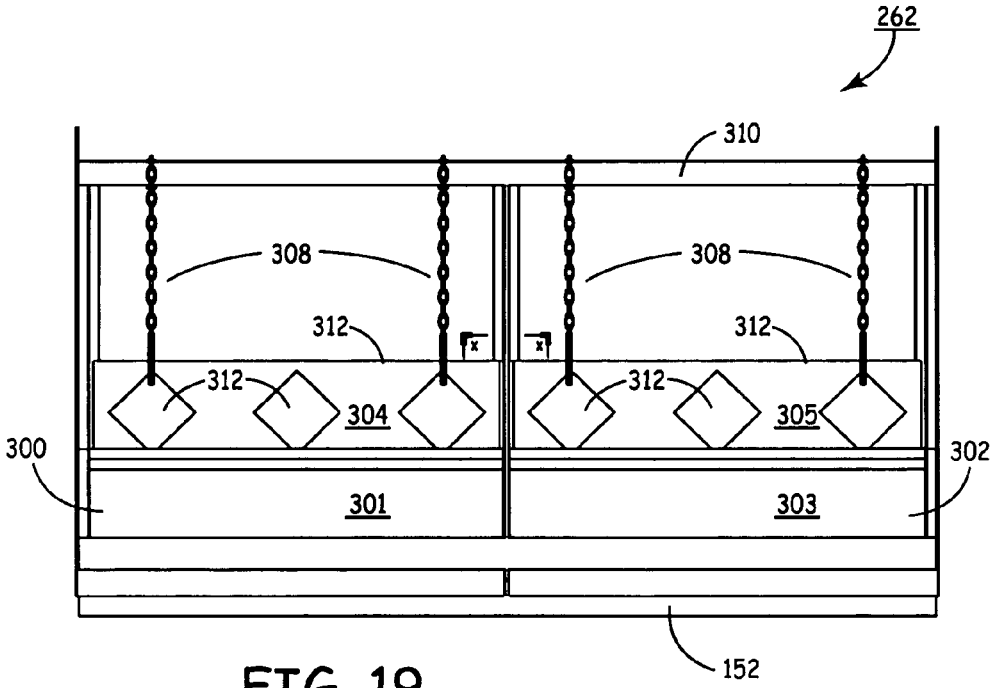
FIG. 19 is a side view of the first-stage weir gate of the fluidized-bed dryer of the present invention.

First-stage weir 262 is shown more fully in FIG. 19. It stretches across the width of the fluidized-bed dryer 250 between first stage 254 and second stage 256. Because of the 14-foot width of the dryer, it consists of two weir gate panels 300 and 302. Each weir gate panel consists of a lower section 301, 303, respectively welded in place to the dryer bottom and side walls and an adjustable upper section 304, 305 that slides vertically within tracks along the dryer side walls, and hangs by means of linked chains 308 connected to a 5"×5" square pipe support 310 which spans the width of the dryer unit. Such linked chains permit the upper sections 304, 305 of the weir gates to be moved vertically in order to adjust the height of the weir gate. Apertures 314 in the weir gates equalize the distribution of the fluidized coal particles across the weir gate to maintain an even depth of coal particles across the fluidized bed. For purposes of dryer 250, there are three apertures 315 in each weir gate, each one diamond-shaped with 12-inch sides. However, other shapes, sizes, and numbers for the apertures may be used depending upon the fluidization conditions in the dryer bed 250. As the upper portion of the gate is slid with respect to the lower portion, the size of these apertures gets larger or smaller to provide some degree of adjustment for the height of the weir gate.

Figure 20:
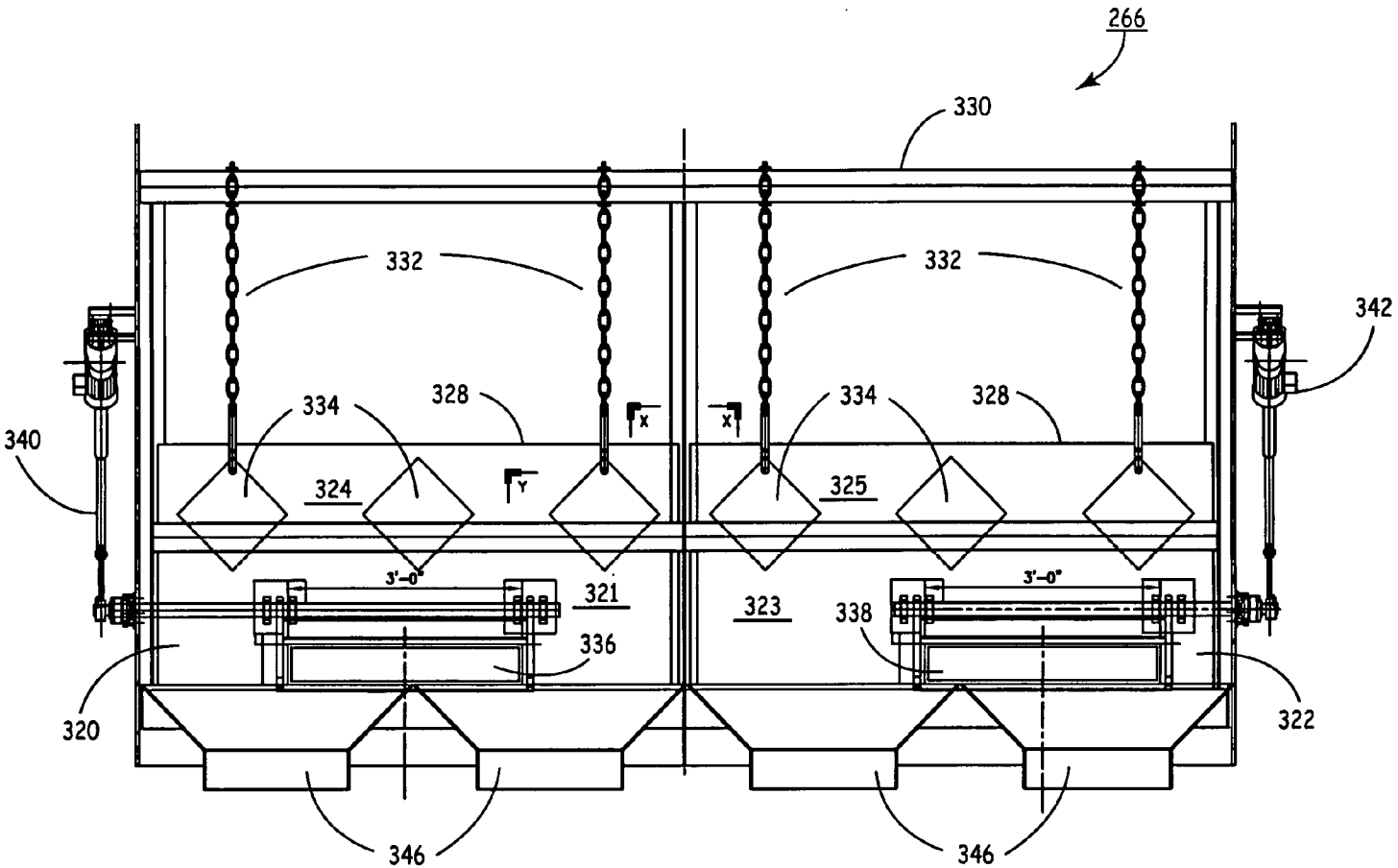
FIG. 20 is a side view of the second-stage weir gate of the fluidized-bed dryer of the present invention.

The weir gate 266 at the discharge end of the second dryer stage 256 is shown more fully in FIG. 20. Like first weir gate 262, this second weir gate 266 consists of two smaller weir gate panels 320 and 322 with lower sections 321, 323 welded to the bottom and side walls of the dryer unit. Adjustable upper sections 324, 325 slide vertically within tracks along the dryer side walls, and are secured along their top edge 328 to 5"×5" square pipe support 330 by means of linked chains 332. Again, diamond-shaped apertures 334, preferably measuring 12 inches along their sides, help to equalize the distribution of coal particles across the weir gate.

Located on the lower portion of each weir gate panel are flop gates 336 and 338. The flop gates are connected by means of hinges to the weir gates and are operated by means of pneumatic air-actuated cylinders 340 and 342 with associated linkages to open and close an 8-inch×3-foot opening 344 in each weir gate panel. When the flop gates are opened, fluidized coal particles in the second stage 256 of the fryer may fall into discharge hoppers 346 from which the dried coal product is subsequently discharged from the dryer. Weir gates 262 and 266 are made of ½-inch carbon steel.

Sparging pipe 350 located in the freeboard region 162 of the dryer 250 helps to keep the air in the dryer above the fluidized bed above the dew point. This is important because evaporated moisture from the fluidized coal particles in the dryer bed will rise to the freeboard region and humidify this area. If the temperature condition in the dryer allows this humid air to condense, water droplets may fall into the fluidized bed, and cause the coal particles to agglomerate and plug the dryer bed and distributor plate.

Figure 21:
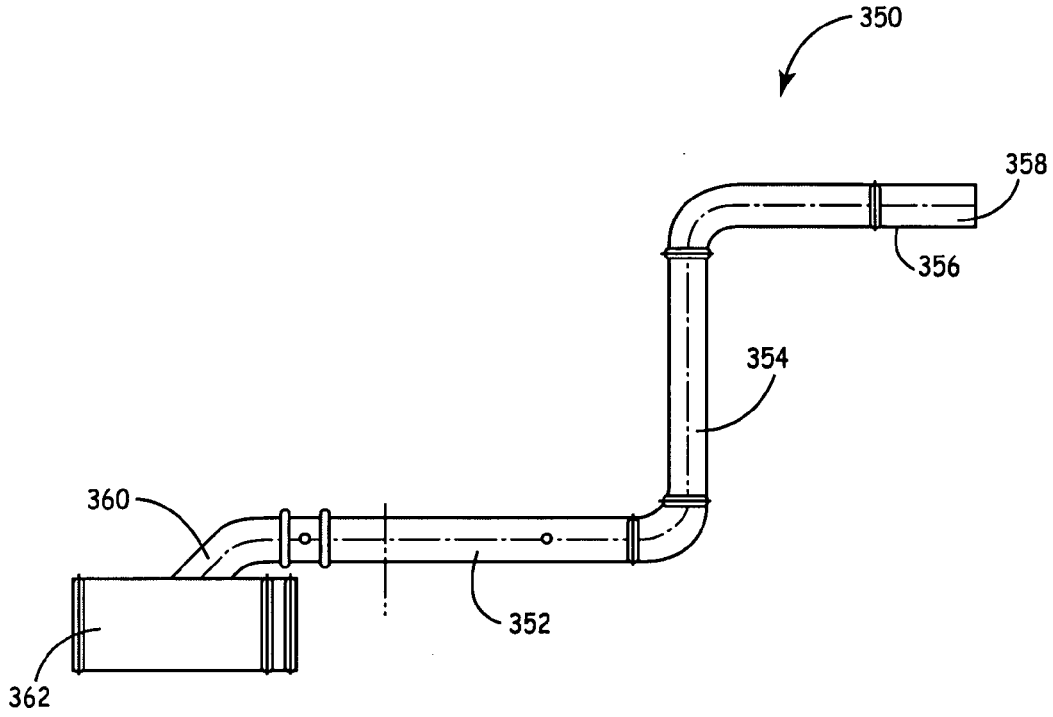
FIG. 21 is a side view of the sparging tube used within the fluidized-bed dryer of the present invention.

Sparging pipe 350 is illustrated in FIG. 21. It consists of a series of interconnected pipe portions 352, 354, 356 with ends 358 and 360. End 358 extends into the dryer as shown more clearly in FIG. 15. End 360 of sparging pipe 350 is connected to duct pipe 362 extending from the pipes that deliver hot fluidizing air to the two dryer stages. In this manner, a portion of hot fluidizing air 206 can be transported by sparger pipe 350 to the freeboard region of the dryer. The sparger pipe 350 is preferably 20-inches in diameter, and has three rows of 1-inch holes 364 drilled therein to deliver this fluidizing air along the width of the fluidized bed dryer 250. The sparging tube is preferably located in the free board region of the dryer near the end of the first stage, because the bulk of the humidity accumulating in the dryer may exist here. Moreover, some of the holes in the sparging tube may be angled to direct fluidizing air to reduce caking of coal particles on the dryer walls.

Figure 22:
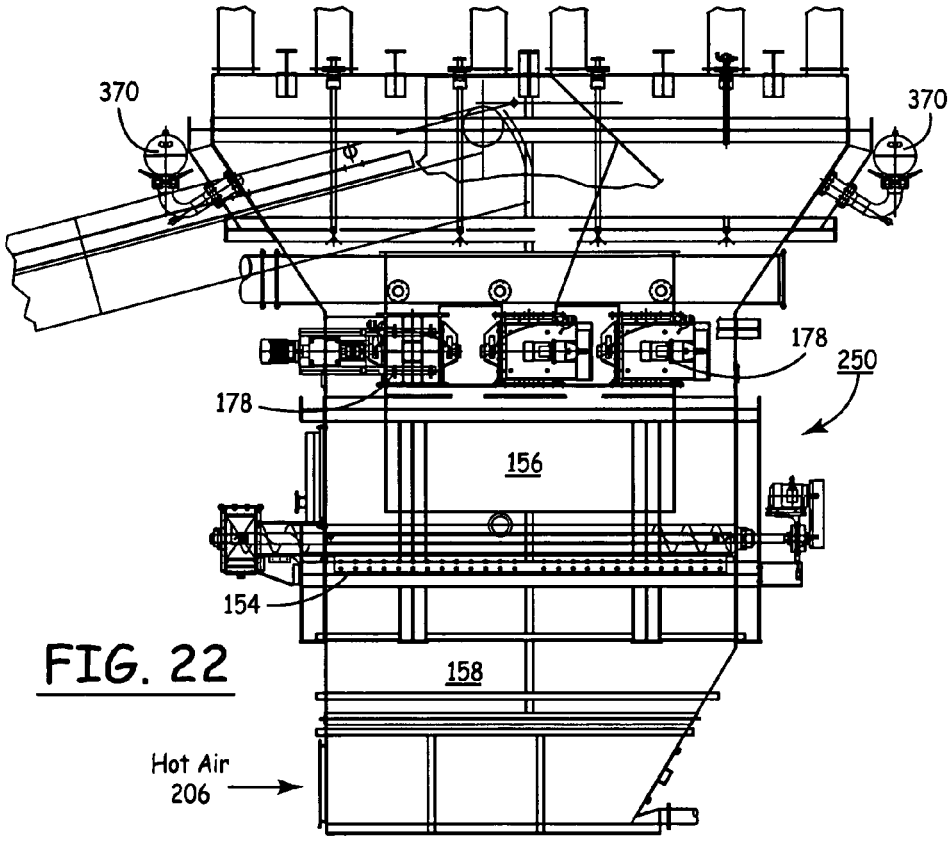
FIG. 22 is an end view of the fluidized-bed dryer of the present invention.

FIG. 22 shows fluidized bed dryer 250 from the feed end. Special attention is called to extinguisher assemblies 370. While the probability of spontaneous combustion of the dried coal particles and fines with the dryer bed are reduced by the fact that the dryer bed is heated below 300° F., preferably 200-300° F., the chance for an explosion still exists. Therefore, extinguishers assemblies 370 comprise a water deluge system that sprays water into the dryer if an emergency situation should occur during its operation. It consists of flanged pipe connections with spray nozzles. A single-zone microprocessor-based control unit with standby battery backup rated for 24 hours supervisees the system. Dry contacts provide for remote signaling of the alarm when an incipient explosion originating in the fluidized bed dryer is detected. High-rate discharge ("HRD") extinguishers are used for suppression of the explosion, and for establishing chemical isolation barriers. The HRD's are pressurized to 500 psig with dry nitrogen, and charged with suppressant consisting of processed-grade sodium bicarbonate. When an incipient explosion is sensed, the detectors send an electrical impulse through the control unit to an explosive actuator located in the neck of the HRD. The actuator rapidly opens a burst disc located on the bottom of the suppressor, thereby, allowing the suppressant to be discharged. The explosion detector used is a pair of pressure detectors which consist of a low-inertia stainless steel diaphragm. A stand-off kit is used in the mounting of the pressure detector to minimize nuisance alarms. Six 30-liter, 5-inch HRD extinguishers, three mounted on each side of the dryer, will discharge through a telescopic flush spreader nozzle.

Figure 23:
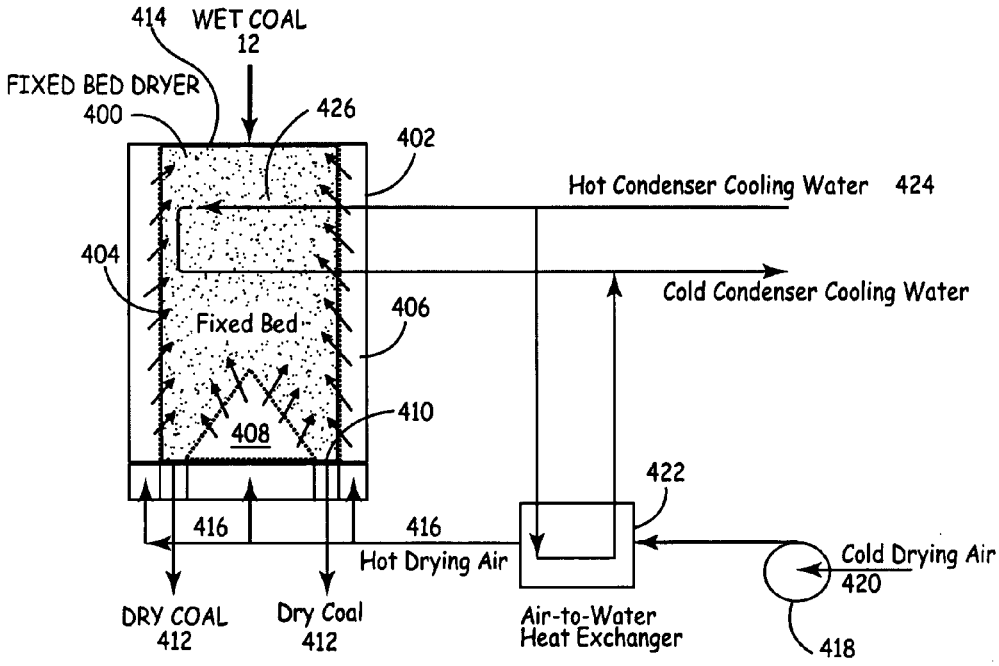
FIG. 23 is a schematic diagram of one embodiment of a fixed bed dryer.

Another type of coal bed dryer for purposes of this invention is a single-vessel, single-stage, fixed-bed dryer with a direct or indirect heat source. One embodiment of such a dryer with a direct heat source is illustrated in FIG. 23, although many other arrangements are possible. A fixed-bed dryer is a good choice for drying coal that will be sold to other power plants or other industrial plants. This is because of the low drying rates and the fact that much longer residence times are needed for fixed-bed dryers, compared with fluidized-bed dryers, to dry a required quantity of coal to a desired degree of moisture reduction. Furthermore, there usually are practical limitations on the use of a fluidized bed dryer in a non-plant situation, such as in the mining field. Under these circumstances, premium waste heat sources, such as the hot condenser cooling water or compressor heat, may not be available for the drying operation. Also, it may be more difficult to cheaply provide the necessary quantity of fluidizing air required for a fluidized bed.

With the arrangement shown in FIG. 23, the fixed-bed dryer 400 has two concentric walls, wherein, a generally cylindrical outer wall 402 and a generally cylindrical inner wall 404 that define a spatial ring 406 between the outer wall 402 and inner wall 404 for air flow. A conical structure 408 having a base diameter smaller than the diameter of the inner wall 404, is positioned at the bottom of the fixed-bed dryer 400, axially aligned with the inner wall 404, to create a ring-shaped floor discharge port 410 for discharge of the dried coal 412.

Coal (typically, but not exclusively, wet sized coal 12) enters the fixed bed 400 at the open top 414. The wet sized coal 12 is drawn by gravity to the bottom of the bed dryer 400. A fluidizing air stream 416 is generated by a fan 418 drawing cold drying air 420 through an air-to-water heat exchanger 422. The fluidizing air 420 is heated by means of waste heat, shown in FIG. 23 as hot condenser cooling water 424 drawn from a steam condenser (not shown). As with all of the embodiments described in this application, other waste heat sources are possible for practice of the invention.

The fluidizing air 420 enters the bottom of the fixed bed 400 through both the conical structure 408 and the spatial ring 406 formed between inner wall 404 and outer wall 402. Both the conical structure 408 and the inner wall 404 are perforated or otherwise suitably equipped to allow fluidizing air 416 to flow through the wet sized coal 12 contained within the inner wall 404 of the fixed bed dryer 400, as shown in FIG. 23. The fluidizing air 416 escapes into the atmosphere through the open top 414 of the fixed bed dryer 400.

The fixed bed dryer 400 includes in-bed heat coils 426. Heat for the in-bed heat transfer coils 426 is provided by waste heat, in this case, hot condenser cooling water 424. Waste heat from other sources or steam extracted from the steam turbine cycle, or any combination thereof, could also be used solely or in combination with the condenser waste heat 424. As wet sized coal 12 is heated and aerated in fixed bed dryer 400, dried coal 412 is drawn by gravity or other commercially available mechanical means to the bottom of the dryer where it is discharged through the discharge ring 410 formed at the bottom of the fixed bed dryer 400.

The dryer bed designs for this invention are intended to be custom designed to maximize use of waste heat streams available from a variety of power plant processes without exposing the coal to temperatures greater than 300° F., preferably between 200-300° F. Other feedstock or fuel temperature gradients and fluid flows will vary, depending upon the intended goal to be achieved, properties of the fuel or feedstock and other factors relevant to the desired result. Above 300° F., typically closer to 400° F., oxidation occurs and volatiles are driven out of the coal, thereby producing another stream containing undesirable constituents that need to be managed, and other potential problems for the plant operations.

The dryers are able to handle higher-temperature waste heat sources by tempering the air input to the dryer to less than 300° F. and inputting this heat into heat exchanger coils within the bed. The multi-stage design of a fluidized-bed dryer creates temperature zones which can be used to achieve more efficient heat transfer by counter flowing of the heating medium. The coal outlet temperature from a dryer bed of the present invention is relatively low (typically less than 140° F.) and produces a product which is relatively easy to store and handle. If a particular particulate material requires a lower or higher product temperature, the dryers can be designed to provide the reduced or increased temperature.

Selection of appropriate dryer design, dryer temperature, and residence time for the coal contained within the bed will produce a reduction in moisture to the desired level. For low-rank coals for power plant applications, this may entail a moisture reduction for North American lignite from approximately 35-40% wt to 10-35% wt, more preferably 27-32% wt. In other geographical markets like Australia and Russia that start out with high moisture levels for lignite as high as 50-60%, coal users may choose to reduce the moisture level through drying to below 27%. For subbituminous coals, this moisture reduction might be from approximately 25-30% wt to approximately 10-30% wt, more preferably 20-25% wt. While properly designed dryer processes under this invention can reduce the moisture level of particulate materials to 0% using low-temperature heat, in the case of coal for electric power plant operations, this may be unnecessary and increase processing costs. Custom designs permit the beds to be constructed to dry high-moisture coal to a level best suited for the particular power plant process.

Figure 24:
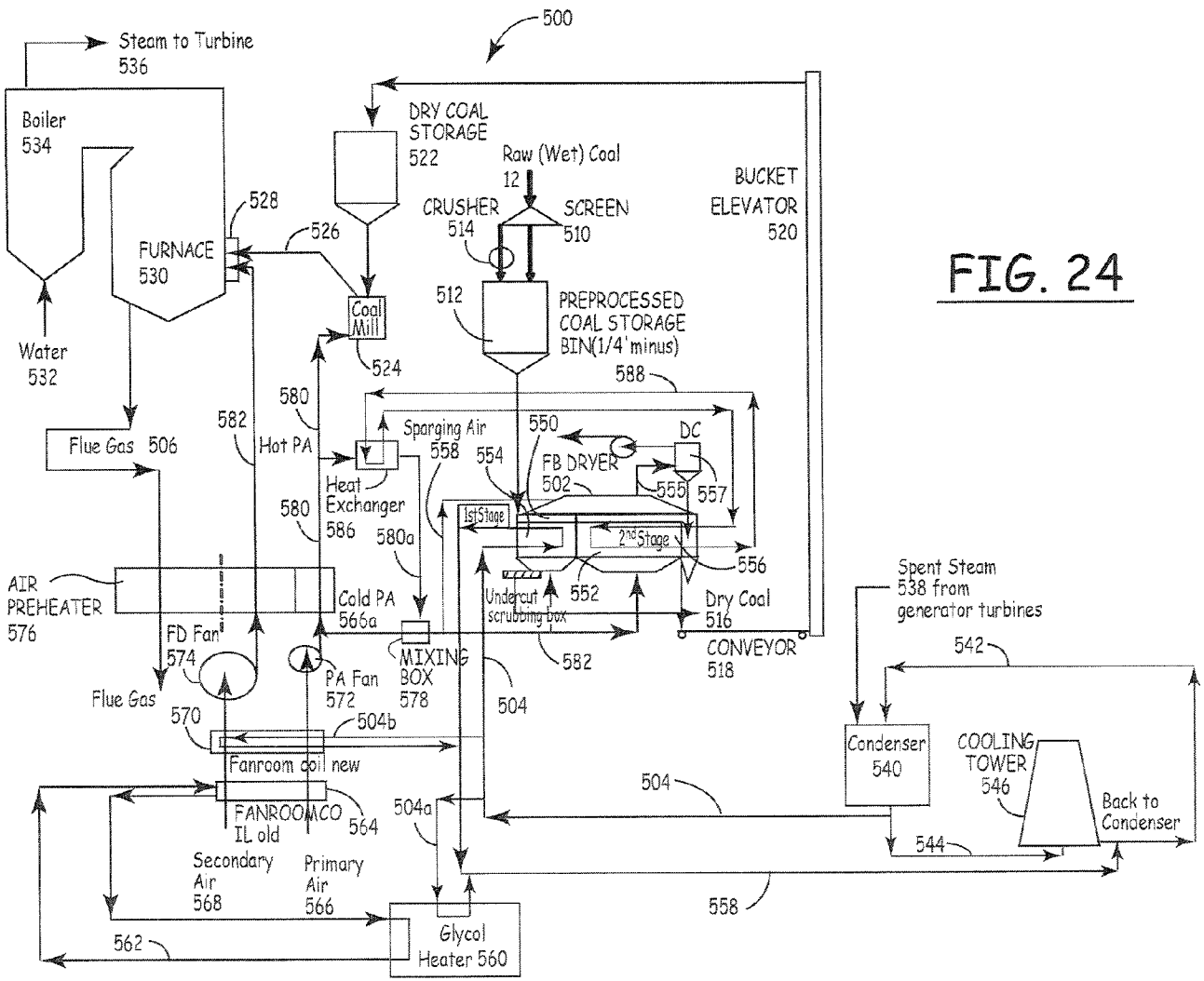
FIG. 24 is a schematic diagram of a two-stage fluidized bed dryer of the present invention integrated into an electric power plant that uses hot condenser cooling water to heat the coal contained in the first dryer stage, and to heat the fluidizing air used to fluidize the coal in both dryer stages. The hot condenser cooling water in combination with hot flue gas dries the coal in the second dryer stage.

An exemplary implementation of a two-stage, single-vessel fluidized bed dryer 502 integrated within an electrical power generation plant 500, using hot condenser cooling water 504 and hot flue gas 506 as the sole heat sources in a low-temperature, open-air drying process is shown in FIG. 24. Raw lignite coal 12 having a moisture level of 35-40% wt is fed into a screen 510 to sort the coal for suitable size for handling within the process. Appropriately sized coal 12 within the range of two inch minus, more preferably 0.25 inches or less, is conveyed by standard means directly into preprocess coal storage bin 512. Any oversized coal greater than 0.25 inches is first run through a crusher 514 before it is conveyed by standard means to coal storage bin 512.

From the storage bin, the wet, sized coal 12 is then transported by a conveyor system known within the art to the fluidized bed dry 502, wherein the total moisture on the surface of and within the pores of the coal particles is reduced to a predetermined level to yield "dried" coal 516 having an average moisture level of approximately 28-30% wt. This resulting dried coal 516 is transported by conveyor 518 to bucket elevator 520 to dry coal storage hopper 522 where it is kept until needed for the boiler furnace.

The dried coal 516 collected in storage silo 522 is conveyed by conventional means to coal mill 524 in which it is pulverized into dried, pulverized coal 526 prior to being conveyed to wind box 528 for entry into furnace 530. For purposes of this application, the process parameters typical of "winter conditions" in North Dakota for a 4 million lbs/hr boiler capacity are provided for the coal drying process shown in FIG. 24. Upon combustion of the coal 526 in furnace 530, the resulting heat within the 6 billion BTU/hr range is transferred to water 532 contained in boiler 534. Steam 536 at an average temperature of 1000° F. and pressure of 2,520 psig is then passed onto the first of a series of high-pressure, intermediate-pressure, and low-pressure steam turbines (not shown) used to drive at least one generator (not shown) for the production of electricity. The spent steam will typically leave the high-pressure turbine at 600° F. and 650 psi, and leave the downstream intermediate pressure turbine(s) at approximately 550-600° F. and 70 psi.

The spent steam 538 exiting the low-pressure turbine at approximately 125-130° F. and 1.5 psia is thereafter delivered to condenser 540 wherein it is converted to water. Cold cooling water 542 at approximately 85° F. is circulated through condenser 540 to withdraw latent heat energy from the spent steam 538. In the process, the cooling water 542 will become hotter and exits the condenser as hot cooling water 544 at approximately 120° F. This hot condenser cooling water 544 is then passed to cooling tower 546 wherein its temperature is reduced again to approximately 85° F. to produce the cold condenser cooling water for recycle to condenser 540. The condensed steam from the condenser is thereafter re-circulated through boiler 534 to be reheated into steam 536 for use again to drive the steam turbine.

Fluidized bed dryer 502 consists of first stage 550 having a distribution area of 70 $ft^2$ for receiving the coal 12 to be dried, and a larger second stage 552 having a distribution area of 245 $ft^2$. These stages of the fluidized bed dryer 502 are equipped with in-bed heat exchangers 554 and 556, respectively, which will be discussed in greater detail below.

A portion 504 of the hot condenser cooling water is diverted and circulated through heat exchanger 554 to provide the direct source of heat to the first stage 550 of the dryer. This hot condenser cooling water 504 will typically average 120° F., and causes first-stage in-bed heat exchanger to emit 2.5 million BTU/hr of heat. The spent hot condenser cooling water 558 exiting the heat exchanger at approximately 100° F. returns to the cooling tower whereupon it will assist in the cooling down of the spent turbine steam 558, and become hot condenser cooling water 504 once again.

A portion 504*a* of the hot condenser cooling water is circulated through external heat exchanger 560, which is used to heat up the glycol-base circulation fluid 562 used to heat preliminary fan room coil 564. This preliminary fan room coil 564 increases the temperature of primary air stream 566 and secondary air stream 568 from ambient temperature which will vary throughout the time of year to approximately 25-30° F. (winter conditions). Glycol will not freeze at low temperatures, so it ensures that the primary and secondary air streams likewise will not fall below a minimum temperature of 25° F.

Primary air stream 566 and secondary air stream 568 leaving preliminary fan room coil 564 are then passed onto the principal fan room coil 570, which constitutes an air-water heat exchanger unit. A portion 504*b* of hot condenser cooling water 504 is circulated through principal fan room coil 570 to provide the necessary heat source. The primary air stream 566 and secondary air stream 568 exit primary fan room coil at approximately 80-100° F., whereupon they are conveyed by means of PA fan 572 and FD fan 574, at 140° F. and 112° F., respectively, to external air heater 576, which constitute a tri-sector, rotating regenerative air pre-heater.

The use of the fanroom coils 564 and 570 to preheat inlet air to the air preheater 576 and the hot and cold primary air streams 580 and 566*a*, respectively, increases the temperature of the heat available to the outer heat exchanger 586 and heat transfer fluid stream 588 from the 120° F. range to the 200° F. plus range. This has a positive effect on the flow rate of fluidizing/drying air 552 and on the required surface area of the in-bed heat exchanger 556. Both are reduced as the temperature of drying and heating streams is increased.

A portion 566*a* of the primary air 566 is diverted prior to external air pre-heater 576 to mixing box 578 at approximately 145° F. After mixing with a hotter stream 380*a* (at approximately 583° F., of the primary air it forms fluidizing air 582 at approximately 187° F., which is used as the fluidizing medium for both first stage 550 and second stage 552 of fluidized bed dryer 502. In order to achieve this 187° F. fluidizing air temperature, approximately 54% of the air entering mixing box 578 will be provided by hot PA air 580*a*, and 46% will be provided by cold PA air 566*a*. The fluidizing air 582 will enter first stage 550 at velocity of approximately 3.5 ft/sec to fluidize the approximately 40 inch-thick bed of coal particles. The coal particles 12 travel across the first stage 550 at approximately 132,000 lbs/hr wherein they are heated by in-bed heat exchanger 554 and the fluidizing air to approximately 92° F. and undergo a small moisture reduction. Upon reaching the end of the first stage 550, they will spill over the top of a weir into second stage 552.

Flue gas 506 exits the boiler furnace 530 at approximately 825° F. This waste heat source is passed through external air heater 576 to provide the heating medium. The flue gas exits the external heater at approximately 343° F. and is vented to the stack via a precipitator and scrubber. But, in the process, the flue gas heats primary air stream 566 and secondary air stream 568 to approximately 757° F. and 740° F., respectively, to form hot primary air 580 and heated secondary air 582. The heated secondary air stream 582 is delivered to furnace 530 at approximately 117% of what is needed to aid the combustion process and enhance the boiler efficiency.

Hot primary air 580 at approximately 757° F. is delivered to coal mill 524, whereupon it forms a source of positive pressure to push the pulverized coal particles to wind box 528 and furnace 530. Again, preheating the pulverized coal particles 526 in this manner enhances the boiler efficiency and enables the use of a smaller boiler and associated equipment.

With drier coal, the flame temperature is higher due to lower moisture evaporation loss, and the heat transfer processes in the furnace 530 are modified. The higher flame temperature results in larger radiation heat flux to the walls of furnace 530. Since the moisture content of the exiting flue gas 506 is reduced, radiation properties of the flame are changed, which also affects radiation flux to the walls of furnace 530. With higher flame temperature, the temperature of coal ash particles exiting the furnace 530 is higher, which could increase furnace fouling and slagging. Deposition of slag on furnace walls reduces heat transfer and results in a higher flue gas temperature (FEGT) at the furnace exit. Due to reduction in coal flow rate as fuel moisture is reduced, the amount of ash entering the boiler will also be reduced. This reduces solid particle erosion in the boiler 534 and maintenance of the boiler 534 (e.g., the required removal of the soot that collects on the interior surface of the boiler).

A portion of the hot primary air stream 580 is diverted to heat exchanger 586, which heats a liquid medium 588 to approximately 201° F., which is used as the heat source for in-bed heat exchanger 556 contained in second stage 552 of the fluidized bed dryer 502. This liquid medium will leave the heat exchanger at approximately 160° F. whereupon it is routed back to heat exchanger 586 to be reheated. As already mentioned above, primary air stream 580*a* leaving heat exchanger 586 at approximately 283° F. combines with cold primary air 566*a* in mixing box 578 to form the fluidizing air stream 582 directed to the fluidized bed dryer 502. This mixing box allows the temperature of the fluidizing air to be adjusted to a desired level.

The fluidized coal particles that were delivered from first stage 550 at approximately 92° F. and slightly reduced moisture to second stage 552 of the fluidized bed dryer will form a bed of approximately 38-42 inches in depth that will be fluidized by air stream 582 and further heated by in-bed heat exchanger 556. These coal particles will take approximately 12 minutes to travel the length of the second stage 552 of the fluidized bed, whereupon they will be discharged as dried coal 516 at approximately 118° F. and 29.5% wt moisture. More importantly, the heat value of the coal 12 that entered the first stage of dryer 502 at approximately 6200 BTU/lb has been increased to approximately 7045 BTU/lb.

Within the industry, an "X ratio" is calculated to represent the relative efficiency of the transfer of heat across air heater 576 from flue gas 506 to primary air 566 and secondary air 568. Represented by the equation:

$$m_{PA+FD} \cdot cp_{PA+FD} \cdot (T_{out} - T_{in})_{PA+FD} = m_{flue} \cdot cp_{flue} \cdot (T_{in} - T_{out})_{flue}$$

where m is the mass flow, cp is the specific heat, $T_{in}$ is the inlet temperature, and $T_{out}$ is the outlet temperature for the respective combustion air (i.e., primary air and secondary air) and flue gas streams, respectively. Because the product of (m·cp) for the combustion air stream (stated in BTU/hr) is typically only 80% of the corresponding value for the flue gas stream, this means that under ordinary circumstances for a power plant the temperature drop in the flue gas across the air heat exchanger can only equal 80% of the temperature gain in the combustion air stream. By reducing the moisture content of the coal and consequently the flue gas produced via combustion of that coal product in the furnace in accordance with this invention, however, the mass flow rate and specific heat values for the flue gas stream 506 will be reduced, while preheating of primary air stream 566 and secondary air stream 568 via fan room coils 564 and 570 will increase the mass flow rate for the combustion air stream. This will cause the X ratio to increase towards 100%, thereby greatly enhancing the boiler efficiency of the power plant operation. Moreover, careful design of the dryer system in accordance with the principles of this invention can further enhance the X ratio value to approximately 112%, thereby rendering the boiler operation even more efficient for producing electricity. Furthermore, this greatly enhanced X ratio for the air heat exchanger and boiler efficiency has been achieved through the use of available waste heat sources within the power plant operation, which enables improvement of the economics for the power plant operation on a synergistic basis. Other low-temperature, open-air drying process implementations using the dryer apparatus of the present inventions are disclosed in U.S. Ser. No. 11/107,152 filed on Apr. 15, 2005, which shares a common inventor and owner with this application, and are incorporated herein by reference.

Many advantages are obtained using the present system. The process allows waste heat to be derived from many sources including hot condenser circulating water, hot flue gas, process extraction steam, and any other heat source that may be available in the wide range of acceptable temperatures for use in the drying process. The process is able to make better use of the hot condenser circulating water waste heat by heating the fan room (APH) by 50 to 100° F. at little cost, thereby reducing sensible heat loss and extracting the heat from the outlet primary and secondary air streams 580, 582 exiting the air pre-heater. This heat could also be extracted directly from the flue gas by use of the air preheat exchanger. This results in a significant reduction in the dryer air flow to coal flow ratio and size of the dryer required.

The dryer can be designed to make use of existing fans to supply the air required for the fluidized bed by adjusting bed differentials and dust collector fan capabilities. The beds may utilize dust collectors of various arrangements, some as described herein. The disclosed embodiments obtain primary air savings because one effect of drier coal is that less coal is required to heat the boiler, and thus fewer mills are required to grind coal and less air flow is required to the mills to supply air to the dryer.

By integrating the dryer into the coal handling system just up stream of the bunkers, the boiler system will benefit from the increase in coal feed temperature into the mills, since the coal exits the dryer at an elevated temperature. Reduction in the volume of flue gas, residence time in the bed dryer, flue gas water content, and higher scrubbing rates are expected to significantly affect mercury emissions from the plant.

An advantage of pre-heating the inlet air to the APH is to increase the temperature of the heat transfer surfaces in the cold end of the APH. Higher surface temperatures will result in lower acid deposition rates and, consequently, lower plugging and corrosion rates. This will have a positive effect on fan power, unit capacity, and unit performance. Using waste heat from the condenser to preheat inlet air to the APH instead of the steam extracted from the steam turbine will result in an increase in the turbine and unit power output and improvement in cycle and unit performance. Increasing the temperature of air at the APH inlet will result in a reduction in APH air leakage rate. This is because of the decrease in air density. A decrease in APH air leakage rate will have a positive effect on the forced draft and induced draft fan power, which will result in a reduction in station service usage, increase in net unit power output, and an improvement in unit performance. For power plants with cooling towers, the use of waste heat to preheat inlet air to the APH will reduce cooling tower thermal duty and result in a decrease in cooling tower water usage.

Coal drying using the disclosed process will lower water losses in the boiler system, resulting in higher boiler efficiency. Lower sensible gas losses in the boiler system results in higher boiler efficiency. Moreover, reduced flue gas volumes will enable lower emissions of carbon dioxide, oxides of sulfur, mercury, particulate, and oxides of nitrogen on a per megawatt (MW) basis. There is also lower coal conduit erosion (e.g., erosion in conduit pipe caused by coal, particulates, and air), lower pulverization maintenance, lower auxiliary power required to operate equipment resulting in higher unit capacity, lower ash and scrubber sludge volumes, lower water usage by the plant (water previously tapped from the steam turbine cycle is unaffected), lower air pre-heater cold end fouling and corrosion, lower flue gas duct erosion, and an increase in the percentage of flue gas scrubbed. The bed dryers can also be equipped with scrubbers—devices that separate higher density particles, thereby removing contaminants, and providing pre-burning treatment of the coal. There is an infinite array of temperature levels and design configurations that may be utilized with the present invention to treat other feedstock and fuel as well.

The combination of the APH—hot condenser cooling water arrangement permits a smaller, more efficient bed for drying coal. Present systems that utilize process heat from the steam turbine cycle require a much larger bed. There is material separation in the current invention. This allows for greater drying efficiencies. The present arrangement can be used with either a static (fluidized) bed drier or a fixed bed drier. In a two-stage dryer, the relative velocity differential between the first and second stages can be adjusted. There can be various temperature gradients, and flexibility in heat ranges in the various stages to maximize desired results. In a multiple-stage fluidized bed arrangement, there is separation of non-fluidized material, re-burn, and oxygen control. In the first stage, which in one embodiment represents 20% of the dryer distribution surface area more of the air flow, mercury, and sulfur concentrations are pulled out. Because the two-stage bed dryer can be a smaller system, there is less fan power required, which saves tremendously on electricity expenses. A significant economic factor in drying coal is required fan horsepower. The present invention can be combined with a scrubbing box. The system also provides elutriation for $NO_x$ control or carbon injection for mercury control.

From a system standpoint, there is less wear and tear and maintenance of coal handling conveyors and crushers, a decrease in the amount of ash, and reduced erosion. It is easier to pulverize coal, so there is more complete drying in the mill, less line clogging, less primary air required, and lower primary air velocities. Station service power (i.e., auxiliary power) needs will decrease, plant capacity can be increased, and scrubbers and emissions will improve.

The flow rate of flue gas 506 leaving the furnace 530 firing dried, pulverized coal 526 is lower compared to wet pulverized coal. Also, the specific heat of the flue gas 506 is lower due to the lower moisture content in the dried, pulverized coal 526. The result is reduced thermal energy of the flue gas 506 and the need for smaller environmental treatment equipment. Lower flow rates of the flue gas 506 also result in lower rates of convective heat transfer. Therefore, despite the increase in FEGT with drier fuel, less heat will be transferred to the working fluid (water or steam, not shown) in the boiler 534. For boilers with fixed heat transfer geometry, the temperature of the hot reheat steam (recycled circulating process steam) may be lower compared to operation with a wetter fuel. Some decrease in the hot reheat steam temperature could be corrected by increasing the surface area of a re-heater (not shown) or changing boiler operating conditions, such as raising burner tilts (the angle at which heat is applied to the boiler) or operating with a higher level of excess air. A new boiler could be designed for reduced flow rate of flue gas 306 through the convection pass (the exit path of the flue gas through the furnace) to achieve desired steam temperature with normal operating conditions. This will further reduce size and construction costs.

By burning drier coal, station service power will decrease due to a decrease in forced draft (FD), induced draft (ID) and primary air (PA) fan powers and a decrease in mill power. The combination of lower coal flow rate, lower air flow requirements and lower flue gas flow rate caused by firing drier coal will result in an improvement in boiler system efficiency and unit heat rate, primarily due to the lower stack loss and lower mill and fan power. This performance improvement will allow plant capacity to be increased with existing equipment. Performance of the back-end environmental control systems typically used in coal burning energy plants (scrubbers, electrostatic precipitators, and mercury capture devices) will improve with drier coal due to the lower flue gas flow rate and increased residence time.

Burning drier coal also has a positive effect on reducing undesirable emissions. The reduction in required coal flow rate will directly translate into reductions in mass emissions of ash, $CO_2$, $SO_2$, and particulates. Primary air also affects $NO_x$. With drier coal, the flow rate of primary air will be lower compared to the wet coal. This will result in a reduced $NO_x$ emission rate because, it creates more flexibility at the front of the dryer for staging of combustion air.

For power units equipped with wet scrubbers, mercury emissions resulting from firing drier coal may be reduced due to reduced air pre-heater gas outlet temperature, which favors the formation of HgO and $HgCl_2$ at the expense of elemental mercury. These oxidized forms of mercury are water-soluble and can, therefore, be removed by a scrubber. In addition, flue gas moisture inhibits mercury oxidation to water-soluble forms. Reducing fuel moisture would result in lower flue gas moisture content, which will promote mercury oxidation to water-soluble forms. Therefore, with drier coal, mercury emissions are lower compared to usage of wetter coals. A U.S. application filed on the same day as this application with a common co-inventor and owner, and which is a continuation-in-part of U.S. Ser. No. 11/107,153 filed on Apr. 15, 2005 discloses in greater detail the use of a dryer bed to remove sulfur, Ash, mercury, and other undesirable constituents from coal, and is hereby incorporated by reference.

Advantages' of lower moisture content in the coal as it travels through this limited portion of the system include: drier coal is easier to pulverize, and less mill power is needed to achieve the same grind size (coal fineness); increased mill exit temperature (the temperature of the coal and primary air mixture at mill exit); and better conveying (less plugging) of coal in coal pipes which convey the coal to the furnace 530. Additionally, less primary air stream 580 will be needed for coal drying and conveying. Lower primary air velocities have a significant positive impact on erosion in coal mill 524, coal pipes, burners and associated equipment, which reduces coal pipe and mill maintenance costs, which are, for lignite-fired plants, very high.

With drier coal, the flame temperature in the furnace 530 is higher due to lower moisture evaporation loss and the heat transfer processes is improved. The higher flame temperature results in larger radiation heat flux to the walls of furnace 530. Since the moisture content of the exiting flue gas 506 is reduced, radiation properties of the flame are changed, which also affects radiation flux to the walls of furnace 530. With higher flame temperature, the temperature of coal ash particles exiting the furnace 530, is higher, which could increase furnace fouling and slagging. Deposition of slag on furnace walls reduces heat transfer and results in a higher flue gas temperature at the furnace exit. Due to a reduction in coal flow rate as fuel moisture is reduced, the amount of ash entering the boiler will also be reduced. This reduces solid particle erosion in the boiler 534 and maintenance requirements for the boiler 534 (e.g., removal of the soot that collects on the interior surface of the boiler).

The flow rate of flue gas 506 leaving the furnace 530 firing dried, pulverized coal 526 is lower compared to wet pulverized coal. Lower flue gas rates generally permit decreased size of environmental control equipment. Also, the specific heat of the flue gas 506 is lower due to the lower moisture content in the dried, pulverized coal 526. The result is reduced thermal energy of the flue gas 506. Lower flow rates of the flue gas 506 also results in lower rates of convective heat transfer. Therefore, despite the increase in FEGT with drier fuel, less heat will be transferred to the working fluid (water or steam) in the boiler system convective pass.

For economic reasons, complete drying of the coal is not needed, nor is it recommended, as removing a fraction of the total fuel moisture is sufficient. The optimal fraction of removed moisture depends on the site-specific conditions, such as coal type and its characteristics, boiler design, and commercial arrangements (for example, sale of dried fuel to other power stations). The key is to leave enough moisture in the coal to provide the necessary mass flow for the heat transfer to the main steam and reheat steam flows within the electrical generation plant. Otherwise, there will be insufficient steam produced by the boiler to drive the turbines. Waste process heat is preferably, but not exclusively used for heat and/or fluidization (drying, fluidization air 582) for use in an in-bed heat exchanger. As has been shown, this heat can be supplied directly or indirectly in one or more stages.

As previously discussed, screw auger 194 contained within trough 190 of the distributor plate 180 of the first fluidization dryer bed stage 254 (see FIGS. 7-8 and 15) generally transports the denser, non-fluidizable, undercut coal particles lying at the bottom of the bed in a horizontal direction the side of the dryer bed. Such undercut material may simply be left to accumulate at the side of the dryer bed until the dryer needs to be periodically shut down to permit its removal, while still realizing an improvement in the overall transport flow of the fluidized coal particles to the discharge end of the dryer bed compared with a dryer without such a screw auger. A preferred embodiment of the fluidized-bed dryer, however, incorporates a scrubber assembly for automatic removal of this accumulation of undercut coal particles from the fluidized dryer bed region while the dryer is in operation in order to reduce the need for such maintenance clean out of the dryer bed that interferes with its continuous operation. By automatically removing such non-fluidizable undercut particles, they may be treated as a separate coal process stream according to their compositional makeup and industrial power plant need, including sending them to the boiler furnace for combustion; processing them to remove any additional fines that may be captured amongst the undercut particles; processing the undercut particles to remove undesirable constituents like elemental sulfur, Ash, or mercury; or disposing of the undercut particles in an appropriate landfill.

Figure 25A:
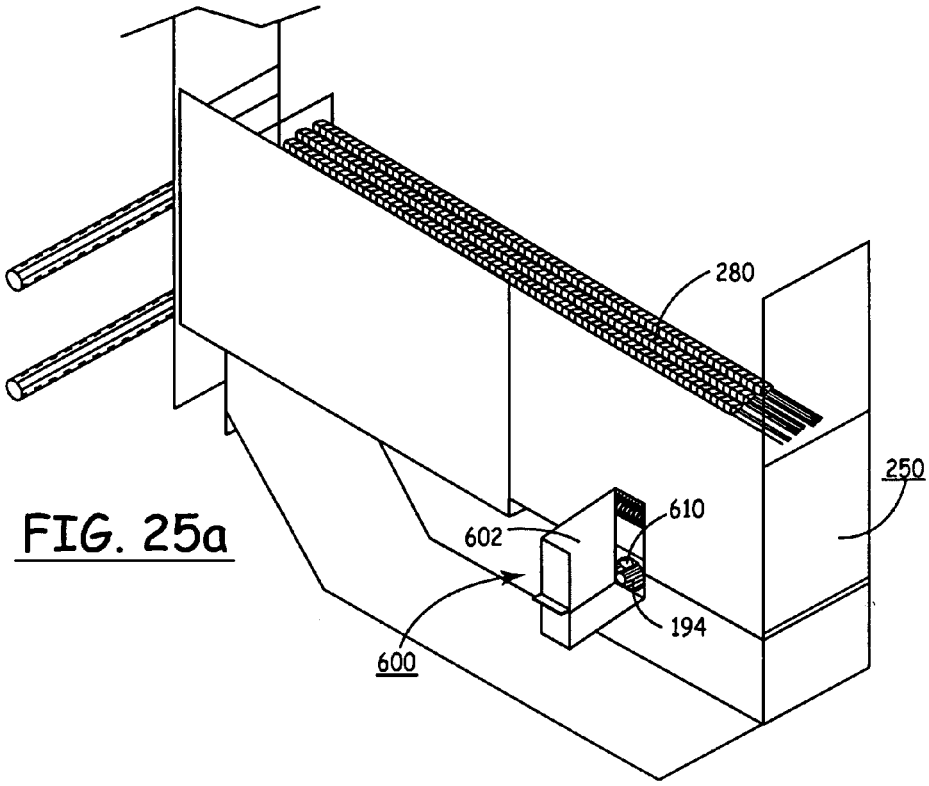
FIGS. 25*a* and 25*b* are perspective cut-away views of the scrubber assembly used to remove undercut particulate from the fluidized-bed dryer.
Figure 25B:
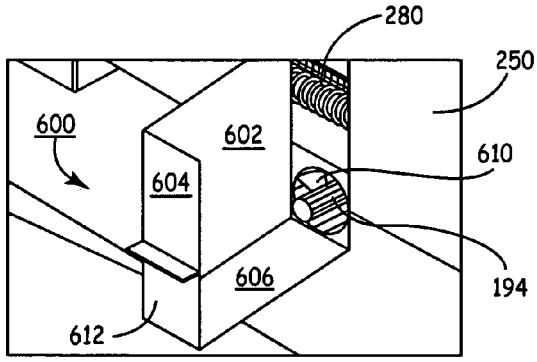

An embodiment of the scrubber assembly 600 of the present invention is shown in a cut-away view in FIGS. 25*a* and 25*b*. The scrubber assembly 600 is a box-like enclosure having side walls 602, an endwall 604, bottom 606, and top 608 (not shown), and is attached to the dryer 250 sidewall to encompass an undercut discharge port 610 through which the screw auger 194 partially extends. It should be noted that any other appropriate device that is capable of conveying the undercut coal particles in a horizontal manner could be substituted for the screw auger, including a belt, ram, or drag chain.

The screw auger 194 will move the undercut particles lying near the bottom of the fluidized bed across the bed, through undercut discharge part 610, and into scrubber assembly 600 where they can accumulate separate and apart from the fluidized dryer. This eliminates the need to shut down the dryer to remove the accumulated undercut particles. When the undercut particles contained within the scrubber assembly have accumulated to a sufficient degree, or are otherwise needed for another purpose, gate 612 in end wall 604 may be opened to allow the accumulated undercut particles to be discharged through an outlet hole in the end wall wherein these undercut particles are pushed by the positive pressure of the imposed by screw auger 294 on the undercut particles through them, or by other suitable mechanical conveyance means. Gate 612 could also be operated by a timer circuit so that it opens on a periodic schedule to discharge the accumulated undercut particles.

Figure 26:
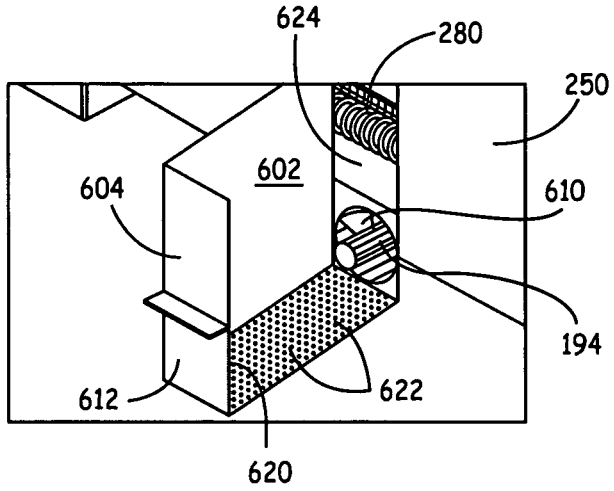
FIG. 26 is a perspective cut-away view of the scrubber assembly containing a distributor plate for fluidizing particulate material within the scrubber assembly.

A preferred embodiment of the scrubber box 600 is shown in FIG. 26, wherein a distributor plate 620 has been substituted for the solid floor panel 606 of the FIG. 25 embodiment. In this case, a substream of hot fluidizing air 206 passes upwardly through holes 622 in distributor plate 620 to fluidize the undercut particle stream contained within the scrubber assembly. Of course, the undercut particles will reside near the bottom of the fluidized bed due to their greater specific gravity, but any elutriated fines trapped amongst these undercut particles will rise to the top of the fluidized bed, and be sucked back into the fluidized dryer bed 250 through inlet hole 624 (the heat exchanger coils 280 are shown through this hole in FIG. 26). In this manner, the undercut particles stream is further processed within the scrubber assembly of FIG. 26 to clean out the elutriated fines, leaving a purer stream of undercut particles for further processing, productive use, or disposal.

Figure 27:
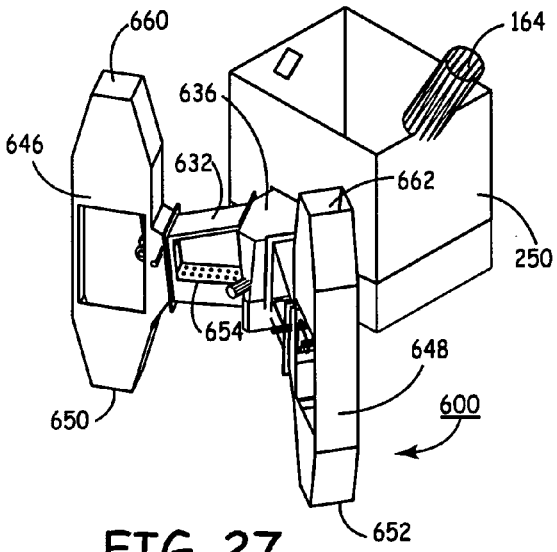
FIG. 27 is perspective view of another scrubber assembly embodiment of the present invention.
Figure 28:
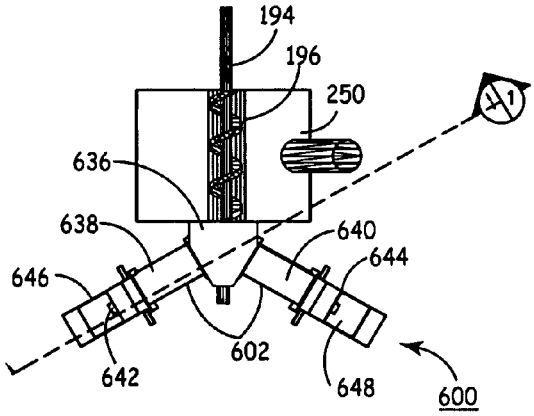
FIG. 28 is a plan view of the scrubber assembly of FIG. 27.
Figure 29:
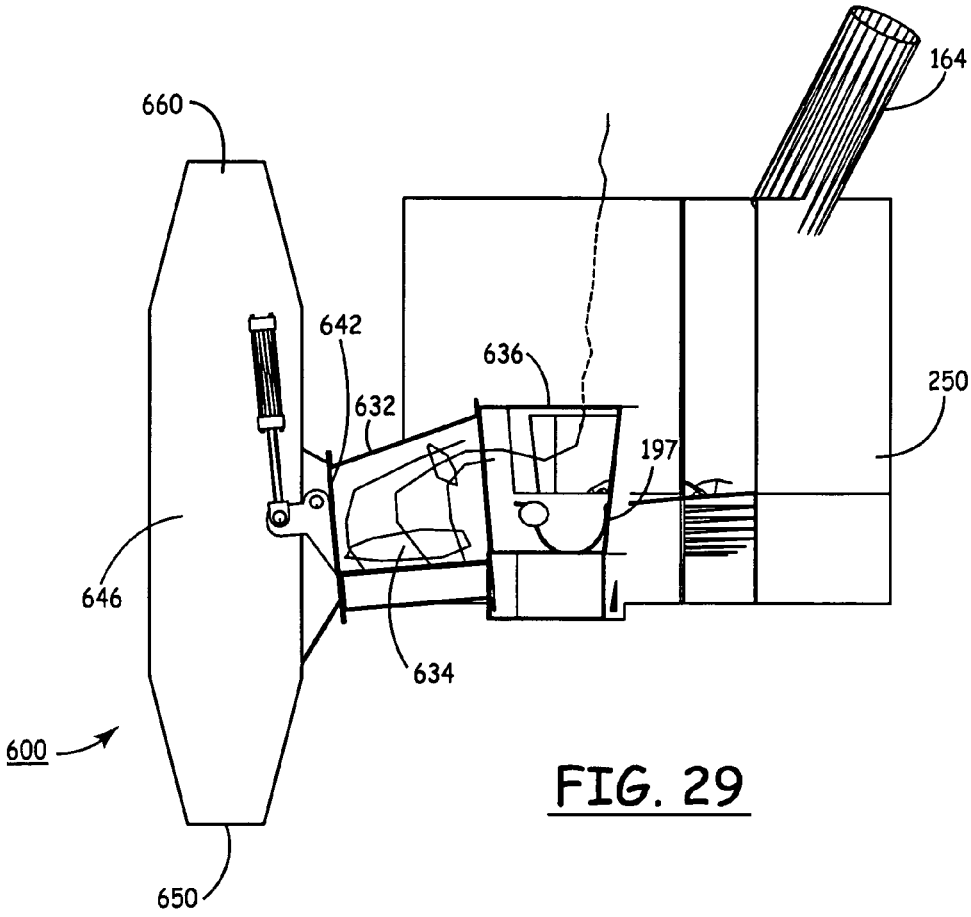
FIG. 29 is an enlarged perspective view of a portion of the scrubber assembly shown in FIG. 27.

Yet another embodiment 630 of the scrubber assembly is shown in FIG. 27-29, constituting two scrubber subassemblies 632 and 634 for handling larger volumes of undercut particles produced by the fluidized-bed dryer 250. As can be seen more clearly in FIG. 28, screw auger 194 extends through vestibule 636. Undercut coal particles are conveyed by screw auger 194 to this vestibule 636 and then into collection chambers 638 and 640 which terminate in gates 642 and 644, respectively, or other appropriate type of flow control means. Once a predetermined volume of undercut particles have accumulated within the collection chambers 638 and 640, or a predetermined amount of time has elapsed, then gates 642 and 644 are opened to permit the undercut particles to be discharged into chutes 646 and 648, respectively. The undercut particles will fall by means of gravity through outlet parts 650 and 652 in the bottom of chutes 646 and 648 into some other storage vessel or conveyance means for further use, further processing, or disposal.

As discussed above, distributor plates 654 and 656 may be included inside the collection chambers 638 and 640 (see FIG. 30) so that a fluidizing airstream passed through holes 658 and 660 in the distributor plates fluidize the undercut particles to separate any elutriated fines trapped amongst the denser undercut particles. Once gates 642 and 644 are opened, the elutriated fines will rise to the tops of chutes 646 and 648 through holes 660 and 662 for conveyance by suitable mechanical means back to the fluidized bed dryer 250. The undercut particles will drop through the bottom of chutes 646 and 648, as previously described.

Gates 642 and 644 may be pivotably coupled to the collection chambers 638 and 640, although these gates may also be slidably disposed, upwardly pivoting, downwardly pivoting, laterally pivoting, or any other appropriate arrangement. Additionally, multiple gates may be operatively associated with a collection chamber to increase the speed of discharge of the undercut coal particles therefrom.

Use of the undercut particles separated from the dryer 250 by the scrubber assembly 600 will depend upon its composition. If these undercut particles contain acceptable levels of sulfur, ash, mercury, and other undesirable constituents, then they may be conveyed to the furnace boiler for combustion, since they contain desirable heat values. If the undesirable constituents contained within these undercut particles are unacceptably high, however, then the undercut particles may be further processed to remove some or all of the levels of these undesirable constituents, as disclosed more fully in U.S. Ser. Nos. 11/107,152 and 11/107,153, both of which were filed on Apr. 15, 2005 and share a common co-inventor and co-owner with this application, and are incorporated hereby. Only if the levels of undesirable constituents contained within the undercut particles are so high that they cannot be viably reduced through further processing will the undercut particles be disposed of in a landfill, since this wastes the desirable heat values contained within the undercut particles. Thus, the scrubber assembly 600 of the present invention not only allows the undercut coal particles stream to be automatically removed from the fluidized bed to enhance the efficient and continuous operation of the dryer, but also permits these undercut particles to be further processed and productively used within the electricity generation plant or other industrial plant operation.

The following examples illustrate the low-temperature coal dryer that forms a part of the present invention.

Example I

Effect of Moisture Reduction on Improvement in Heat Value of Lignite Coal

A coal test burn was conducted at Great River Energy's Coal Creek Unit 2 in North Dakota to determine the effect on unit operations. Lignite was dried for this test by an outdoor stockpile coal drying system. The results are shown in FIG. 21.

Figure 30:
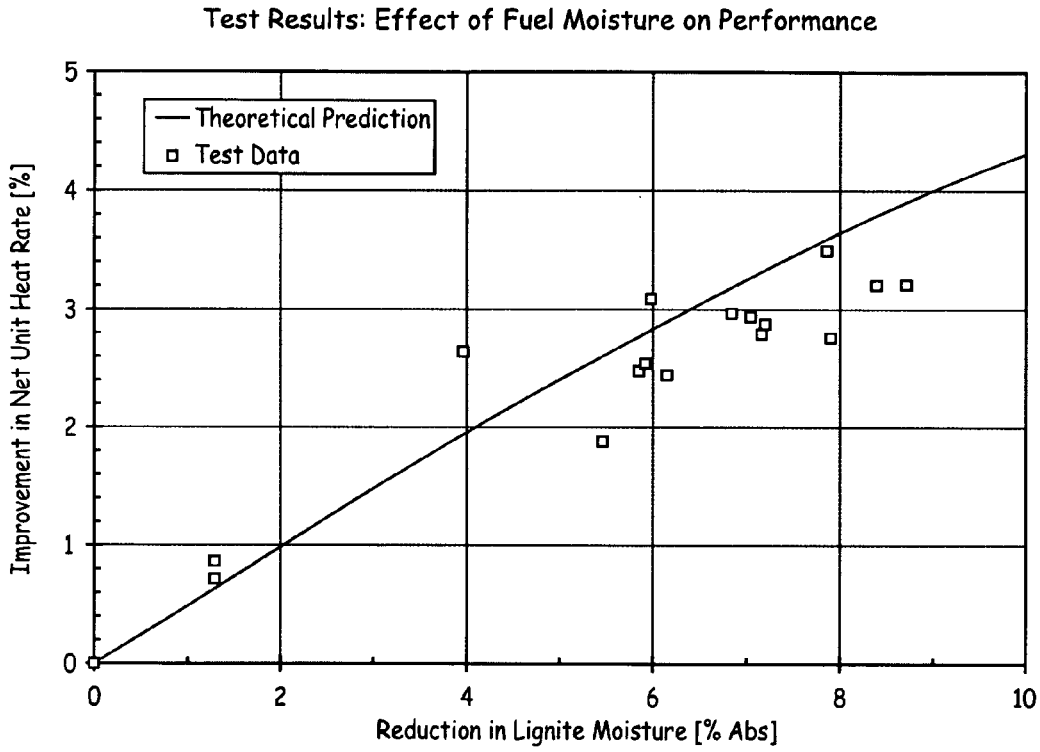
FIG. 30 is a graphical depiction of the improvement in net unit heat rate for coal at different levels of reduced moisture.

As can be clearly seen, on average, the coal moisture was reduced by 6.1% from 37.5% to 31.4%. These results were in close agreement with theoretical predictions, as shown in FIG. 30. More importantly, a 6% reduction in moisture content of the lignite coal translated to approximately a 2.8% improvement in the net unit heat rate of the coal when combusted, while an 8% moisture reduction produced approximately a 3.6% improvement in net unit heat rate for the lignite coal. This demonstrates that drying the coal does, in fact, increase its heat value.

Example II

Effect of Moisture Reduction on the Coal Composition

PRB coal and lignite coal samples were subjected to chemical and moisture analysis to determine their elemental and moisture composition. The results are reported in Table 1 below. As can be seen, the lignite sample of coal exhibited on average 34.03% wt carbon, 10.97% wt oxygen, 12.30% wt fly ash, 0.51% wt sulfur, and 38.50% wt moisture. The PRB subbituminous coal sample meanwhile exhibited on average 49.22% wt carbon, 10.91% wt oxygen, 5.28% wt fly ash, 0.35% wt sulfur, and 30.00% moisture.

An "ultimate analysis" was conducted using the "as-received" values for these lignite and PRB coal samples to calculate revised values for these elemental composition values, assuming 0% moisture and 0% ash ("moisture and ash-free"), and 20% moisture levels, which are also reported in Table 1. As can be seen in Table 1, the chemical compositions and moisture levels of the coal samples significantly change. More specifically for the 20% moisture case, the lignite and PRB coal samples exhibit large increases in carbon content to 44.27% wt and 56.25% wt, respectively, along with smaller increases in oxygen content to 14.27% wt and 12.47% wt, respectively. The sulfur and fly ash constituents increase slightly too (although not on an absolute basis?). Just as importantly, the heat value (HHV) for the lignite coal increased from 6,406 BTU/lb to 8,333 BTU/lb, while the HHV value for the PBR coal increased from 8,348 BTU/lb to 9,541 BTU/lb.

TABLE 1

| | | As-Received | | Moisture & Ash-Free | | 20% Fuel Moisture | |
|---|---|---|---|---|---|---|---|
| | Units | Lignite | PRB | Lignite | PRB | Lignite | PRB |
| Carbon | % wt | 34.03 | 49.22 | 69.17 | 76.05 | 44.27 | 56.25 |
| Hydrogen | % wt | 2.97 | 3.49 | 6.04 | 5.39 | 3.87 | 3.99 |
| Sulfur | % wt | 0.51 | 0.35 | 1.04 | 0.54 | 0.67 | 0.40 |
| Oxygen | % wt | 10.97 | 10.91 | 22.29 | 16.86 | 14.27 | 12.47 |
| Nitrogen | % wt | 0.72 | 0.75 | 1.46 | 1.16 | 0.92 | 0.86 |
| Moisture | % wt | 38.50 | 30.00 | 0.00 | 0.00 | 20.00 | 20.00 |
| Ash | % wt | 12.30 | 5.28 | 0.00 | 0.00 | 16.00 | 6.30 |
| TOTAL | % wt | 100.00 | 100.00 | 100.00 | 100.00 | 100.00 | 100.00 |
| HHV | BTU/lb | 6,406 | 8,348 | 13,021 | 12,899 | 8,333 | 9,541 |
| $H^T_{fuel}$ | BTU/lb | −2,879 | 2,807 | | | −1,664 | −2,217 |

Example III

Effect of Moisture Level on Coal Heat Value

Figure 31:
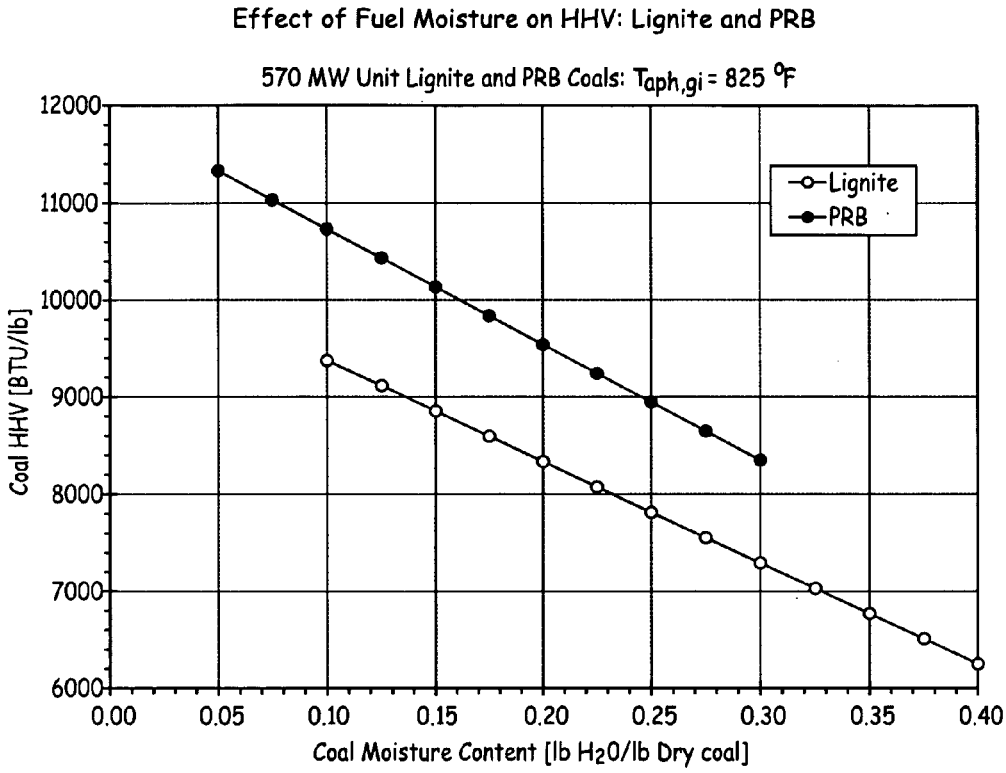
FIG. 31 is a graphical depiction of HHV measures for lignite and PRB coals at different moisture contents.

Using the compositional values from Table 1, and assuming a 570 MW power plant releasing 825° F. flue gas, ultimate analysis calculations were performed to predict the HHV heat values for these coal samples at different moisture levels from 5% to 40%. The results are shown in FIG. 31. As can be clearly seen, a linear relationship exists between HHV value and moisture level with higher HHV values at lower moisture levels. More specifically, the PRB coal sample produced HHV values of 11,300 BTU/lb at 5% moisture, 9,541 BTU/lb at 20% moisture, and only 8,400 BTU/lb at 30% moisture. Meanwhile, the lignite coal sample produced HHV values of 9,400 BTU/lb at 10% moisture, 8,333 BTU/lb at 20% moisture, and only 6,200 BTU/lb at 40%. This suggests that boiler efficiency can be enhanced by drying the coal prior to its combustion in the boiler furnace. Moreover, less coal is required to produce the same amount of heat in the boiler.

Example IV

Pilot Dryer Coal Drying Results

During the Fall of 2003 and Summer of 2004, over 200 tons of lignite was dried in the pilot fluidized bed coal drier built by Great River Energy at Underwood, N. Dak. The dryer capacity was 2 tons/hr and was designed for determining the economics of drying North Dakota lignite using low-temperature waste heat and determining the effectiveness of concentrating impurities such as mercury, ash and sulfur using the gravimetric separation capabilities of a fluidized bed.

Coal streams in and out of the dryer included the raw coal feed, processed coal stream, elutriated fines stream and the undercut. During tests, coal samples were taken from these streams and analyzed for moisture, heating value, sulfur, ash and mercury. Some of the samples were sized and further analysis was done on various size fractions.

The pilot coal dryer was instrumented to allow experimental determination of drying rates under a variety of operating conditions. A data collection system allowed the recording of dryer instruments on a 1-minute bases. The installed instrumentation was sufficient to allow for mass and energy balance calculations on the system.

Figure 32:
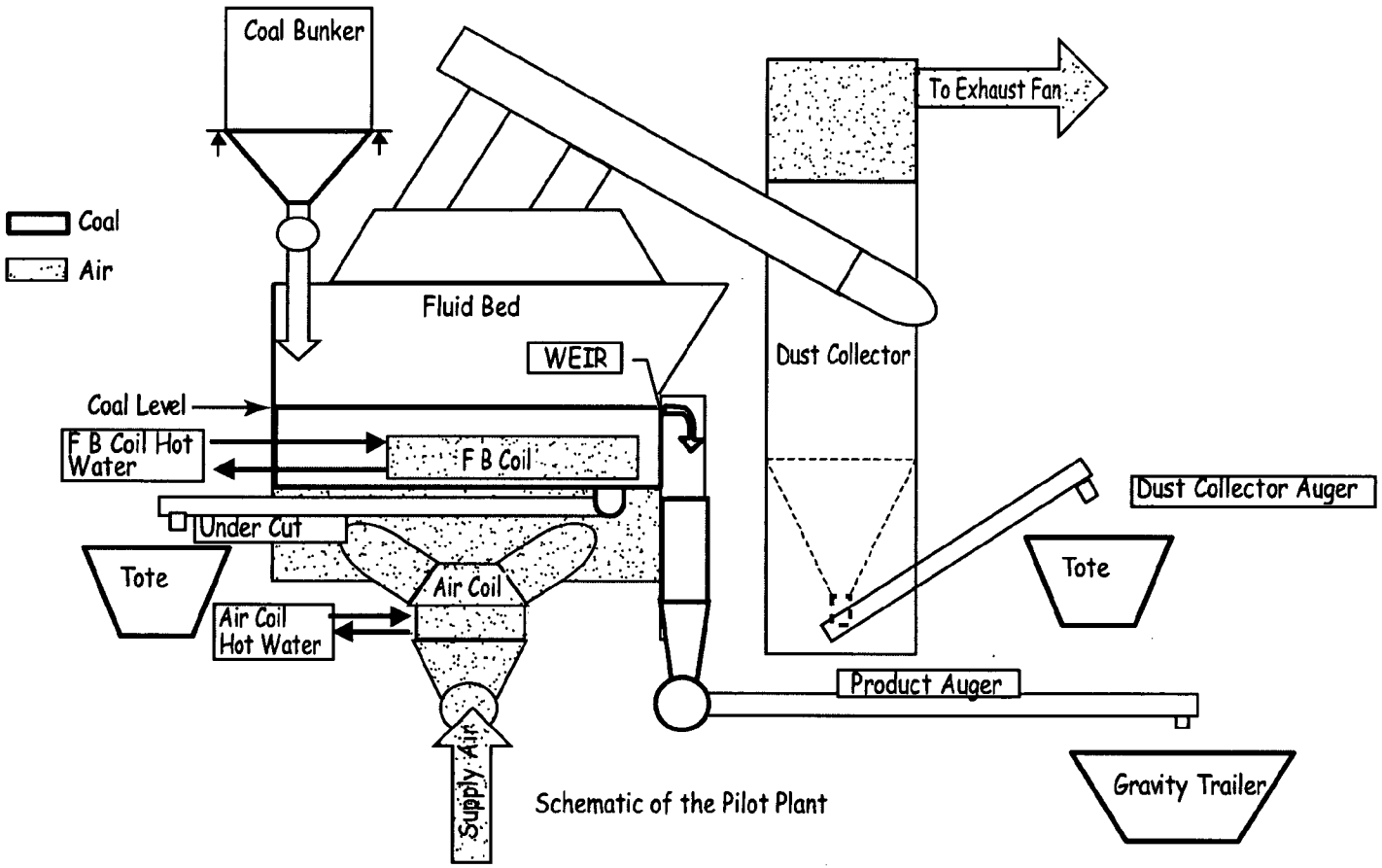
FIG. 32 is a schematic of a two-stage fluidized-bed pilot dryer of the present invention.
Figure 33:
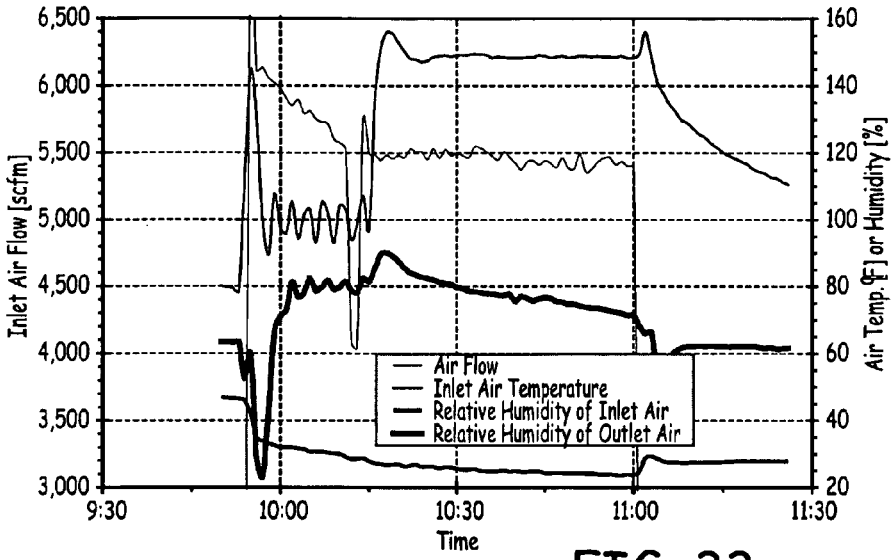
FIGS. 33-37 are graphical depictions of different operational characteristics of the fluidized-bed dryer of FIG. 32.

The main components of the pilot dryer were the coal screen, coal delivery equipment, storage bunker, fluidized bed dryer, air delivery and heating system, in-bed heat exchanger, environmental controls (dust collector), instrumentation, and a control and data acquisition systems (See FIG. 32). Screw augers were used for feeding coal in and products out of the dryer. Vane feeders are used to control feed rates and provide air lock on the coal streams in and out of the dryer. Load cells on the coal burner provided the flow rate and total coal input into the dryer. The undercut and dust collector elutriation were collected in totes which were weighted before and after the test. The output product stream was collected in a gravity trailer which was equipped with a scale. The coal feed system was designed to supply ¼-minus coal at up to 8000 lbs/hr to the dryer. The air system was designed to supply 6000 SCFM @ 40 inches of water. An air heating coil inputted 438,000 BTU/hr and the bed coil inputted about 250,000 BTUs/hr. This was enough heat and air flow to remove about 655 lbs of water per hour.

Typical tests involved filling the coal bunker with 18,000 lbs of ¼" minus coal. The totes would be emptied and the gravity trailer scale reading recorded. Coal samples on the feed stock were collected either while filling the bunker or during the testing at the same time interval as the dust collector, undercut and gravity trailer samples (normally every 30 minutes after achieving steady state.) The dust collector and all product augers and air locks were then started. The supply air fan was started and set to 5000 scfm. The coal feed to the dryer was then started and run at high speed to fill the dryer. Once the bed was established in the dryer, the air temperature was increased, heating was lined up to the bed coil, and the air flow adjusted to the desired value. The tests were then run for a period of 2-3 hours. One test was run for eight hours. After the test, the totes were weighed and the gravity trailer scale reading recorded. Instrument reading from the test was transferred to an excel spread sheet and the coal samples taken to the lab for analysis. The totes and gravity trailer were then emptied in preparation for the next test.

During the Fall of 2003, 150 tons of lignite was sent through the single-stage pilot dryer with a distribution area of 23.5 $ft^2$ in 39 different tests. Coal was fed into the fluidized bed at rates between 3000 to 5000 lbs/hr. Air flows were varied from 4400 (3.1 ft/sec) to 5400 (3.8 ft/sec) scfm. The moisture reduction in the coal is a function of the feed rate and the heat input to the drier. The $1^{st}$ pilot module had the ability to remove about 655 lb water per hour at the design water temperatures of 200° F. Feeding coal at 83.3 lbs/min, one would expect a water removal rate of 0.13 lbs/lb coal.

During the Summer of 2004 the dryer was modified to two stages and a larger bed coil was installed. After modifying the drier module, the drying capability was increased to about 750,000 BTU/hr and with a water removal rate of 1100 lbs/hr. An additional 50 tons of coal was dried in the new module. The modified module also allowed for the collection of an undercut stream off the $1^{st}$ stage. The undercut was nonfluidized material which was removed from the bottom of the $1^{st}$ stage. It was primarily made up of oversized and higher density material that was gravimetrically separated in the $1^{st}$ stage. The materials, temperature, and heat balances for the different inlet and outlet flows are depicted in Tables 2-4. The total distributor plate area was 22.5 $ft.^2$

TABLE 2

Pilot Dryer Test 44 Schematic Flow Chart

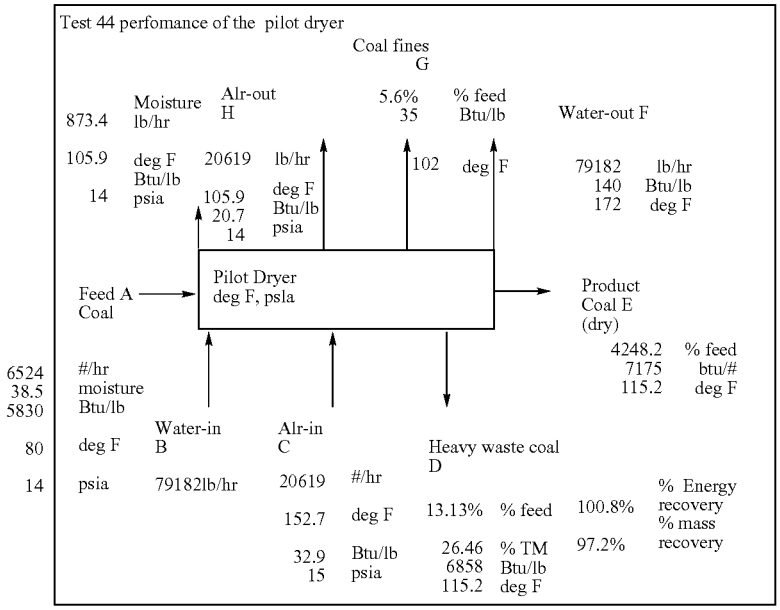

TABLE 3

Pilot Test 44 Results

| Point | | Test 44 Parameter | Results | |
|---|---|---|---|---|
| Feed | A | #/hr | 6524 | |
| | | TM | 31.48 | 2053.8 |
| | | ARA | 15.21 | |
| | | HHV | 5830 | |
| | | ARS | 0.53 | |
| | | AR merc. | 68.8 | |
| | | Temp F. | 80 | |
| | B | FB water in | | |
| | | Flow #/hr | 79182 | |
| | | Temp F. | 179.4 | |
| | | Heat in btu/hr | 11671143 | |
| | C | FB air in | | |
| | | Flow #/hr | 20619 | |
| | | Temp F. | 152.7 | |
| | | Heat in btu/hr | 679287 | |
| | | HW | | |
| | | #H20/#Dair | 0.0137 | |
| | D | UC | | |
| | | #/hr, % | 856.6 | 13.13% |
| | | TM | 26.46 | 226.6 |
| | | ARA | 15.4 | |
| | | HHV | 6858 | 900.406 |
| | | ARS | 0.76 | |
| | | AR merc. | 117.6 | |
| | | Temp F. | 115.2 | |
| | E | GT | | |
| | | #/hr | 4248.2 | 65.1% |
| | | TM | 24.5 | 1040.8 |
| | | ARA | 14.22 | |
| | | HHV | 7175 | 4672.082 |
| | | ARS | 0.55 | |
| | | AR merc. | 55.35 | |
| | | Temp F. | 115.2 | |
| | F | FB water out | | |
| | | Flow #/hr | 79182 | |
| | | Temp F. | 172 | |
| | | Heat in btu/hr | 11085480 | |

TABLE 3-continued

Pilot Test 44 Results

| Point | | Test 44 Parameter | Results | |
|---|---|---|---|---|
| | G | DC | | |
| | | #/hr | 363.7 | 5.6% |
| | | TM | 21.22 | 77.2 |
| | | ARA | 30.26 | |
| | | HHV | 5434 | 302.9223 |
| | | ARS | 0.5 | |
| | | AR merc. | 117.6 | |
| | | Temp F. | 102 | |
| | H | FB air out | | |
| | | Flow #/hr | 20619 | |
| | | Temp F. | 105.9 | |
| | | Heat in btu/hr | 427101 | |
| | | HW | | |
| | | #H20/#Dair | 0.05606 | |
| | | FB moisture | | |
| | I | out | | |
| | | Hwout − Hwin * m | 873.4 | 13.39% |
| | | mass balance | | 97.21% |
| | | coal HHV bal | | 100.8% |
| | | water balance | | 108.0% |

As can be seen, the moisture was reduced from 31.5% in the coal feed to 24.5% in the coal product ("GT") stream. Thus, the pilot coal dryer demonstrated that North Dakota Lignite can be dried reliably and economically using low temperature waste heat from a power plant.

Table 4 shows the coal quality for the dryer feed, elutriation, undercut and product streams. The data indicates that the elutriation stream was high is mercury and ash, the undercut stream was high in mercury and sulfur, and the product stream experienced a significant improvement in heating value, mercury, ash and $SO_2$/mbtus. The elutriation stream was primarily 40-mesh minus and the undercut stream was 8-mesh plus.

TABLE 4

Coal Feed Quality Verses Product Streams Test 44

| Coal | Pounds | Mercury ppb | Ash % | HHV BTUs/lb | Sulfur % | #$SO_2$/ mbtu |
|---|---|---|---|---|---|---|
| Feed | 14902 | 91.20 | 18.05 | 5830.00 | 0.53 | 1.82 |
| Undercut | 2714 | 100.61 | 15.41 | 6877.00 | 0.76 | 2.20 |
| Elutriation | 789 | 136.58 | 30.26 | 5433.75 | 0.50 | 1.86 |
| Product | 7695 | 65.83 | 14.22 | 7175.25 | 0.55 | 1.54 |

Therefore, Test 44 reduced the mercury and sulfur in the coal product stream by 40% and 15%, respectively.

Figure 34:
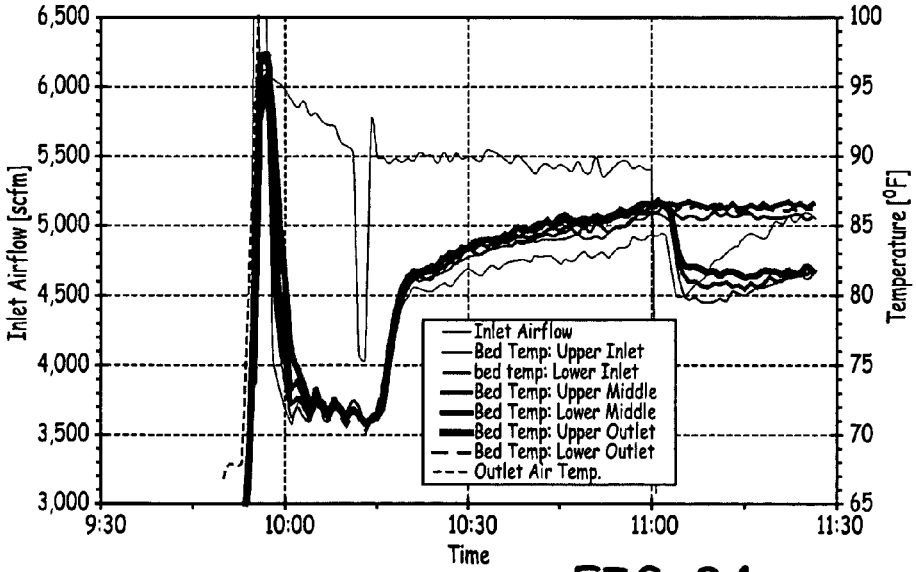

Time variation of bed temperature, measured at six locations within the bed, and outlet air temperature are presented in FIG. 34. This information was used, along with the information on coal moisture content (obtained from coal samples) to close the mass and energy balance for the dryer and determine the amount or removed moisture from coal.

Figure 35:
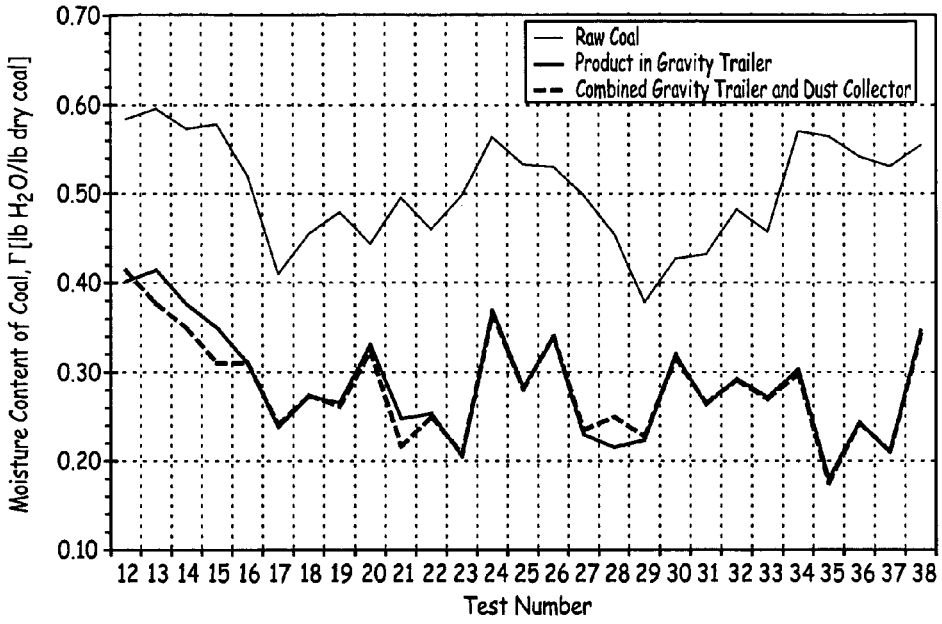

Moisture contents in the feed and product streams, determined from coal samples and expressed as pounds of coal moisture per pound of dry coal, are presented in FIG. 35. The results show that inlet coal moisture varied from 0.40 to 0.60 lb $H_2O$/lb dry coal (28.5 to 37.5% on wet coal basis), while the moisture in the product stream varied from 0.20 to 0.40 lb $H_2O$/lb dry coal (16.5 to 28.5% on wet coal basis). In other words, the low-temperature, fluidized-bed drying process was effective in removing approximately ten percentage points of moisture with the bed residence time on the order of 30 minutes. Higher-temperature fluidizing air or higher in-bed heat exchanger heat input resulted in increased moisture removal rates. Moisture-free heat content values obtained for the feed and product streams indicated that no appreciable carbon oxidation and devolatilization occurred during the drying process.

The amount of moisture removed from coal during the drying process was determined by four methods, which included the total mass balance for the dryer, air moisture balance, coal moisture balance, and total energy balance for the dryer. The total energy balance method was based on balancing heat flows in and out of the dryer, such as: heat input by the in-bed heat exchanger and changes in sensible heats of air and coal across the dryer, and on the assumption that the difference represents the heat required to evaporate water in the coal. No losses to the environment were assumed. The air moisture balance method was based on the measurement of air flow rate and inlet and outlet air humidity. The amount of evaporated coal moisture was calculated from the difference in specific humidity of the inlet and outlet air flow streams and the air flow rate. Similarly, the coal moisture balance method was based on the moisture measured in the feed and product coal streams and flow rates of these streams. The total mass balance approach was based on the difference in mass between the input raw coal and the output product streams, correcting for the material left in the bed, coal samples and a one percent leakage rate. The resulting difference was assumed to be water removed from the coal.

Figure 36:
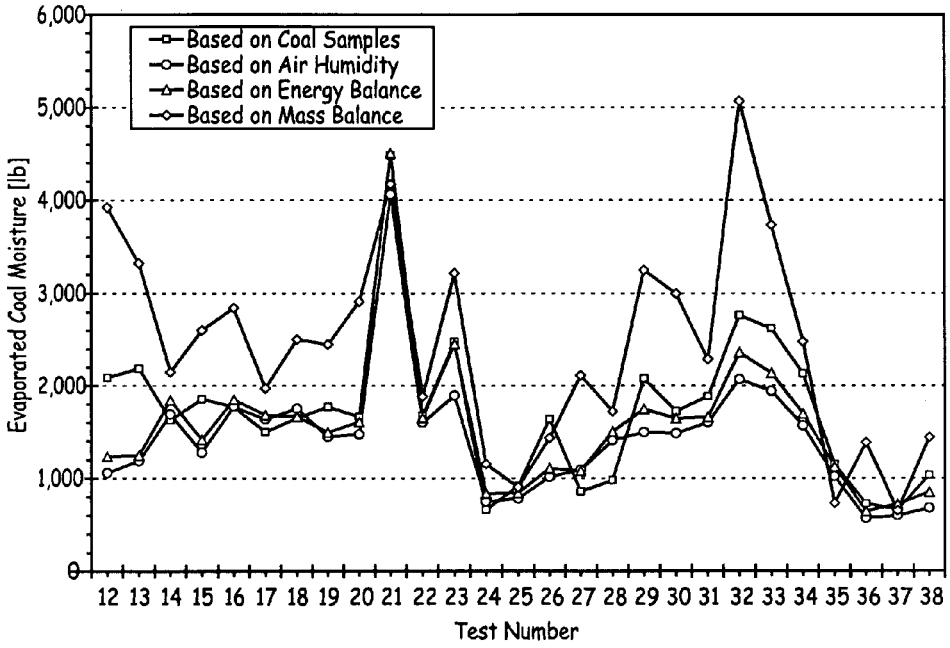

Results of the calculations, presented in FIG. 36, show that a close agreement in removed coal moisture, calculated by four different methods was achieved.

Figure 37:
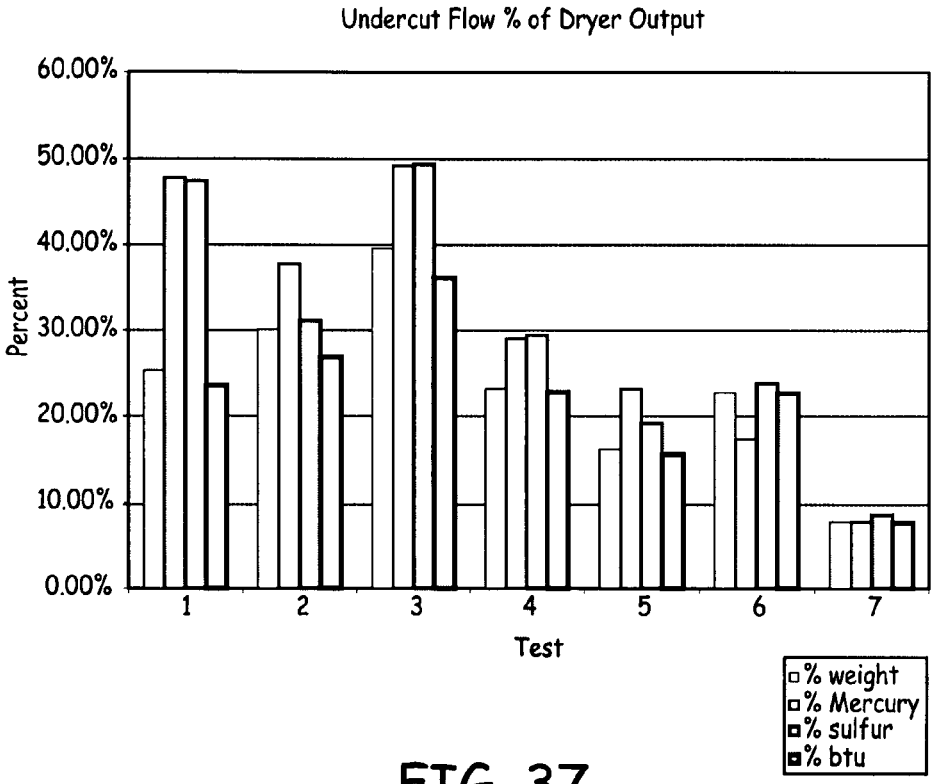

FIG. 37 shows the makeup of the undercut product for the 7 tests using the modified pilot dryer. Test 41 had the best results with containing 48% of the sulfur and mercury and only 23% of the btu and 25% of the weight. Applying the results from the air jig test in Module 4 we could expect to remove 37% of 48% for the mercury 18%, 27% of 48% for the sulfur 13% and 7.1 of 23% for BTU loss 1.6%.

The above specification and drawings provide a complete description of the structure and operation of the heat treatment apparatus of the present invention. However, the invention is capable of use in various other combinations, modifications, embodiments, and environments without departing from the spirit and scope of the invention. For example, it can be utilized with any combination of direct or indirect heat source, fluidized or non-fluidized beds, and single or multiple stages. Moreover, the drying approach described in this invention is not limited to enhancing the quality of coal to be burned in the utility or industrial boilers but can also be applied to dry particulate materials for the glass, aluminum, pulp and paper and other industries. For example, sand used as a feedstock in the glass industry can be dried and preheated by a fluidized bed dryer using waste heat harvested from flue gas exiting the furnace stack before the sand is fed to the glass furnace. This will improve thermal efficiency of the glass-making process. Moreover, the invention can be used for amine scrubber regeneration.

As another example, a fluidized bed dryer can be used as a calcinatory in aluminum production. To refine alumina from raw bauxite ore, the ore is broken up and screened when necessary to remove large impurities like stone. The crushed bauxite is then mixed in a solution of hot caustic soda in digesters. This allows the alumina hydrate to be dissolved from the ore. After the red mud residue is removed by decantation and filtration, the caustic solution is piped into huge tanks, called precipitators, where alumina hydrate crystallizes. The hydrate is then filtered and sent to calciners to dry and under very high temperature, is transformed into the fine, white powder known as alumina. The present invention could be used as a calciner in this and similar processes.

As still another example for purposes of illustration, waste heat sources could be applied to a greenhouse used to grow tomatoes or other crops. Therefore, the description is not intended to limit the invention to the particular form disclosed.

We claim:

1. An apparatus for heat treating a product within a manufacturing operation to which at least two different types of waste heat are accessible, comprising:

(a) a vessel for receiving the product;

(b) a first waste heat source of heat;

(c) a first heat exchanger operatively connected to the vessel with the such first waste heat source provided to such first heat exchanger;

(d) a second waste heat source of heat different in type from the first waste heat source;

(e) a second heat exchanger operatively connect to the vessel with such second waste heat source provided to such second heat exchanger;

(f) whereby predetermined amounts of heat content contained within the first waste heat source and second waste heat source are delivered to the vessel;

(g) wherein the product is maintained within the vessel exposed to the combined first waste heat source and second waste heat source for a sufficient temperature and time duration to achieve the desired degree of heat treatment;

(h) a sparging pipe operatively connected to the vessel for delivering a gaseous stream to the vessel during the heat treatment process to reduce the incidence of condensation within the vessel; and (i) wherein "waste heat source" means a gaseous or liquid stream having an elevated heat content resulting from an operation of a process or piece of equipment separate from the heat treatment apparatus, such gaseous or liquid stream being used for the secondary purpose of providing heat content to the heat exchanger instead of being discarded.

2. The heat treatment apparatus of claim 1, wherein the waste heat source is selected from the group consisting of cooling water streams, hot condenser cooling water, hot stack gas, hot flue gas, spent process steam, and discarded heat from operating equipment.

3. The heat treatment apparatus of claim 1, wherein the vessel is a fluidized-bed dryer.

4. The heat treatment apparatus of claim 1, wherein the vessel is a fixed-bed dryer.

5. The heat treatment apparatus of claim 1, wherein the product is particulate material.

6. The heat treatment apparatus of claim 1, wherein the equipment is used within an electricity power plant.

7. The heat treatment apparatus of claim 1, wherein the temperature delivered to the vessel by the heat source is about 300° F. or less.

8. The heat treatment apparatus of claim 1 further comprising at least one additional heat source in the form of a waste heat source or a principal heat source delivered to the vessel by means of an associated heat exchanger, wherein "principal heat source" means a quantity of heat produced for the principal purpose of providing heat content to the associated heat exchanger.

9. The heat treatment apparatus of claim 1 further comprising a conveyor means contained within the vessel for transporting a portion of the product having a higher specific gravity than the specific gravity of other product contained within the vessel during the heat treatment process to a remote region of the vessel to enhance heat treatment of the remaining, lower-specific gravity product within the vessel.

10. The heat treatment apparatus of claim 9, wherein the conveyor means is a screw auger.

11. The heat treatment apparatus of claim 9 further comprising a scrubber assembly operatively associated with the vessel whereby the conveyor means transports the higher specific gravity portion of the product during the heat treatment process completely outside of the vessel into the scrubber assembly for further processing, use, or disposal of the product.

12. The heat treatment apparatus of claim 11, wherein the further processing of the higher specific gravity portion of the product comprises removal of residual lower specific gravity product that is entrapped within the higher specific gravity product.

13. The heat treatment apparatus of claim 11, wherein the further processing of the higher specific gravity portion of the product comprises treatment of at least one undesirable constituent contained within the product.

14. The heat treatment apparatus of claim 13, wherein the undesirable constituents is selected from the group consisting of sulfur, ash, and mercury.

15. The heat content apparatus of claim 1, wherein the heat treatment of the product comprises a reduction in moisture content of the product.

16. The heat treatment apparatus of claim 5, wherein the particulate material comprises coal.

17. An apparatus for drying product, for use in an industrial plant having a waste heat source, comprising:

(a) a fluidized-bed dryer unit having an interior for receiving the product, wherein product disposed in the dryer unit travels from one end of the dryer to the other end while being dried;

(b) an air or inert gas fluidizing stream for fluidizing the product particles contained within the dryer unit;

(c) a first heat exchanger for transferring heat from the waste heat source to the fluidizing stream to increase its temperature before it flows to and through the dryer unit;

(d) a second heat exchanger for transferring heat from the waste heat source to a third heat exchanger embedded within the dryer unit;

(e) wherein the interior of the vessel is heated to about 300° F. or less; and (f) wherein "waste heat source" means a gaseous or liquid stream having an elevated heat content resulting from an operation of a process or piece of equipment separate from the heat treatment apparatus, such gaseous or liquid stream being used for the secondary purpose of providing heat content to the heat exchanger instead of being discarded.

18. The coal drying apparatus of claim 17 further comprising a second waste heat source different in type from the first waste heat source, wherein a combination of the heat contained within the two waste heat sources is delivered via associated heat exchangers to the first heat exchanger operatively associated with the fluidizing stream, or the second heat exchanger operatively associated with the third heat exchanger embedded within the dryer unit.

19. A particulate material drying apparatus incorporated into an industrial plant operation having at least two different types of waste heat, such apparatus comprising:

(a) a fluidized-bed dryer unit having an interior for receiving the particulate material, wherein particulate material disposed in the dryer unit travels from one end of the dryer to the other end while being dried;

(b) an air pre-heater operatively disposed between the dryer unit and the two different waste heat sources to transfer heat from each of the waste heat sources to an air stream passing through the air pre-heater before it flows to and through the dryer unit, wherein the air stream fluidizes the particulate material particles contained within dryer unit;

(c) a heat exchanger operatively connected to the dryer unit for transferring heat from at least one of the waste heat sources to the dryer unit for increasing the interior temperature of the dryer unit; and (d) wherein "waste heat source" means a gaseous or liquid stream having an elevated heat content resulting from an operation of a process or piece of equipment separate from the heat treatment apparatus, such gaseous or liquid stream being used for the secondary purpose of providing heat content to the heat exchanger instead of being discarded.

* * * * *